US010380823B2

(12) United States Patent
Fukuda et al.

(10) Patent No.: US 10,380,823 B2
(45) Date of Patent: Aug. 13, 2019

(54) ARTICLE DISPENSING APPARATUS

(71) Applicant: FUJI ELECTRIC CO., LTD., Kawasaki-shi, Kanagawa (JP)

(72) Inventors: Katsuhiko Fukuda, Yokkaichi (JP); Hajime Erikawa, Kumagaya (JP); Yuji Tachi, Yokkaichi (JP); Shirou Takeuchi, Yokkaichi (JP); Tsutomu Iwako, Yokkaichi (JP)

(73) Assignee: FIJU ELECTRIC CO., LTD., Kawasaki-Shi, Kanagawa (JP)

( * ) Notice: Subject to any disclaimer, the term of this patent is extended or adjusted under 35 U.S.C. 154(b) by 240 days.

(21) Appl. No.: 15/657,880

(22) Filed: Jul. 24, 2017

(65) Prior Publication Data

US 2017/0323512 A1 Nov. 9, 2017

Related U.S. Application Data

(63) Continuation of application No. PCT/JP2015/083815, filed on Dec. 1, 2015.

(30) Foreign Application Priority Data

Feb. 27, 2015 (JP) ..... 2015-039448
Feb. 27, 2015 (JP) ..... 2015-039449
Mar. 17, 2015 (JP) ..... 2015-053918

(51) Int. Cl.
*G07F 11/24* (2006.01)
*G07F 9/02* (2006.01)
*G07F 11/10* (2006.01)

(52) U.S. Cl.
CPC ..... *G07F 11/24* (2013.01); *G07F 9/026* (2013.01); *G07F 11/10* (2013.01)

(58) Field of Classification Search
None
See application file for complete search history.

(56) References Cited

U.S. PATENT DOCUMENTS 4,854,477 A 8/1989 Kurosawa et al.
6,467,648 B1 * 10/2002 Nishiyama ..... G07F 11/06 221/289

(Continued)

FOREIGN PATENT DOCUMENTS

JP S60-225994 A 11/1985
JP S62-1291 U 1/1987

(Continued)

OTHER PUBLICATIONS

PCT/JP2015/083815 "International Search Report" dated Mar. 8, 2016.

*Primary Examiner* — Jacob S. Scott
*Assistant Examiner* — Ayodeji T Ojofeitimi
(74) *Attorney, Agent, or Firm* — Manabu Kanesaka

(57) ABSTRACT

An article dispensing apparatus includes an article discharging apparatus, which includes a base, an article storage passage storing articles, a lower pedal, and an upper pedal, an out-of-stock detection switch that is turned to a first state when the lower pedal is in a second standby position and that is turned to a second state when the lower pedal is in a position other than the second standby position; an output member putting the article discharging apparatus in the standby state and drives the article discharging apparatus when the output member rotates from the standby position; and a controller rotating the output member to return the output member to the standby position when the output member rotated from the standby position does not return to the standby position in a preset set time and when the out-of-stock detection switch is turned to the first state in the set time.

9 Claims, 34 Drawing Sheets

(56) References Cited

U.S. PATENT DOCUMENTS

| | | | | |
|---|---|---|---|---|
| 9,520,013 | B2 * | 12/2016 | Erikawa | G07F 11/10 |
| 9,652,924 | B2 * | 5/2017 | Yasaka | G07F 11/24 |
| 9,710,993 | B2 * | 7/2017 | Makino | G07F 11/24 |
| 9,747,742 | B2 * | 8/2017 | Yasaka | G07F 11/04 |
| 9,811,965 | B2 * | 11/2017 | Erikawa | G07F 11/04 |
| 9,811,967 | B2 * | 11/2017 | Nakajima | G07F 5/22 |
| 9,818,252 | B2 * | 11/2017 | Nakajima | G07F 11/24 |

FOREIGN PATENT DOCUMENTS

| | | | |
|---|---|---|---|
| JP | 2001-188953 | A | 7/2001 |
| JP | 2002-150374 | A | 5/2002 |
| JP | 2003-233866 | A | 8/2003 |
| JP | 2009-054059 | A | 3/2009 |

* cited by examiner

ARTICLE DISPENSING APPARATUS

CROSS-REFERENCE TO RELATED APPLICATION(S)

The present application claims priority to and incorporates by reference the entire contents of PCT International Application No. PCT/JP2015/083815 filed on Dec. 1, 2015, which is based on Japanese Patent Application Nos. 2015-039448 filed on Feb. 27, 2015, 2015-039449 filed on Feb. 27, 2015, and 2015-053918 filed on Mar. 17, 2015.

BACKGROUND

The present disclosure relates to an article dispensing apparatus.

In vending machines that sell articles such as canned beverages and PET-bottled beverages, an article storage rack has been conventionally provided in an article storage inside a main body cabinet as a vending machine main body. The article storage rack has article storage passages extending in an up-and-down direction and article discharging apparatuses arranged at the lower part of the article storage passages.

The article discharging apparatus includes a lower pedal and an upper pedal. The lower pedal and the upper pedal are linked with an AC solenoid as an actuator via links and advance and retract to and from the article storage passage as appropriate through the energization of the AC solenoid.

In such an article discharging apparatus, in a standby state, the upper pedal is retracted from the article storage passage, whereas the lower pedal is advanced to the article storage passage. With this configuration, the lower pedal comes into contact with the lowermost article stored in the article storage passage, thereby preventing articles stored in the article storage passage from moving downward.

When a discharging instruction for an article is given, in the article discharging apparatus at the lower part of the article storage passage that stores therein a corresponding article, the AC solenoid is energized, whereby the upper pedal advances to the article storage passage via the link to come into contact with the second lowermost article, thereby preventing the article and articles stored above the article from moving downward. In addition, the AC solenoid is energized, whereby the lower pedal retracts from the article storage passage, only the lowermost article is discharged downward, and when the article slips through the lower pedal, the lower pedal advances to the article storage passage by the biasing force of a spring. After that, when the energized state of the AC solenoid is released to be a non-energized state, the lower pedal that has advanced to the article storage passage is prevented from retracting, and the upper pedal has retracted from the article storage passage, thereby returning to the standby state.

The article discharging apparatus includes an out-of-stock detection lever and an out-of-stock detection switch in addition to the pedals. The out-of-stock detection lever is swingably arranged in an area above the upper pedal in such a manner as to advance and retract to and from the article storage passage, and is biased to advance to the article storage passage by a biasing unit. When articles are present in the article storage passage, the out-of-stock detection lever is retracted due to the articles from the article storage passage against the biasing force of the biasing unit.

The out-of-stock detection switch is linked to the out-of-stock detection lever, and is turned to an off state when the out-of-stock detection lever retracts from the article storage passage, and is turned to an on state when the out-of-stock detection lever advances to the article storage passage. The out-of-stock detection switch outputs an out-of-stock signal when it is turned to the on state, which indicates that articles in the article storage passage are out of stock (see, for example, Japanese Laid-open Patent Publication No. 2001-188953).

SUMMARY

The present disclosure has been made in view of the foregoing circumstances, and it is an object of the present disclosure to provide an article dispensing apparatus that can solve at least one of the above problems.

According to an embodiment, an article dispensing apparatus includes: an article discharging apparatus including a base, an article storage passage that stores therein charged articles in an up-and-down direction, a lower pedal swingably arranged on the base in such a manner that a tip of the lower pedal advances and retracts to and from the article storage passage, and an upper pedal swingably arranged on the base in such a manner that a tip of the upper pedal advances and retracts to and from the article storage passage in an area above the lower pedal, the article discharging apparatus, in a standby state, preventing a lowermost article from moving downward with the upper pedal retracted from the article storage passage and with the lower pedal advanced to the article storage passage to be in a first standby position in which the lowermost article is placed on a top face of the lower pedal, the article discharging apparatus, when being driven, discharging the lowermost article downward with the upper pedal advanced to the article storage passage to come into contact with a second lowermost article and with the lower pedal retracted from the article storage passage. Further, the lower pedal is in a second standby position in which the tip of the lower pedal is positioned at a position upper than in the first standby position when no article is placed on the top face of the lower pedal advanced to the article storage passage, the article dispensing apparatus further includes: an out-of-stock detection switch that is turned to a first state when the lower pedal is in the second standby position and that is turned to a second state when the lower pedal is in a position other than the second standby position; an output member that is rotatably provided about a central axis of the article dispensing apparatus, puts the article discharging apparatus in the standby state when the output member is at a standby position, and drives the article discharging apparatus when the output member rotates from the standby position; and a controller that rotates the output member in a first direction to return the output member to the standby position when the output member rotated from the standby position in the first direction does not return to the standby position in a preset set time and when the out-of-stock detection switch is turned to the first state in the set time.

According to an embodiment, an article dispensing apparatus includes: an article discharging apparatus including a base, an article storage passage that stores therein charged articles in an up- and down direction, a lower pedal swingably arranged on the base in such a manner that a tip of the lower pedal advances and retracts to and from the article storage passage, and an upper pedal swingably arranged on the base in such a manner that a tip of the upper pedal advances and retracts to and from the article storage passage in an area above the lower pedal, the article discharging apparatus, in a standby state, preventing a lowermost article from moving downward with the upper pedal retracted from the article storage passage and with the lower pedal advanced to the article storage passage to be in a first standby position in which the lowermost article is placed on a top face of the lower pedal, the article discharging apparatus, when being driven, discharging the lowermost article downward with the upper pedal advanced to the article storage passage to come into contact with a second lowermost article and with the lower pedal retracted from the article storage passage, so that the lower pedal is in a second standby position in which the tip of the lower pedal is positioned at a position upper than in the first standby position when no article is placed on the top face of the lower pedal advanced to the article storage passage, the article dispensing apparatus further includes: an out-of-stock detection switch that is turned to a first state when the lower pedal is in the second standby position and that is turned to a second state when the lower pedal is in a position other than the second standby position; an output member that is rotatably provided about a central axis of the article dispensing apparatus, puts the article discharging apparatus in the standby state when the output member is at a standby position, and drives the article discharging apparatus when the output member rotates from the standby position; and a controller that rotates the output member in a second direction to return the output member to the standby position when the output member rotated from the standby position in a first direction opposite to the second direction does not return to the standby position in a preset set time. Further, the controller stops rotation of the output member when the output member returns to the standby position and when the out-of-stock detection switch is turned to the first state in a drive time that lasts until the output member returns to the standby position.

According to an embodiment, An article dispensing apparatus includes an article discharging apparatus including a base, an article storage passage that stores therein charged articles in an up-and-down direction, a lower pedal swingably arranged on the base in such a manner that a tip of the lower pedal advances and retracts to and from the article storage passage, an upper pedal swingably arranged on the base in such a manner that a tip of the upper pedal advances and retracts to and from the article storage passage in an area above the lower pedal, the article discharging apparatus, in a standby state, preventing a lowermost article from moving downward with the upper pedal retracted from the article storage passage and with the lower pedal advanced to the article storage passage, the article discharging apparatus, when being driven, discharging the lowermost article downward with the upper pedal advanced to the article storage passage to come into contact with a second lowermost article and with the lower pedal retracted from the article storage passage; an output member that is rotatably provided about a central axis of the article dispensing apparatus, puts the article discharging apparatus in the standby state when the output member is at a standby position, and drives the article discharging apparatus when the output member is rotated from the standby position by a driving force given thereto from a driving source in accordance with a discharging instruction; and a controller that rotates the output member in a second direction to return the output member to the standby position when the output member rotated from the standby position in a first direction opposite to the second direction does not return to the standby position in a preset set time. Further, when the output member returns to the standby position and when a returning time for the output member to return to the standby position is equal to or greater than a preset reference time, the controller determines that an article has been discharged and stops rotation of the output member.

According to an embodiment, an article dispensing apparatus includes: an article discharging apparatus including a base, an article storage passage that stores therein charged articles in an up-and-down direction, a lower pedal swingably arranged on the base in such a manner that a tip of the lower pedal advances and retracts to and from the article storage passage, an upper pedal swingably arranged on the base in such a manner that a tip of the upper pedal advances and retracts to and from the article storage passage in an area above the lower pedal, the article discharging apparatus, in a standby state, preventing a lowermost article from moving downward with the upper pedal retracted from the article storage passage and with the lower pedal advanced to the article storage passage to be in a first standby position in which the lowermost article is placed on a top face of the lower pedal, the article discharging apparatus, when being driven, discharging the lowermost article downward with the upper pedal advanced to the article storage passage to come into contact with a second lowermost article and with the lower pedal retracted from the article storage passage, so that the lower pedal is in a second standby position in which the tip of the lower pedal is positioned at a position upper than in the first standby position when no article is placed on the top face of the lower pedal advanced to the article storage passage. Further, the article dispensing apparatus further includes: an out-of-stock detection switch that is turned to a first state when the lower pedal is in the second standby position and that is turned to a second state when the lower pedal is in a position other than the second standby position; an output member that is rotatably provided about a central axis of the article dispensing apparatus, puts the article discharging apparatus in the standby state when the output member is at a standby position, and drives the article discharging apparatus when the output member rotates from the standby position; and a controller that determines that an abnormality has occurred when the output member rotated from the standby position in a first direction returns to the standby position and when the out-of-stock detection switch is not turned to the first state.

According to an embodiment, an article dispensing apparatus includes an article discharging apparatus including a base, an article storage passage that stores therein charged articles, a lower pedal swingably arranged on a base in such a manner that a tip of the lower pedal advances and retracts to and from an article storage passage, an upper pedal swingably arranged on the base in such a manner that a tip of the upper pedal advances and retracts to and from the article storage passage in an area above the lower pedal, the article discharging apparatus, in a standby state, preventing a lowermost article from moving downward with the upper pedal retracted from the article storage passage and with the lower pedal advanced to the article storage passage, the article discharging apparatus, when being driven, discharging the lowermost article downward with the upper pedal advanced to the article storage passage to come into contact with a second lowermost article and with the lower pedal retracted from the article storage passage; an output member that is rotatably provided about a central axis of the article dispensing apparatus, puts the article discharging apparatus in the standby state when the output member is at a standby position, and drives the article discharging apparatus when the output member is rotated from the standby position by a driving force given thereto from a driving source in accordance with a discharging instruction; and a controller that stops rotation of the output member for a certain time with the upper pedal kept advanced to the article storage passage when the output member is rotated from the standby position to drive the article discharging apparatus.

BRIEF DESCRIPTION OF THE DRAWINGS

FIG. 16 is viewed from the right side;

DETAILED DESCRIPTION

Figure 1:
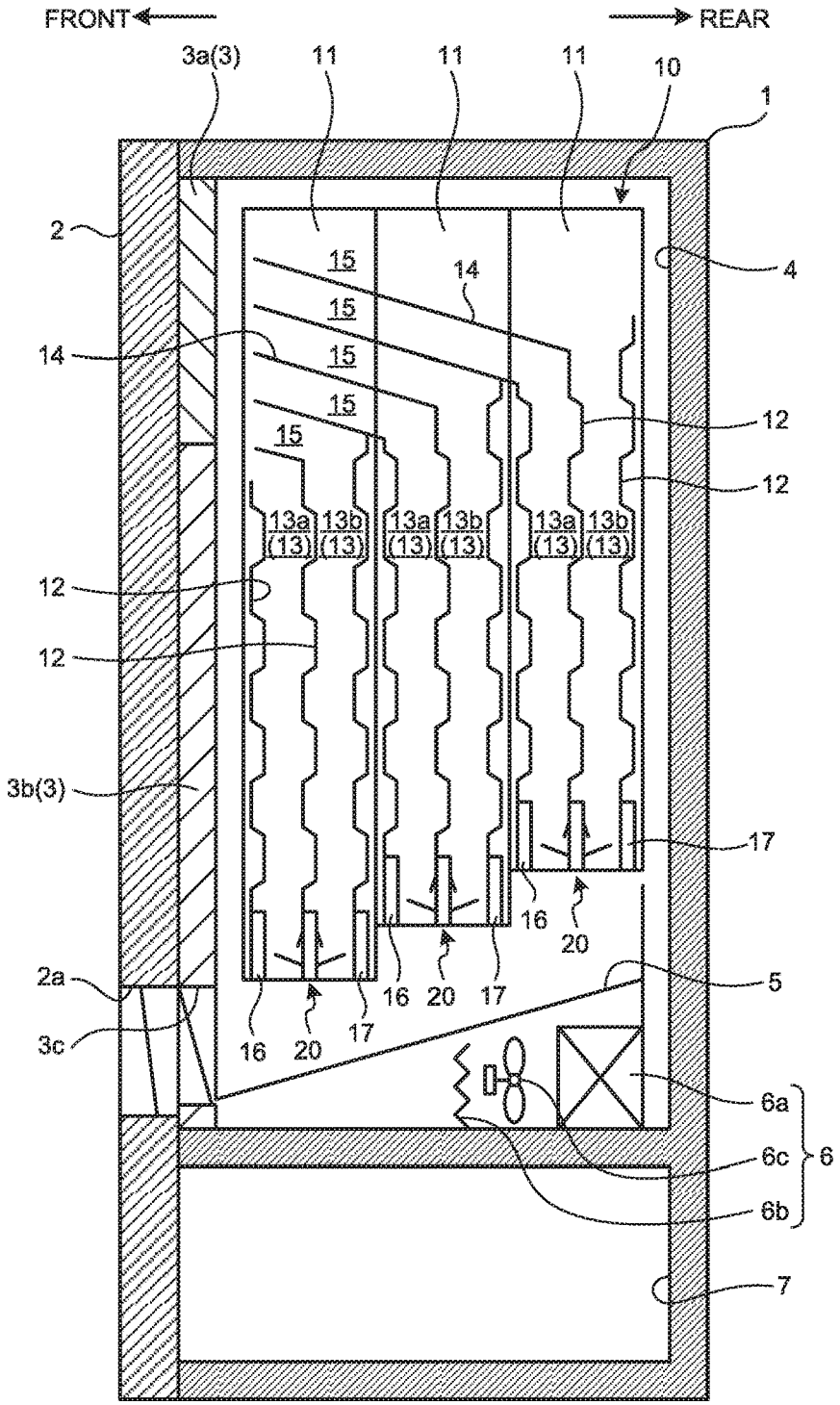
FIG. 1 is a sectional side view when an internal structure of a vending machine is viewed from the right side in which an article dispensing apparatus as a first embodiment of the present disclosure is used.

In the article discharging apparatus disclosed in Japanese Laid-open Patent Publication No. 2001-188953 mentioned above, the out-of-stock detection lever is arranged in an area above the upper pedal and has a limited length so as not to interfere with the advancing and retracting movement of the upper pedal. When the out-of-stock detection lever advances to the article storage passage, the last article remaining in the article storage passage is placed on the lower pedal. Although the out-of-stock detection configuration indicates that the articles in the article storage passage are out of stock, at least one article is present therein in the actual situation, which results in fewer sales opportunities for articles than that of the articles stored in the article storage passage.

To prevent this situation, the article discharging apparatus can be configured to discharge an article only once by a discharging instruction for the article when the out-of-stock detection lever advances to the article storage passage and the out-of-stock detection switch is turned to the on state, which is based on an assumption that an article is placed on the lower pedal even after the out-of-stock detection switch is turned to the on state.

The out-of-stock detection lever advanced to the article storage passage can be detected by the out-of-stock detection switch being turned to the on state, but whether an article is placed on the lower pedal is not recognized. There is a possibility that the article is stuck in the middle of the article storage passage between the out-of-stock detection lever and the lower pedal with an altered attitude. In this case, the article discharging apparatus cannot ensure a successful discharge of the article when a discharging instruction for the article is given only once, which is disadvantageous to users of the vending machine.

Other article discharging apparatuses that use a DC motor as a driving source (see Patent Literature 1, for example) have been known, instead of using an AC solenoid disclosed in Patent Literature 1 mentioned above.

Such an article discharging apparatus includes an output gear that is provided to rotate forward and backward about its central axis. When the output gear is positioned at a standby position, the article discharging apparatus is in a standby state, and the article discharging apparatus is driven when the output gear rotates in a first direction from the standby position by the driving force given from the driving source in accordance with a discharging instruction. If the output gear that has rotated in the first direction fails to return to the standby position in a certain time, the output gear is rotated in a second direction opposite to the first direction to be returned to the standby position, and is rotated in the first direction again.

However, when the article discharging apparatus is driven by the first rotation of the output gear in the first direction, the configuration in which the output gear is returned to the standby position and then rotated in the first direction again may drive the article discharging apparatus second time. This configuration may drive the article discharging apparatus a plurality of times by a single discharging instruction, which may result in dispensing of a plurality of articles.

Such an article discharging apparatus using, for example, a DC motor as a driving source retracts the lower pedal for a substantially constant time when the output gear is rotated from the standby position and returned to the standby position in a certain time. In this configuration, if the lowermost article has a light weight or has a rectangular parallelepiped shape, such an article may move too slow, and thus the discharge of the article can be insufficient.

The following descries preferred embodiments of an article dispensing apparatus according to the present disclosure in detail with reference to the accompanying drawings.

First Embodiment

FIG. 1 is a sectional side view when an internal structure of a vending machine is viewed from the right side in which the article dispensing apparatus as a first embodiment of the present disclosure is used. The vending machine illustrated in this example sells articles cooled or heated and includes a main body cabinet 1, an outer door 2, and an inner door 3.

The main body cabinet 1 is formed in a rectangular parallelepipedal shape with its front open by combining a plurality of steel sheets when necessary and includes an article storage 4 with a heat insulating structure thereinside. The outer door 2 is provided for covering the front opening of the main body cabinet 1 and is arranged on one side edge of the main body cabinet 1 in an openable and closable manner. Provided on the front face of this outer door 2 are requirements for selling articles such as a display window, article selection buttons, a bill insertion port, a coin slot, a return lever, an integral display, a coin drop, and an article outlet port 2*a*. The inner door 3 is a heat insulting door divided into up-and-down two parts for covering the front opening of the article storage 4, in which inside the outer door 2 an upper heat insulating door 3*a* is arranged on one side edge of the outer door 2 in an openable and closable manner, whereas a lower heat insulating door 3*b* is arranged on one side edge of the main body cabinet 1 in an openable and closable manner. An article discharging port 3*c* for discharging articles outside the article storage 4 is provided below the lower heat insulating door 3*b* of the inner door 3.

In the vending machine, an article chute 5 is provided inside the article storage 4; a temperature adjusting unit 6 is arranged in an area (hereinafter, also referred to as a "heat exchange area") below this article chute 5, whereas article storage racks 10 are arranged in an area (hereinafter, also referred to as an "article storage area") above this article chute 5.

The article chute 5 is a plate-shaped member for guiding articles discharged from the article storage racks 10 to the article discharging port 3*c* of the inner door 3 and is arranged in such a manner as to gradually incline downward toward the front. Although not being explicitly illustrated in the drawing, this article chute 5 is formed with many vent holes (not illustrated) causing the heat exchange area and the article storage area to communicate with each other.

The temperature adjusting unit 6 is provided for maintaining the internal atmosphere of the article storage 4 at a desired temperature condition and includes an evaporator 6*a* for the refrigerating cycle, an electric heater 6*b*, and an air-blowing fan 6*c*. In this temperature adjusting unit 6, when the air-blowing fan 6*c* is driven with the refrigerating cycle operated, for example, air cooled by the evaporator 6*a* is supplied upward through the vent holes of the article chute 5, whereby the article storage area can be maintained at a low temperature state. In contrast, when the air-blowing fan 6*c* is driven with the electric heater 6*b* energized, air heated by the electric heater 6*b* is supplied upward through the vent holes of the article chute 5, whereby the article storage area can be maintained at a high temperature state. A compressor and a condenser for the refrigerating cycle and an expansion valve are arranged in a machinery room 7 outside the article storage 4, although they are not explicitly illustrated in the drawing.

The article storage racks 10 are arranged in three rows fore and aft, include a plurality of (two in the illustrated example) article storage passages 13 formed zigzag in an up-and-down direction by arranging passage forming elements 12 between a pair of base side plates 11, and store a plurality of articles with an attitude turned on their sides in the up-and-down direction inside these article storage passages 13. More specifically, the passage forming elements 12 are arranged as appropriate so as to face each other on the front side and the rear side of the article storage passage 13 and are fixed to the base side plates 11. With this configuration, in each of the article storage racks 10, the two article storage passages 13 are provided in such a manner as to be adjacent to each other fore and aft. In the following description, in one article storage rack 10, the front article storage passage 13 will be referred to also as a first article storage passage 13*a*, whereas the rear article storage passage 13 will be referred to also as a second article storage passage 13*b*.

The passage forming element 12 is provided with a flapper, which is not explicitly illustrated in the drawing. The flapper is swingably arranged on the passage forming element 12 in such a manner as to advance and retract to and from the article storage passage 13. This flapper is in an attitude advanced to the article storage passage 13 in a normal state by being biased by a coil spring (not illustrated). Coming into contact with an article passing through the article storage passage 13, the flapper itself retracts so as to be along the zigzag article storage passage 13 against a biasing force of the coil spring to correct the attitude of the article.

In each of the article storage racks 10, a top tray 14 is provided at an upper part of the article storage passage 13, whereas an article dispensing apparatus 20 is provided at a lower part of the article storage passage 13.

The top tray 14 is formed by bending plate-shaped sheet metal and is arranged between the base side plates 11 in such a manner as to gradually incline downward from the front toward the rear. The upper face of this top tray 14 forms an article guiding passage 15 that guides articles charged through a charging port to the article storage passage 13.

Figure 2:
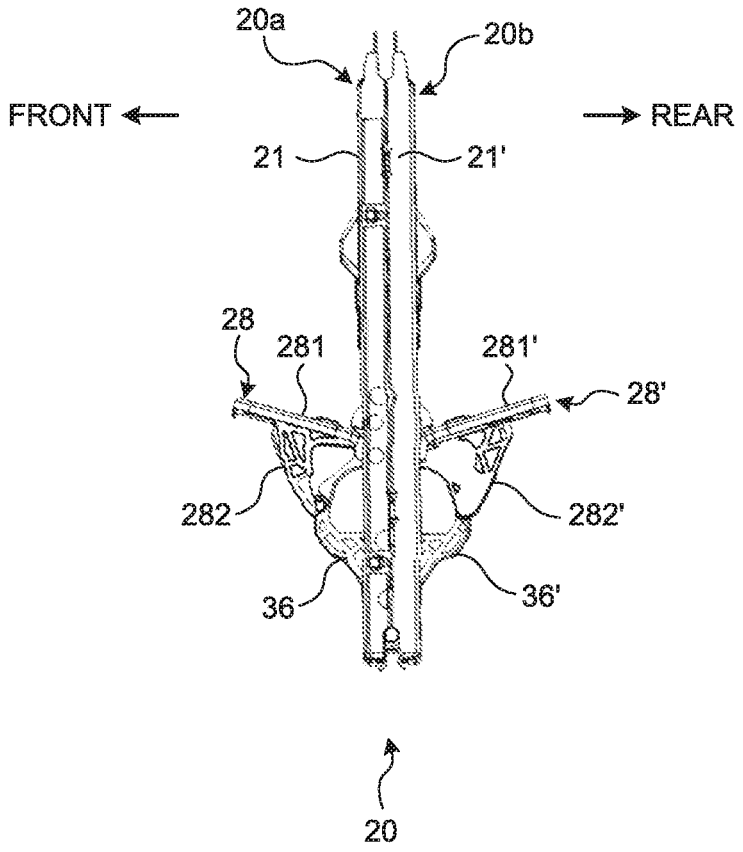
FIG. 2 is a side view when the article dispensing apparatus illustrated in FIG. 1 is viewed from the right side.
Figure 3:
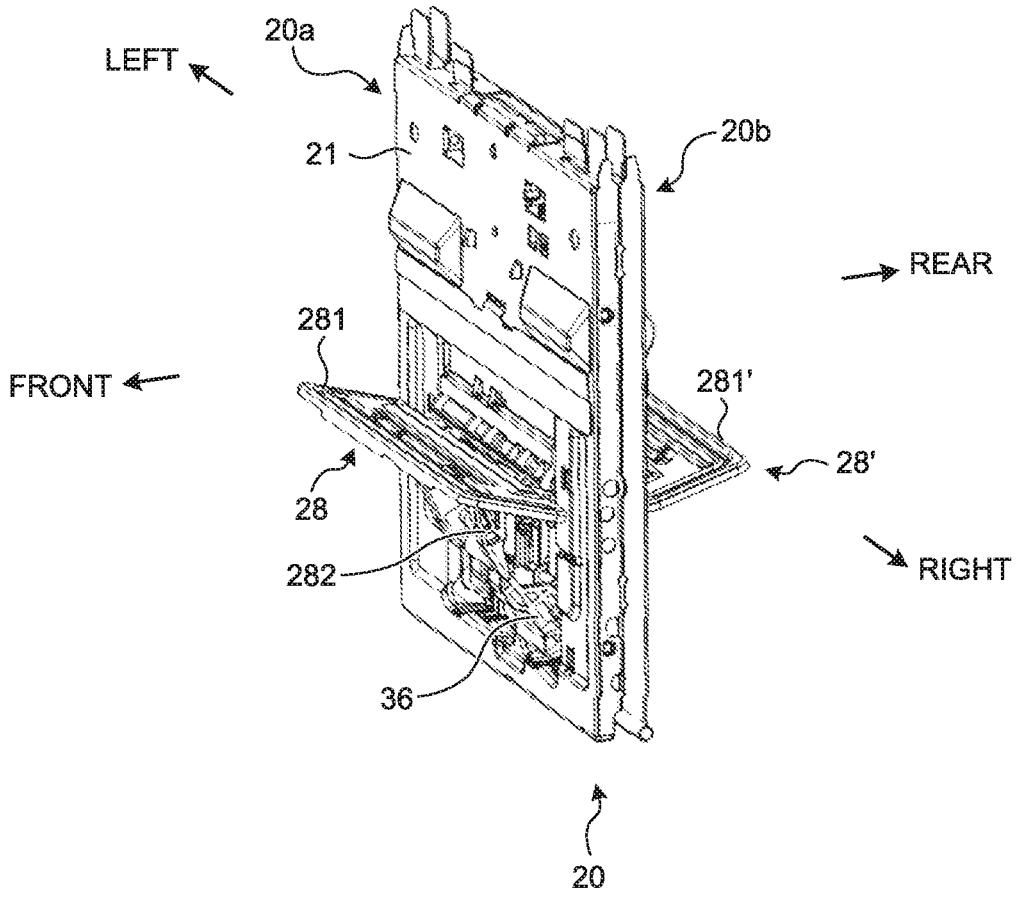
FIG. 3 is a perspective view when the article dispensing apparatus illustrated in FIG. 1 is viewed from the right front side.
Figure 4:
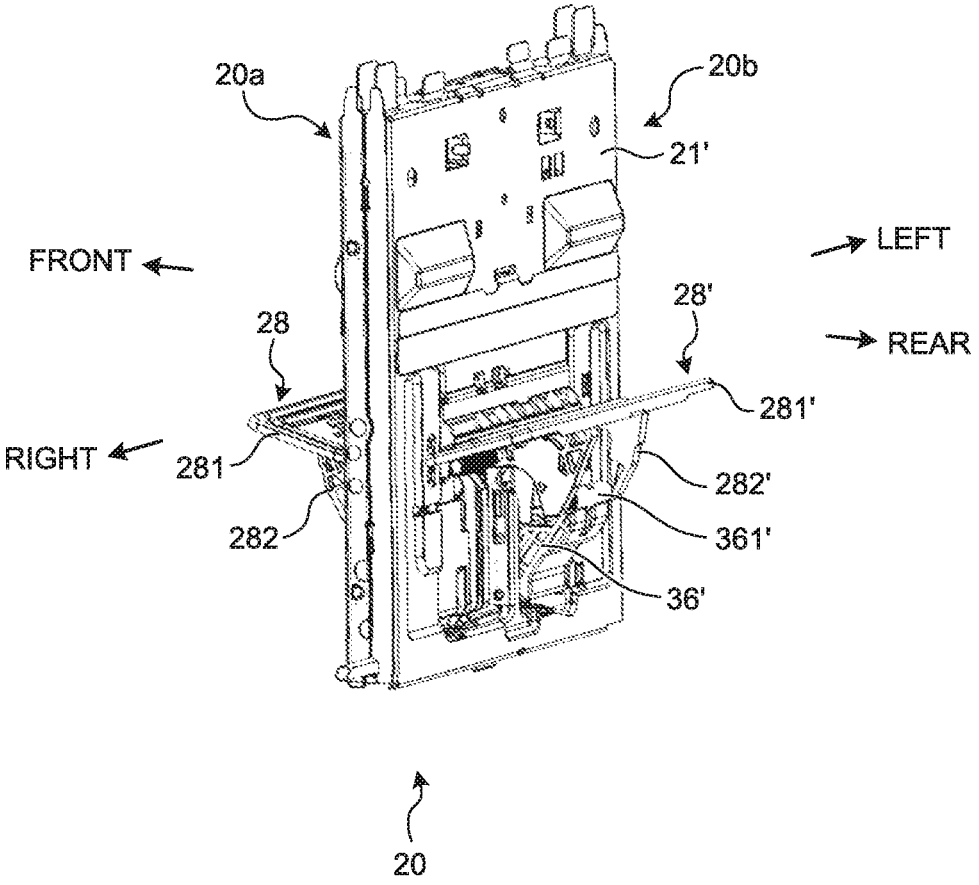
FIG. 4 is a perspective view when the article dispensing apparatus illustrated in FIG. 1 is viewed from the right rear side.

FIG. 2 to FIG. 4 illustrate the article dispensing apparatus 20 illustrated in FIG. 1: FIG. 2 is a side view when viewed from the right side; FIG. 3 is a perspective view when viewed from the right front side; and FIG. 4 is a perspective view when viewed from the right rear side.

As illustrated in FIG. 2 to FIG. 4, the article dispensing apparatus 20 includes one article discharging apparatus (hereinafter, may be referred to as a first article discharging apparatus) 20*a* and another article discharging apparatus (hereinafter, may be referred to as a second article discharging apparatus) 20*b*, in which the first article discharging apparatus 20*a* and the second article discharging apparatus 20*b* are combined in a back-to-back manner. FIG. 2 to FIG. 4 illustrate a state in which no article is stored in both the first article discharging apparatus 20*a* and the second article discharging apparatus 20*b* included in the article dispensing apparatus 20.

Figure 5:
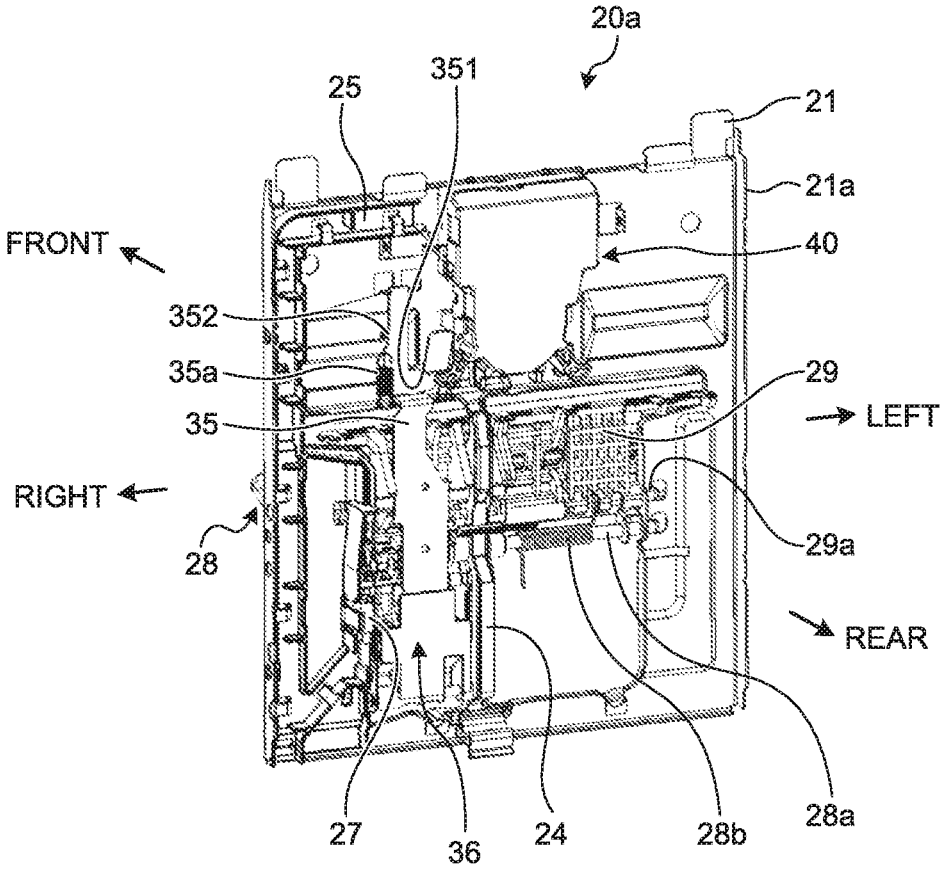
FIG. 5 is a perspective view when a first article discharging apparatus illustrated in FIG. 2 to FIG. 4 is viewed from the right rear side.

FIG. 5 is a perspective view when the first article discharging apparatus 20*a* illustrated in FIG. 2 to FIG. 4 is viewed from the right rear side. The following describes a configuration of the first article discharging apparatus 20*a* and then describes the second article discharging apparatus 20*b*.

Figure 6:
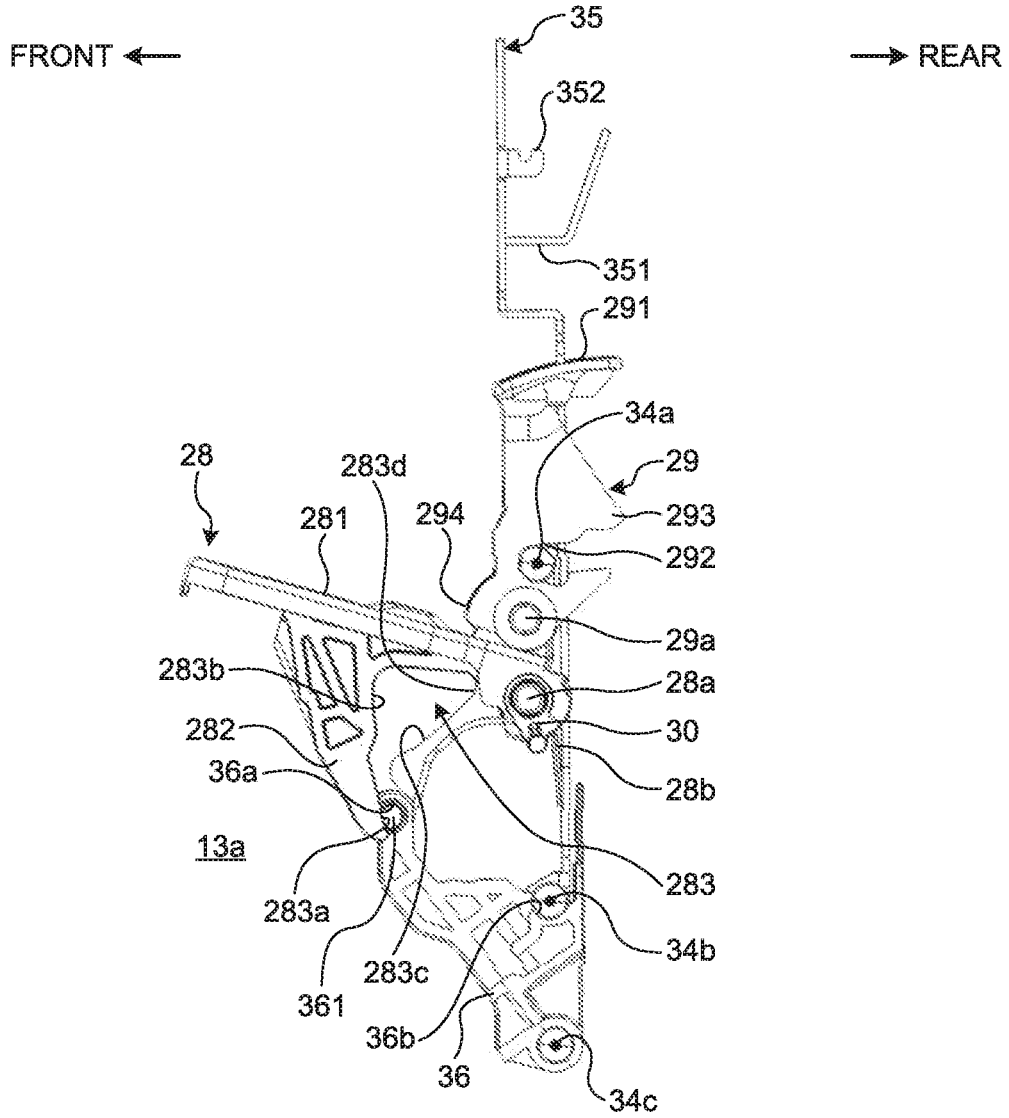
FIG. 6 is a schematic illustrative diagram when viewing a principal part of the first article discharging apparatus illustrated in FIG. 2 to FIG. 5 from the right side.
Figure 7:
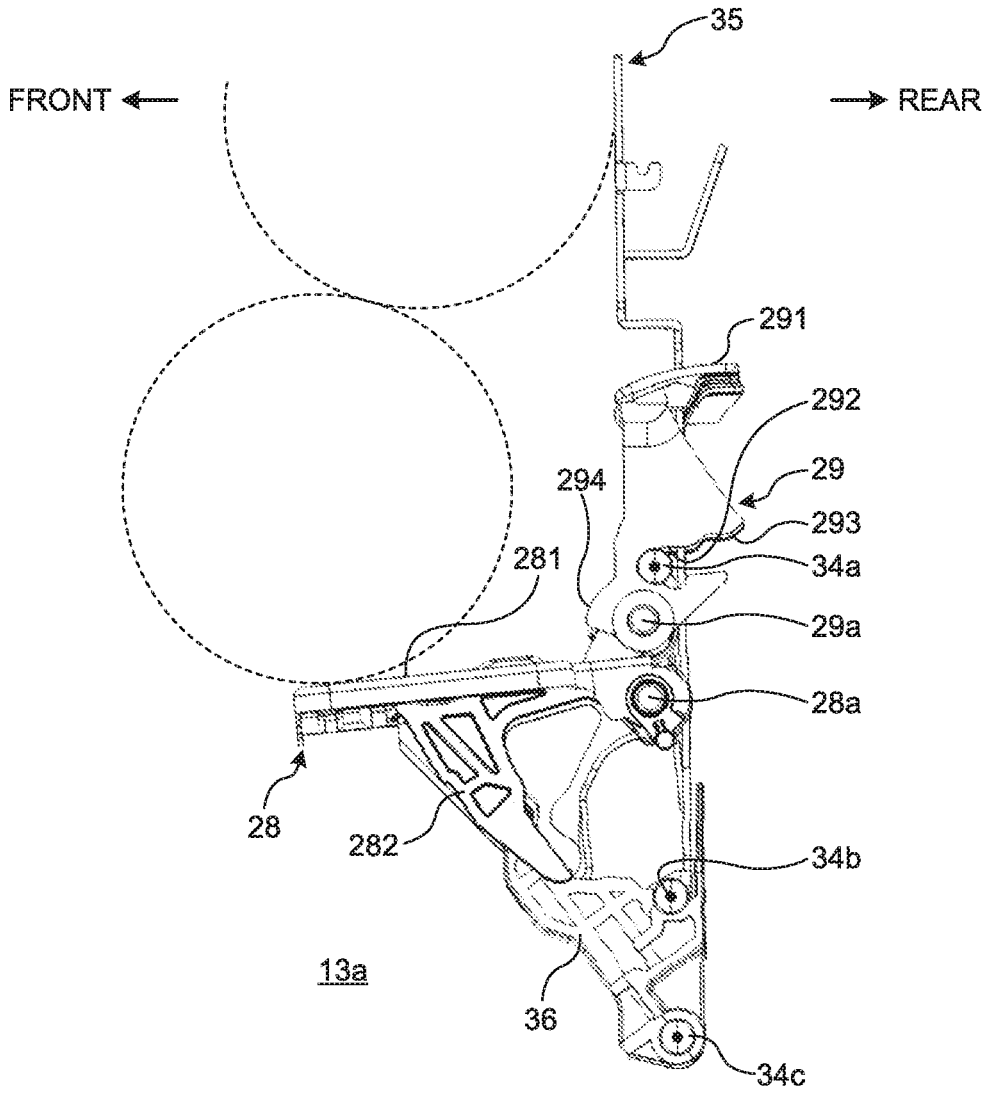
FIG. 7 is a schematic illustrative diagram when the principal part of the first article discharging apparatus illustrated in FIG. 2 to FIG. 5 is viewed from the right side.
Figure 8:
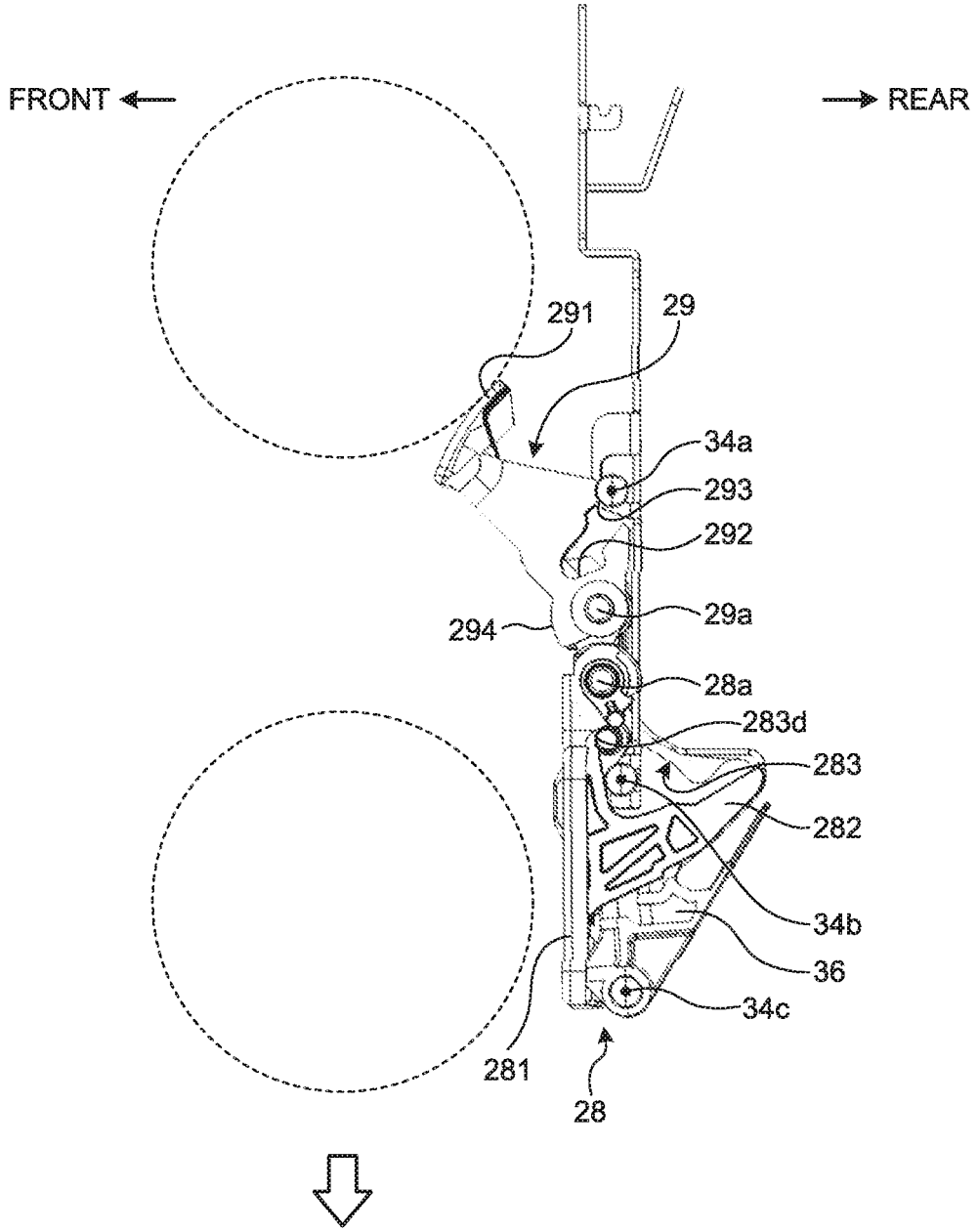
FIG. 8 is a schematic illustrative diagram when the principal part of the first article discharging apparatus illustrated in FIG. 2 to FIG. 5 is viewed from the right side.

FIG. 6 to FIG. 8 are schematic illustrative diagrams when a principal part of the first article discharging apparatus 20*a* illustrated in FIG. 2 to FIG. 5 is viewed from the right side. The following describes the configuration of the first article discharging apparatus 20*a* with reference also to FIG. 6 to FIG. 8 as appropriate.

The first article discharging apparatus 20*a* is used for the first article storage passage 13*a* and arranged at the lower part of this first article storage passage 13*a*. This first article discharging apparatus 20*a* controls a behavior of articles between the first article discharging apparatus 20*a* and a passage width defining plate 16 facing it, thereby functioning to store the articles in the first article storage passage 13*a* in a discharge standby state and to discharge a corresponding article one by one to the article chute 5 when being driven, and includes a base 21.

Figure 9:
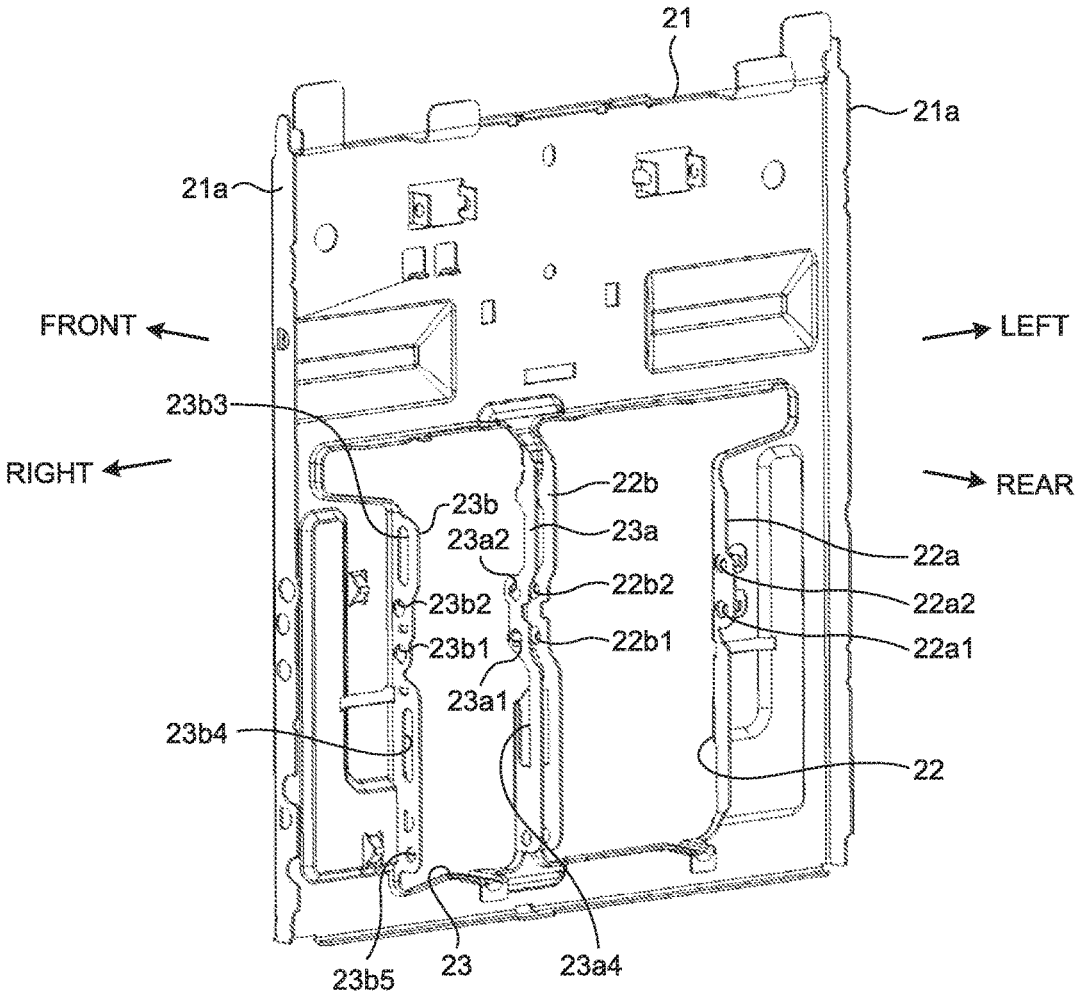
FIG. 9 is a perspective view of a base of the first article discharging apparatus illustrated in FIG. 2 to FIG. 5.

As illustrated in FIG. 9, the base 21 is formed by performing cutting and bending on a steel sheet and is arranged in such a manner as to cause its surface to face the passage width defining plate 16. This base 21 is formed with side walls 21*a* by causing its both ends to be bent and is formed with a first insertion hole 22 and a second insertion hole 23 in its intermediate part. The peripheries of the first insertion hole 22 and the second insertion hole 23 are bent similarly to the side walls 21*a* to form flanges.

The first insertion hole 22 and the second insertion hole 23 are formed so as to be next to each other right and left and have the same up-and-down dimension. As to the first insertion hole 22 and the second insertion hole 23, the first insertion hole 22 is positioned on the left side of the second insertion hole 23, and the right-and-left width of the first insertion hole 22 is greater than the right-and-left width of the second insertion hole 23. The first insertion hole 22 and the second insertion hole 23 are both through openings (recesses causing a lower pedal 28 and an upper pedal 29 described below to retract to within the base 21) formed in a substantially rectangular shape as a whole; the upper end of the first insertion hole 22 protrudes leftward, whereas the upper end of the second insertion hole 23 protrudes rightward. A first left shaft support piece 22*a* is provided on the left side edge of the first insertion hole 22, whereas a first right shaft support piece 22*b* is provide on the right side edge of the first insertion hole 22; a second left shaft support piece 23*a* is provided on the left side edge of the second insertion hole 23, whereas a second right shaft support piece 23*b* is provided on the right side edge of the second insertion hole 23. The first left shaft support piece 22*a* and the second right shaft support piece 23*b* correspond to the flanges formed on the peripheries of the first insertion hole 22 and the second insertion hole 23. The first right shaft support piece 22*b* and the second left shaft support piece 23*a* are formed in shaft inserting flanges forming U-shaped both leg pieces in a shaft support holding part that is formed integrally with the base 21 and is formed to have a U-shaped transverse cross section (discontinuous) that holds a shaft support part 24 described below in a fitted manner. This shaft support holding part has a function of maintaining the strength of the base 21 also when a large through opening including the first insertion hole 22 and the second insertion hole 23 formed in a substantially rectangular shape as a whole is formed in the base 21.

Figure 10:
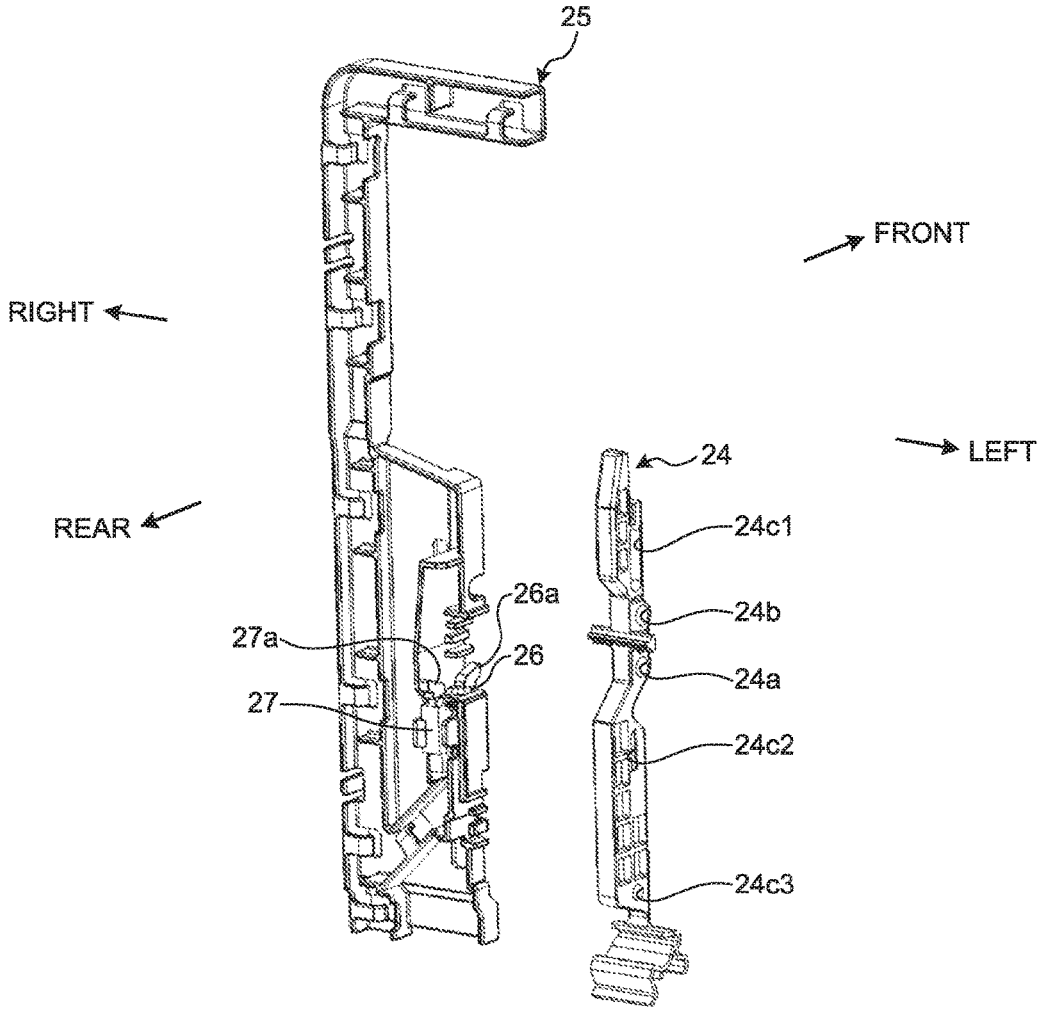
FIG. 10 is a perspective view of a shaft support part and a harness guide mounted on the base illustrated in FIG. 9.

The shaft support part 24 and a harness guide 25 as illustrated in FIG. 10 are mounted on the base 21 having the above configuration. The shaft support part 24 is formed of a resin material or the like and is fitted into between the first right shaft support piece 22*b* and the second left shaft support piece 23*a*.

The harness guide 25 is formed of a resin material or the like similar to the shaft support part 24 and is fitted along the right side wall 21*a* of the base 21 in such a manner as to being adjacent to the second right shaft support piece 23*b*. This harness guide 25 is provided for routing a harness of electric parts mounted on the first article discharging apparatus 20*a*. In addition, the harness guide 25 has a role as a guide member when the first article discharging apparatus 20*a* and the second article discharging apparatus 20*b* are combined in a back-to-back manner.

Arranged on the harness guide 25 are a first out-of-stock detection switch 26 and a second out-of-stock detection switch 27.

The first out-of-stock detection switch 26 is arranged so as to be aligned with the second out-of-stock detection switch 27 fore and aft and is positioned on the front side of the second out-of-stock detection switch 27. This first out-of-stock detection switch 26 is what is called a push type switch and includes a contact maker 26*a* biased to be erected by a spring (not illustrated). The first out-of-stock detection switch 26 is turned to an off state (the second state) to send an off signal to a dispensing controller 60 described below with the contact maker 26*a* not pressed and is turned to an on state (the first state) to send an on signal to the dispensing controller 60 when the contact maker 26*a* is pressed to be displaced against the biasing force of the spring.

In the first embodiment, the first out-of-stock detection switch 26 is turned to the off state with the contact maker 26*a* not pressed and is turned to the on state when the contact maker 26*a* is pressed to be displaced; in the present disclosure, the first out-of-stock detection switch 26 may be turned to the on state with the contact maker 26*a* not pressed and be turned to the off state when the contact maker 26*a* is pressed to be displaced.

The second out-of-stock detection switch 27 is positioned on the rear side of the first out-of-stock detection switch 26. This second out-of-stock detection switch 27 is what is called a push type switch and includes a contact maker 27*a* biased to be erected by a spring (not illustrated). The second out-of-stock detection switch 27 is turned to an off state (the second state) to send an off signal to the dispensing controller 60 described below with the contact maker 27*a* not pressed and is turned to an on state (the first state) to send an on signal to the dispensing controller 60 when the contact maker 27*a* is pressed to be displaced against the biasing force of the spring.

In the first embodiment, the second out-of-stock detection switch 27 is turned to the off state with the contact maker 27*a* not pressed and is turned to the on state when the contact maker 27*a* is pressed to be displaced; in the present disclosure, the second out-of-stock detection switch 27 may be turned to the on state with the contact maker 27*a* not pressed and be turned to the off state when the contact maker 27*a* is pressed to be displaced.

Provided on the base 21 are a first swinging support shaft 28*a* and a second swinging support shaft 29*a*. The first swinging support shaft 28*a* is a shaft-shaped member installed passing through open holes 22*a*1, 22*b*1, 23*a*1, 23*b*1, and 24*a* formed in the first left shaft support piece 22*a*, the first right shaft support piece 22*b*, the second left shaft support piece 23*a*, the second right shaft support piece 23*b*, and the shaft support part 24, respectively, in such a manner as to extend in a substantially horizontal direction and supports the lower pedal 28 in its intermediate part. A first out-of-stock link 30 is arranged at the right end of the first swinging support shaft 28*a*.

The second swinging support shaft 29*a* is a shaft-shaped member installed passing through open holes 22*a*2, 22*b*2, 23*a*2, 23*b*2, and 24*b* formed in the first left shaft support piece 22*a*, the first right shaft support piece 22*b*, the second left shaft support piece 23*a*, the second right shaft support piece 23*b*, and the shaft support part 24, respectively, in such a manner as to extend in the substantially horizontal direction in an area above the first swinging support shaft 28*a* and supports the upper pedal 29 in its intermediate part.

The lower pedal 28 is a plate-shaped member and causes the first swinging support shaft 28*a* to be inserted into its basal end to be thereby arranged in such a manner as to be swingable about the central axis of this first swinging support shaft 28*a*.

A tip of the lower pedal 28 extends in the radially outside direction of the first swinging support shaft 28*a* and can advance and retract to and from the first article storage passage 13*a* through the first insertion hole 22 and the second insertion hole 23 when swinging about the central axis of the first swinging support shaft 28*a*. In other words, the lower pedal 28 is swingably arranged in such a manner as to advance and retract to and from the first article storage passage 13*a*.

A lower pedal spring 28*b* is interposed between the lower pedal 28 and the base 21. The lower pedal spring 28*b* always biases the lower pedal 28 in an advancing direction to the first article storage passage 13*a*. More specifically, the lower pedal spring 28*b* sets the lower pedal 28 to a standby position (hereinafter, may be referred to as an article-absent standby position (the second standby position)) so as to position the tip of the lower pedal 28 above the first swinging support shaft 28*a* as illustrated in FIG. 6. When an article is placed on the top face of the lower pedal 28, the lower pedal spring 28*b* sets the lower pedal 28 to a standby position (hereinafter, referred to also as an article-present standby position (the first standby position)) so as to position the tip of the lower pedal 28 at a height level equal to the first swinging support shaft 28*a* as illustrated in FIG. 7.

With this operation, the tip of the lower pedal 28 when the lower pedal 28 is in the article-absent standby position is positioned at a position upper than when the lower pedal 28 is at the article-present standby position.

Figure 11:
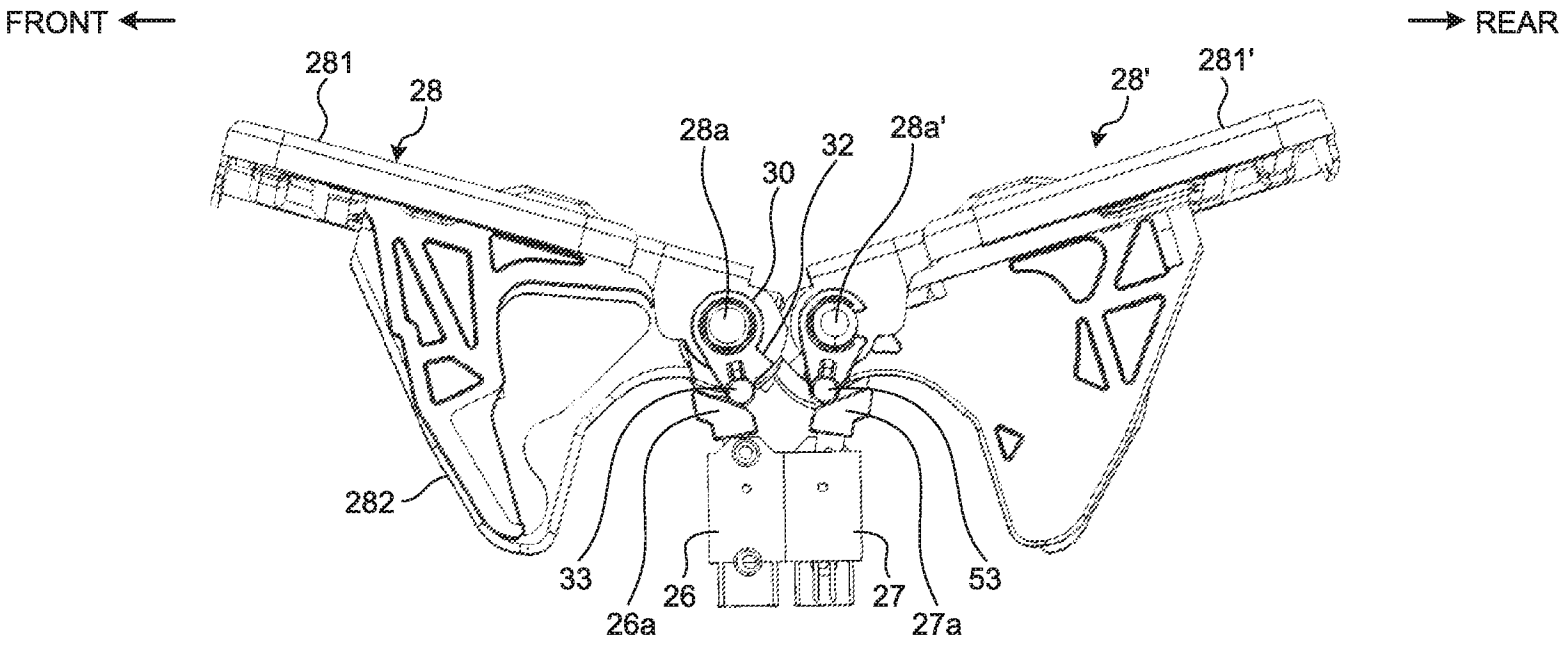
FIG. 11 is a side view of a principal part of the article dispensing apparatus in FIG. 2 to FIG. 4.

When the lower pedal 28 is in the article-absent standby position, the basal end of the lower pedal 28 comes into contact with a first out-of-stock contact part 32 of the first out-of-stock link 30 as illustrated in FIG. 11, whereby the first out-of-stock link 30 rotates with the first swinging support shaft 28*a* as an axis, whereby a first out-of-stock pressing part 33 presses the contact maker 26*a* of the first out-of-stock detection switch 26. With this operation, the contact maker 26*a* is pressed to be displaced frontward against the biasing force of the spring, whereby the first out-of-stock detection switch 26 is turned to the on state to send the on signal to the dispensing controller 60.

Figure 12:
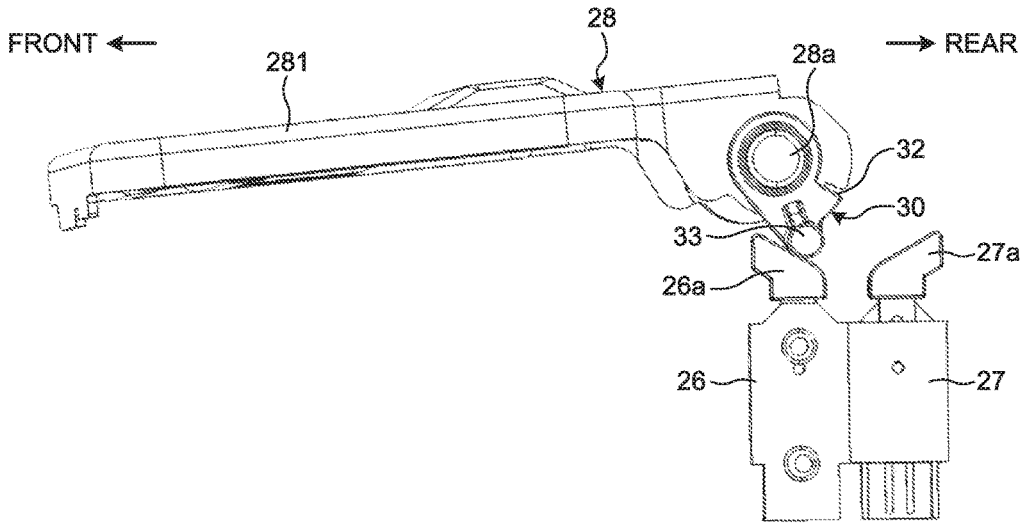
FIG. 12 is a side view of a relationship between a first out-of-stock link and a first out-of-stock detection switch when a lower pedal is in an article-present standby position.

In contrast, when the lower pedal 28 is at the article-present standby position, the basal end of the lower pedal 28 separates from the first out-of-stock contact part 32 of the first out-of-stock link 30 as illustrated in FIG. 12, whereby the first out-of-stock link 30 becomes free. With this operation, the contact maker 26*a* is biased by the spring to be erected, whereby the first out-of-stock detection switch 26 is turned to the off state to send the off signal to the dispensing controller 60. In other words, the first out-of-stock pressing part 33 is pressed by the contact maker 26*a*, whereby the first out-of-stock link 30 that has become free rotates with the first swinging support shaft 28*a* as the axis.

The lower pedal 28 includes a plate-shaped pedal main body 281 and a pair of guide parts 282. The pair of guide parts 282 is provided on the back side of the pedal main body 281. The guide parts 282 are plate-shaped members extending in the up-and-down direction and are formed so as to face each other. Guide grooves 283 are formed on the facing faces facing each other of the respective guide parts 282.

The guide groove 283 includes a fitted-in part 283*a* that is positioned lowermost and in which a pedal operation shaft 361 of a turning stopper 36 described below is fitted in a state (the state illustrated in FIG. 6) in which the lower pedal 28 is arranged at an advanced position most advanced relative to the first article storage passage 13*a*, a contact part 283*d* that is positioned uppermost and with which the pedal operation shaft 361 of the turning stopper 36 comes into contact in a state (the state illustrated in FIG. 8) in which the lower pedal 28 is arranged at a retracted position most retracted from the first article storage passage 13*a*, and a first guide part 283*b* and a second guide part 283*c* that connect the fitted-in part 283*a* and the contact part 283*d* so as to make them continuous.

The first guide part 283*b* is formed in the guide part 282 in such a manner as to incline obliquely upward so as to separate from the fitted-in part 283*a* relative to the base 21, to incline obliquely upward so as to be close to the base 21, and to reach the contact part 283*d* in the state in which the lower pedal 28 is arranged at the position (the advanced position) most advanced relative to the first article storage passage 13*a*.

The second guide part 283*c* is formed in the guide part 282 in such a manner as to incline obliquely downward so as to separate from the contact part 283*d* relative to the base 21 and to reach the fitted-in part 283*a* in the state in which the lower pedal 28 is arranged at the position (the advanced position) most advanced to the first article storage passage 13*a*.

The radially outward length of this lower pedal 28 from the first swinging support shaft 28*a* is set to a length that can ensure a gap smaller than the maximum width of an article the maximum width of which is smaller between the lower pedal 28 and the passage width defining plate 16 when the lower pedal 28 is positioned at the position (the advanced position) most advanced to the first article storage passage 13*a*.

The upper pedal 29 is a plate-shaped member and causes the second swinging support shaft 29*a* to be inserted into its basal end to be thereby arranged on the base 21 in such a manner as to be swingable about the central axis of this second swinging support shaft 29*a*.

A tip of the upper pedal 29 extends in the radially outside direction of the second swinging support shaft 29*a* and can advance and retract to and from the first article storage passage 13*a* through the first insertion hole 22 and the second insertion hole 23 when swinging about the central axis of the second swinging support shaft 29*a*. In other words, the upper pedal 29 is swingably arranged in such a manner as to advance and retract to and from the first article storage passage 13*a*.

An upper pedal spring (not illustrated) is interposed between the upper pedal 29 and the base 21. The upper pedal spring always biases the upper pedal 29 in a retracting direction from the first article storage passage 13*a*.

The upper pedal 29 includes a pressing inclined face 291, a recess 292, a stopper contact part 293, and a protrusion 294. The pressing inclined face 291 is provided at the tip of the upper pedal 29 and is a curved inclined face formed in such a manner as to gradually lower toward the first article storage passage 13*a* when the upper pedal 29 is retracted from the first article storage passage 13*a*. The recess 292 is provided on the back side of the upper pedal 29 and is a line of recess extending in the substantially horizontal direction formed in such a manner as to open to both side faces of the upper pedal 29. The stopper contact part 293 is a part with which a stopper pin 34*a* described below comes into contact and is provided in such a manner as to incline above the recess 292 on the back side of the upper pedal 29.

The protrusion 294 is provided in such a manner as to protrude at the basal end of the upper pedal 29 toward the first article storage passage 13*a*.

This upper pedal 29 is biased to retract from the first article storage passage 13*a* by the biasing force of the upper pedal spring, and the stopper pin 34*a* comes into contact with the recess 292, whereby an initial position is set to the state in which the upper pedal 29 has retracted from the first article storage passage 13*a*.

This upper pedal 29 is inclined forward relative to a vertical plane passing through the second swinging support shaft 29*a* in a state (the state illustrated in FIG. 8) in which the upper pedal 29 is positioned at a position (an advanced position) most advanced relative to the first article storage passage 13*a*. The radially outward length of the upper pedal 29 from the second swinging support shaft 29*a* is set to a length that can ensure a gap smaller than the maximum width of an article the maximum width of which is smaller between the upper pedal 29 and the passage width defining plate 16 in the forward inclined state.

In the base 21, installed between the shaft support part 24 and the second right shaft support piece 23*b* are the stopper pin 34*a*, a pedal stopper pin 34*b*, and a stopper shaft 34*c*.

The stopper pin 34*a* is a shaft-shaped member arranged in the substantially horizontal direction between the shaft support part 24 and the second right shaft support piece 23*b*, one end of which is inserted into a stopper pin insertion hole 23*b*3 of the second right shaft support piece 23*b*, whereas the other end of which is inserted into a stopper pin insertion hole 24*c*1 of the shaft support part 24 exposed out of the second left shaft support piece 23*a*. This stopper pin 34*a* is connected to a pedal link 35 and can move in the up-and-down direction inside the stopper pin insertion holes 23*b*3 and 24*c*1 along with the movement in the up-and-down direction of the pedal link 35. The stopper pin 34*a* is in contact with the recess 292 of the upper pedal 29 in the initial position.

The pedal stopper pin 34*b* is a shaft-shaped member arranged in the substantially horizontal direction between the shaft support part 24 and the second right shaft support piece 23*b*, one end of which is inserted into a pedal stopper pin support groove 24*c*2 (an elongated groove extending up and down similar to the stopper pin insertion hole 24*c*1, is blocked by a groove bottom as a drawer part of the reference symbol 24*c*1, and is invisible in FIG. 6) of the shaft support part 24, whereas the other end of which is inserted into a pedal stopper pin support groove 23*b*4 of the second right shaft support piece 23*b*. An insertion groove 23*a*4 is provided in the second left shaft support piece 23*a* so as to expose the pedal stopper pin insertion hole 24*c*2. This pedal stopper pin 34*b* is connected to the pedal link 35 and can move in the up-and-down direction inside the pedal stopper pin support grooves 23*b*4 and 24*c*2 along with the movement in the up-and-down direction of the pedal link 35. The periphery of this pedal stopper pin 34*b* slides within the pedal stopper pin support grooves 23*b*4 and 24*c*2 when the pedal link 35 is moved in the up-and-down direction.

The stopper shaft 34*c* is a shaft-shaped member arranged in the substantially horizontal direction between the shaft support part 24 and the second right shaft support piece 23*b*, one end of which is inserted into a stopper shaft insertion hole 24*c*3 of the shaft support part 24, whereas the other end of which is inserted into an open hole 23*b*5 of the second right shaft support piece 23*b*. An insertion hole for the stopper shaft 34*c* is formed in the second left shaft support piece 23*a*. This stopper shaft 34*c* supports the turning stopper 36 in its intermediate part.

The turning stopper 36 causes the stopper shaft 34*c* to be inserted into its insertion hole of its basal end and is arranged between the shaft support part 24 and the second right shaft support piece 23*b* in such a manner as to be swingable about the central axis of this stopper shaft 34*c*.

A tip of the turning stopper 36 extends in the radially outside direction of the stopper shaft 34*c* and can advance and retract to and from the first article storage passage 13*a* through the second insertion hole 23 when swinging about the central axis of the stopper shaft 34*c*.

This turning stopper 36 causes the pedal operation shaft 361 to be inserted into an open hole 36*a* of the tip and thereby has the pedal operation shaft 361. The pedal operation shaft 361 is a shaft-shaped member arranged in the substantially horizontal direction, both ends of which are fitted in the guide grooves 283 of the lower pedal 28.

A pedal operation spring (not illustrated) is interposed between the turning stopper 36 and the base 21. The pedal operation spring always biases the turning stopper 36 in an advancing direction to the first article storage passage 13*a*.

This turning stopper 36 is biased in an advancing direction to the first article storage passage 13*a* by the pedal operation spring and is prevented from moving in a retracting direction by the pedal stopper pin 34*b* entering an indentation 36*b* of the turning stopper 36 and coming into contact with the pedal stopper pin 34*b*, and an initial position with the turning stopper 36 advanced relative to the first article storage passage 13*a* is set. The lower pedal 28 is biased by the lower pedal spring 28*b*, whereby the turning stopper 36 positions both ends of the pedal operation shaft 361 at the fitted-in parts 283*a* of the guide grooves 283 and sets an initial position at a position at which the lower pedal 28 has advanced to the first article storage passage 13*a*.

The pedal link 35 is an elongated plate-shaped member extending in the up-and-down direction, in which an upper part is bent frontward and then extends upward. Provided on the upper part of this pedal link 35 are a contact piece 351 that extends rearward and then extends obliquely upward and a locking part 352 that locks a link spring 35*a*. This link spring 35*a* is interposed between the pedal link 35 and the base 21 and always biases the pedal link 35 downward.

With the pedal link 35 biased by the link spring 35*a* and arranged at a lower position, the stopper pin 34*a* is arranged at the lower end of the stopper pin insertion holes 23*b*3 and 24*c*1, whereas the pedal stopper pin 34*b* is arranged at the lower end of the pedal stopper pin support grooves 23*b*4 and 24*c*2. In this state, the recess 292 of the upper pedal 29 arranged at the retracted position is in contact with the stopper pin 34*a*. Besides, the turning stopper 36 arranged at the advanced position is in contact with the pedal stopper pin 34*b*, thereby preventing the turning stopper 36 from retracting. In addition, the pedal operation shaft 361 of the turning stopper 36 arranged at the advanced position is fitted in the fitted-in parts 283*a* of the lower pedal 28, thereby preventing the lower pedal 28 arranged at the advanced position from retracting.

In contrast, with the pedal link 35 arranged at an upper position against the biasing force of the link spring 35*a*, as illustrated in FIG. 8, the stopper pin 34*a* is arranged at the upper end of the stopper pin insertion holes 23*b*3 and 24*c*1, whereas the pedal stopper pin 34*b* is arranged at the upper end of the pedal stopper pin support grooves 23*b*4 and 24*c*2. In this state, the stopper contact part 293 of the upper pedal 29 is in contact with the stopper pin 34*a*, thereby preventing the upper pedal 29 from retracting and causing the upper pedal 29 to advance against the biasing force of the upper pedal spring and to be arranged at the advanced position.

Meanwhile, the prevention of retracting for the turning stopper 36 by the pedal stopper pin 34*b* is released, and the prevention of retracting is released about the stopper shaft 34*c*. The load of the article in contact with the lower pedal 28 maintained at the advanced position by the turning stopper 36 is being applied to the turning stopper 36, and the prevention of retracting has been released, whereby the turning stopper 36 starts retracting. When the retracting of the turning stopper 36 is started, the pedal operation shaft 361 is detached from the fitted-in parts 283*a* of the lower pedal 28, whereby the lower pedal 28 is allowed to retract about the first swinging support shaft 28*a* and retracts against the elastic biasing force of the lower pedal spring 28*b* by the load of the article (refer to FIG. 8).

Figure 13:
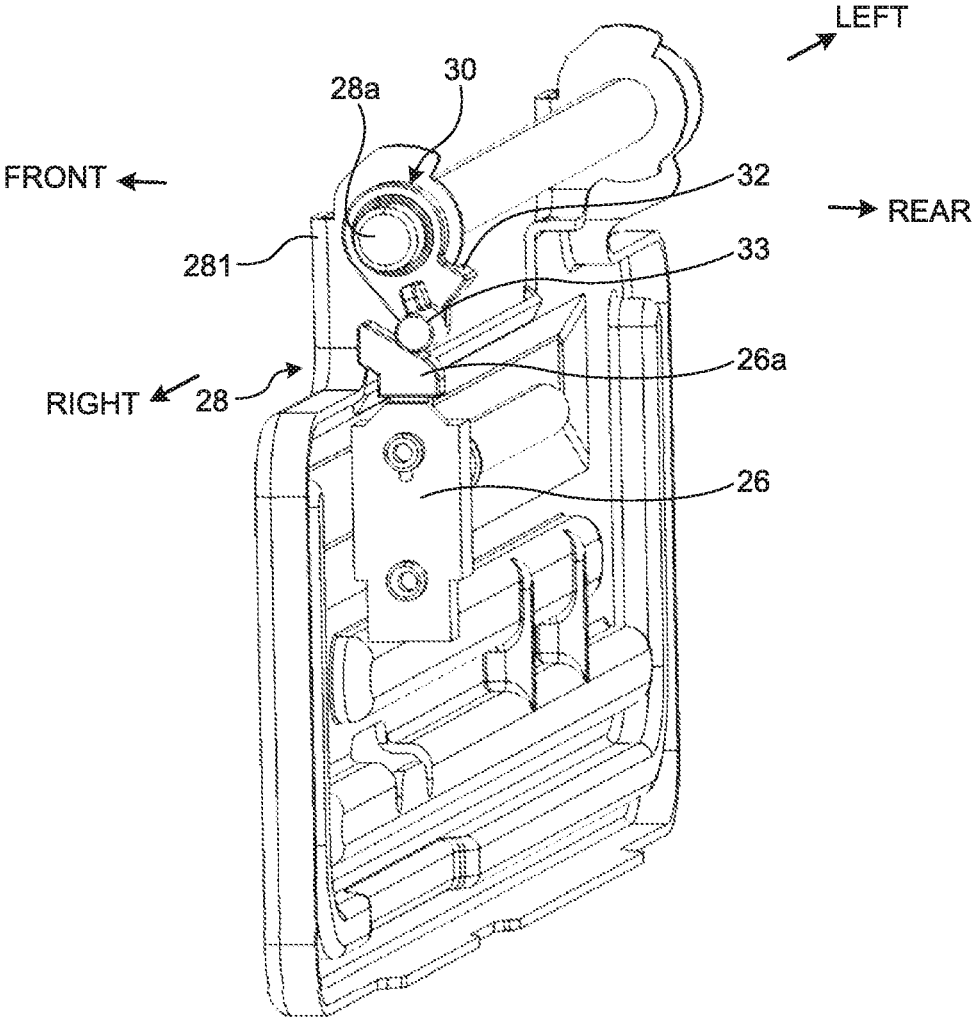
FIG. 13 is a perspective view of a relationship between the first out-of-stock link and the first out-of-stock detection switch when the lower pedal is retracted.

When the lower pedal 28 thus retracts, the basal end of the lower pedal 28 separates from the first out-of-stock contact part 32 of the first out-of-stock link 30 as illustrated in FIG. 13, whereby the first out-of-stock link 30 becomes free. With this operation, the contact maker 26*a* is pressed by the spring to be erected, whereby the first out-of-stock detection switch 26 maintains the off state. In other words, also when the lower pedal 28 retracts similarly to the article-present standby position, the first out-of-stock link 30 does not press the contact maker 26*a* of the first out-of-stock detection switch 26.

The first article discharging apparatus 20*a* having such a configuration includes a driving unit 40 in addition to the above configuration.

Figure 14:
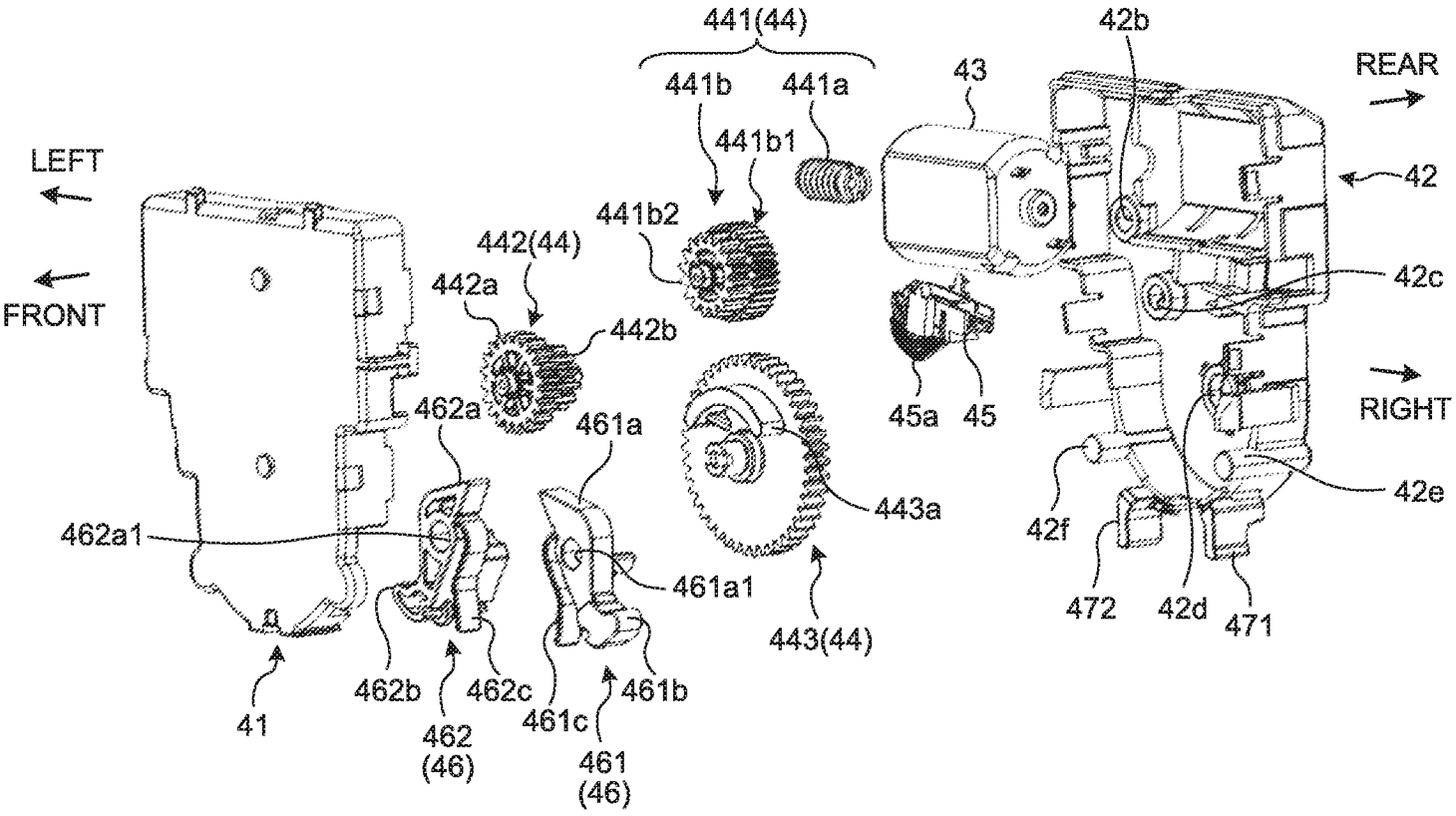
FIG. 14 is an exploded perspective view of a principal part of a driving unit in the first article discharging apparatus when viewed from the right front side.
Figure 15:
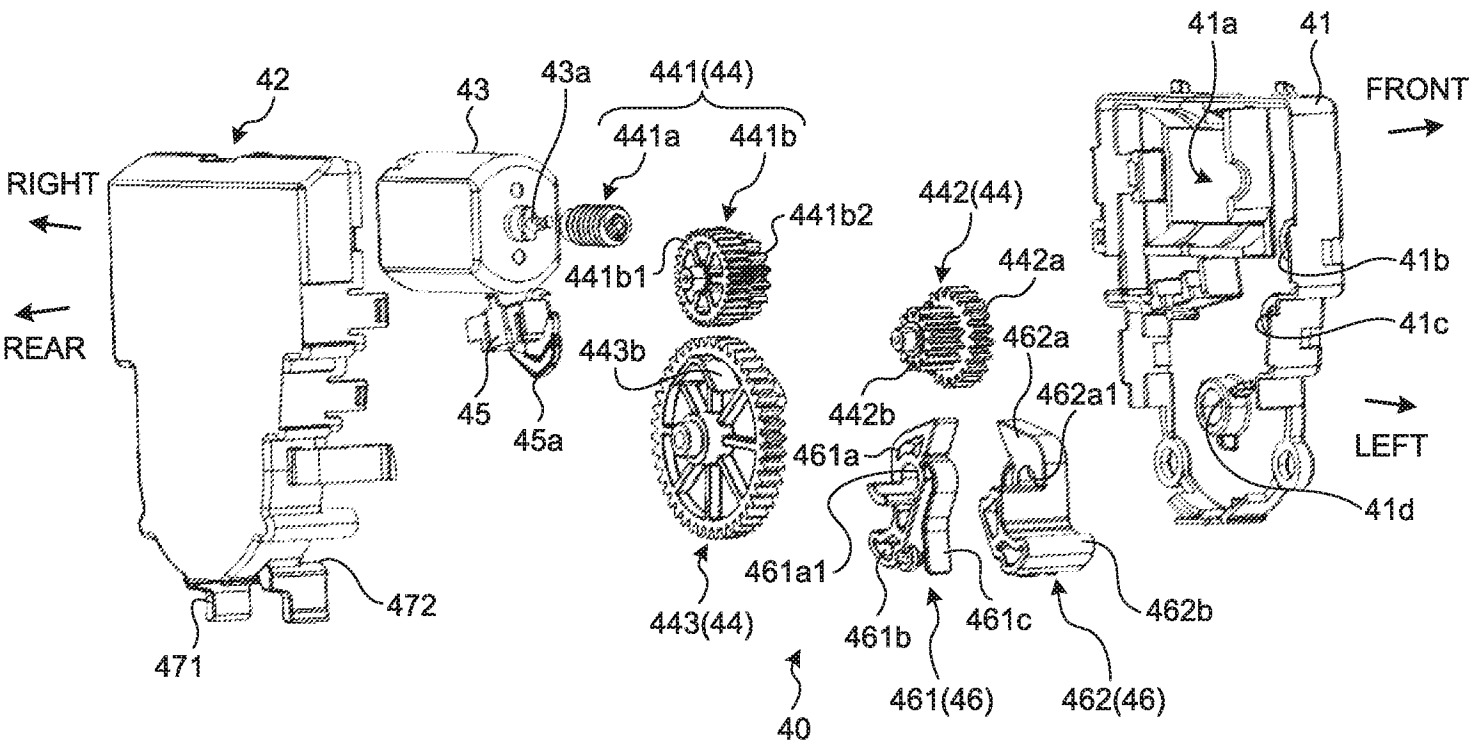
FIG. 15 is an exploded perspective view of the principal part of the driving unit in the first article discharging apparatus when viewed from the left rear side.

FIG. 14 and FIG. 15 illustrate a principal part of the driving unit 40 in the first article discharging apparatus 20*a*: FIG. 14 is an exploded perspective view when viewed from the right front sides; and FIG. 15 is an exploded perspective view when viewed from the left rear side.

The driving unit 40 is arranged at the central area at the upper part on the back side of the base 21. This driving unit 40 includes a unit base 41 mounted on the back side of the base 21.

The unit base 41 is formed of a resin material, for example, and is formed in a box shape with its rear face open. The unit base 41 blocks the rear opening by mounting a unit cover 42 formed of resin to form a housing space between the unit base 41 and the unit cover 42. Housed in the housing space thus formed by the unit base 41 and the unit cover 42 are a motor 43, a gear member 44, a carrier switch 45, and a link lever 46.

The motor 43 is a driving source and is a forward-and-backward rotatable direct-current (DC) motor that is driven in accordance with an instruction given from the dispensing controller 60 described below. The motor 43 is arranged by being held by a motor holding part 41*a* of the unit base 41.

The gear member 44 includes a worm gear 441, an intermediate gear 442, and an output gear (output member) 443. The worm gear 441 has a worm 441*a* and a worm wheel 441*b*.

The worm 441*a* is formed in a cylindrical shape and is mounted on an output shaft 43*a* of the motor 43. The worm wheel 441*b* has a disc-shaped first worm wheel 441*b*1 and a disc-shaped second worm wheel 441*b*2.

The first worm wheel 441*b*1 is formed with a shaft-shaped part protruding rearward at its central part and is formed with a gear part including a plurality of teeth on its periphery.

The second worm wheel 441*b*2 is positioned on the front side of the first worm wheel 441*b*1 and is formed with a shaft-shaped part the central axis of which is aligned with the central axis of the shaft-shaped part of the first worm wheel 441*b*1 in such a manner as to protrude frontward. The periphery of this second worm wheel 441*b*2 is also formed with a gear part including a plurality of teeth.

This worm wheel 441*b* is rotatably provided about the central axis of the shaft-shaped part by, with the gear part of the first worm wheel 441*b*1 engaged with the worm 441*a*, inserting the shaft-shaped part into recesses 41*b* and 42*b* of the unit base 41 and the unit cover 42, respectively.

The intermediate gear 442 has a disc-shaped first intermediate gear 442*a* and a disc-shaped second intermediate gear 442*b*. The first intermediate gear 442*a* is formed with a shaft-shaped part protruding rearward at its central part and is formed with a gear part including a plurality of teeth on its periphery.

The second intermediate gear 442*b* is positioned on the rear side of the first intermediate gear 442*a* and is formed with a shaft-shaped part the central axis of which is aligned with the central axis of the shaft-shaped part of the first intermediate gear 442*a* in such a manner as to protrude frontward. The periphery of this second intermediate gear 442*b* is also formed with a gear part including a plurality of teeth.

This intermediate gear 442 is rotatably provided about the central axis of the shaft-shaped part by, with the gear part of the first intermediate gear 442*a* engaged with the gear part of the second worm wheel 441*b*2, inserting the shaft-shaped part into recesses 41*c* and 42*c* of the unit base 41 and the unit cover 42, respectively.

The output gear 443 is formed in a disc shape having an enlarged diameter compared with those of the worm wheel 441*b* and the intermediate gear 442. The periphery of this output gear 443 is also formed with a plurality of teeth. The output gear 443 is formed with a shaft-shaped part protruding in a fore-and-aft direction at its central part. Further, the output gear 443 is formed with a cam part 443*a* on its front face and is formed with a pressing piece 443*b* on its rear face.

The cam part 443*a* is formed in an arc shape and is formed in such a manner as to protrude frontward. This cam part 443*a* is formed such that its arc length will be large enough to, after the pedal link 35 is moved upward, maintain that state.

The pressing piece 443*b* is formed in a substantially V shape and is formed in such a manner as to protrude rearward on the rear face as a face that is opposite the cam part 443*a*.

This output gear 443 is rotatably provided about the central axis of the shaft-shaped part by, with the gear part engaged with the gear part of the second intermediate gear 442*b*, inserting the shaft-shaped part into recesses 41*d* and 42*d* of the unit base 41 and the unit cover 42, respectively.

The carrier switch 45 is what is called a push type switch and includes a contact maker 45*a*. This carrier switch 45 is arranged on the unit base 41 held at a position slightly upper than the area on which the output gear 443 is arranged. This carrier switch 45 is turned to an on state when the contact maker 45*a* is pressed and gives the fact as an on signal to the dispensing controller 60 and is turned to an off state when the contact maker 45*a* is not pressed and gives the fact as an off signal to the dispensing controller 60.

The link lever 46 includes a first link lever 461 and a second link lever 462. The first link lever 461 is formed of a resin material, for example, and is formed with an open hole 461*a*1 in a basal end 461*a*. This first link lever 461 is formed in a hook shape in which a tip 461*b* extends right downward from the basal end 461*a* and then curves right upward. In addition, a locking part 461*c* is provided on the basal end 461*a* of the first link lever 461. The locking part 461*c* is an elastically deformable, plate-shaped elastic member extending downward from the left end of the basal end 461*a*.

A first link shaft 42*e* provided in the unit cover 42 is inserted into the open hole 461*a*1 of the basal end 461*a*, whereby the first link lever 461 is rotatably provided about the central axis of the first link shaft 42*e* on the front side of the output gear 443. In this case, the first link lever 461 passes through a right opening (not illustrated) formed by the unit base 41 and the unit cover 42, and the tip 461*b* is positioned outside the unit base 41 and the unit cover 42. The locking part 461*c* comes into contact with a left side edge 471 of the right opening, thereby determining the attitude of the first link lever 461 in the normal state.

The second link lever 462 is formed of a resin material, for example, and is formed with an open hole 462*a*1 in a basal end 462*a*. This second link lever 462 is formed in a hook shape in which a tip 462*b* extends left downward from the basal end 462*a* and then curves left upward. The width in the back-and-forth direction of the tip 462*b* of this second link lever 462 is greater than that of the tip 461*b* of the first link lever 461. Further, a locking part 462*c* is provided on the basal end 462*a* of the second link lever 462. The locking part 462*c* is an elastically deformable and plate-shaped elastic member extending downward from the right end of the basal end 462*a*.

A second link shaft 42*f* provided in the unit cover 42 is inserted into the open hole 462*a*1 of the basal end 462*a*, whereby the second link lever 462 is rotatably provided about the central axis of the second link shaft 42*f* on the front side of the output gear 443. In this case, the second link lever 462 passes through a left opening (not illustrated) formed by the unit base 41 and the unit cover 42, and the tip 462*b* is positioned outside the unit base 41 and the unit cover 42. The locking part 462*c* comes into contact with a right side edge 472 of the left opening, thereby determining the attitude of the second link lever 462 in the normal state.

Figure 16:
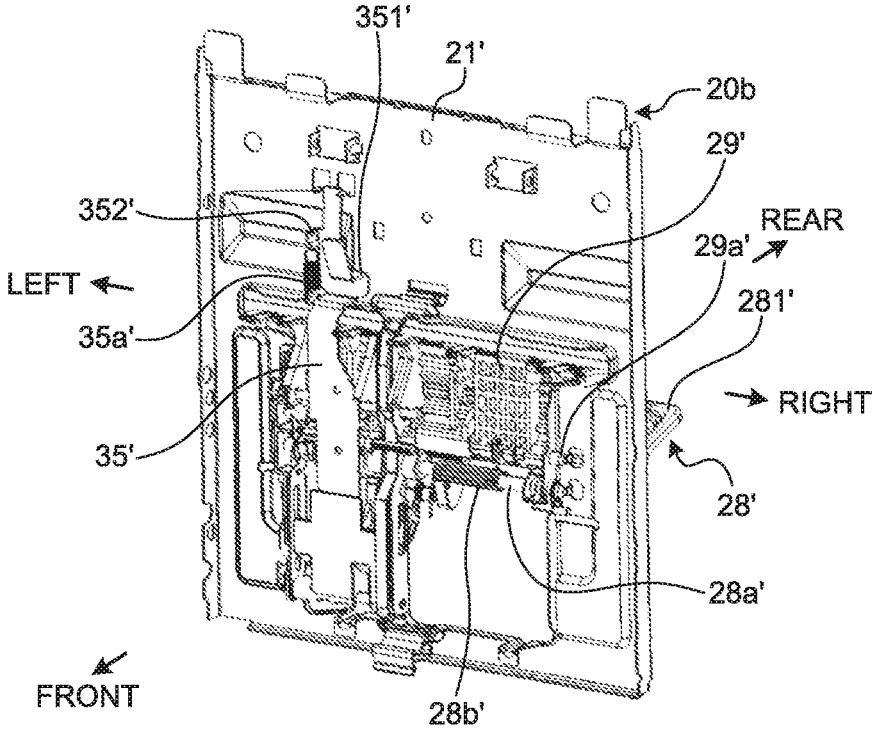
FIG. 16 is a perspective view when a second article discharging apparatus illustrated in FIG. 2 to FIG. 4 is viewed from the right front side.
Figure 17:
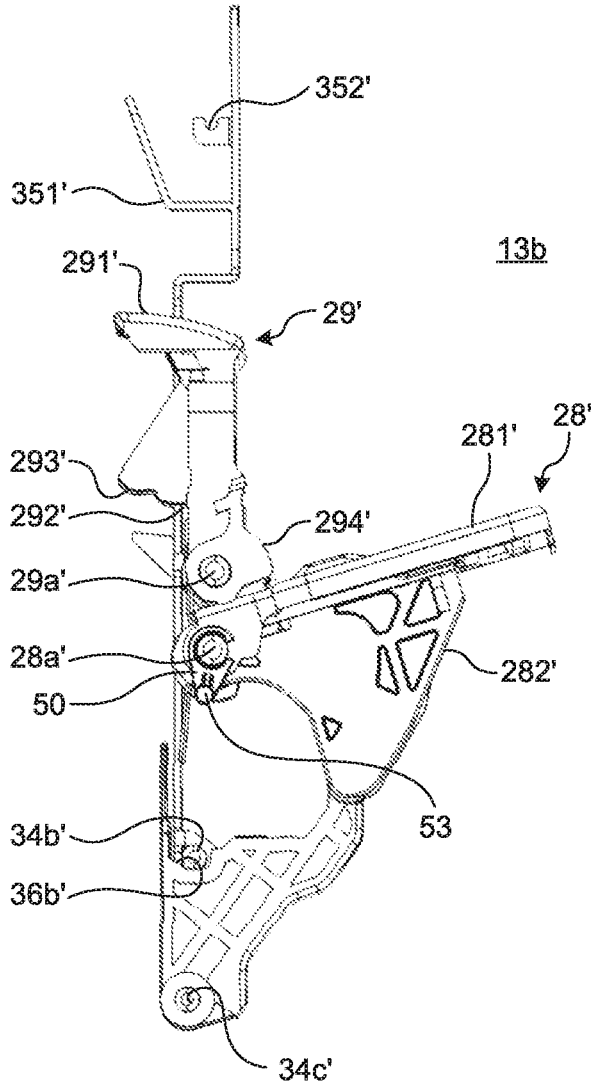
FIG. 17 is a schematic illustrative diagram when a principal part of the second article discharging apparatus illustrated in FIG. 2 to FIG. 4

FIG. 16 is a perspective view when the second article discharging apparatus 20*b* illustrated in FIG. 2 to FIG. 4 is viewed from the right front side. FIG. 17 is a schematic illustrative diagram when a principal part of the second article discharging apparatus 20*b* illustrated in FIG. 2 to FIG. 4 and FIG. 16 is viewed from the right side. Most of the components of the second article discharging apparatus 20*b* are common to the components of the first article discharging apparatus 20*a* and are different in fore-and-aft orientation from the components of the first article discharging apparatus 20*a* and are opposite in the right-and-left direction. Given this situation, the second article discharging apparatus 20*b* will be described simply with illustration omitted as appropriate and with "'" attached to the symbols attached in the first article discharging apparatus 20*a* for components common to the components of the first article discharging apparatus 20*a* among the components of the second article discharging apparatus 20*b*.

The second article discharging apparatus 20*b* is used for the second article storage passage 13*b* and is arranged at the lower part of this second article storage passage 13*b*. This second article discharging apparatus 20*b* controls the behavior of articles between the second article discharging apparatus 20*b* and a passage width defining plate 17 facing it, thereby functioning to store the articles in the second article storage passage 13*b* in a discharge standby state and to discharge a corresponding article one by one to the article chute 5 when being driven and includes a base 21'.

Figure 18:
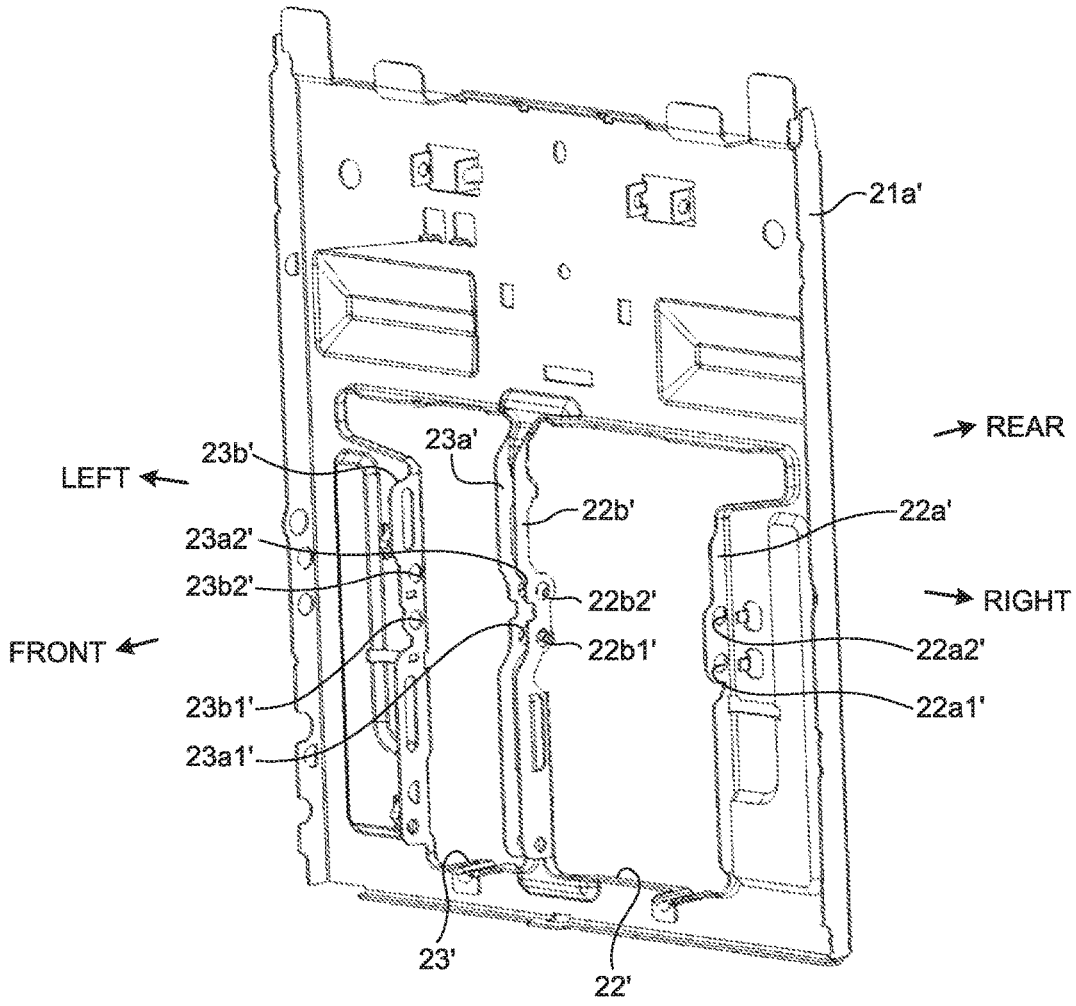
FIG. 18 is a perspective view of a base of the second article discharging apparatus illustrated in FIG. 16.

As illustrated in FIG. 18, the base 21' is formed by performing cutting and bending on a steel sheet and is arranged in such a manner as to cause its surface to face the passage width defining plate 17. This base 21' is formed with side walls 21*a*' by causing its both ends to be bent and is formed with a first insertion hole 22' and a second insertion hole 23' in its intermediate part. The peripheries of the first insertion hole 22' and the second insertion hole 23' are bent similarly to the side walls 21*a*' to form flanges.

The first insertion hole 22' and the second insertion hole 23' are formed so as to be next to each other right and left and have the same up-and-down dimension. As to the first insertion hole 22' and the second insertion hole 23', the first insertion hole 22' is positioned on the right side of the second insertion hole 23', and the right-and-left width of the first insertion hole 22' is larger than the right-and-left width of the second insertion hole 23'. The first insertion hole 22' and the second insertion hole 23' are both through openings (recesses causing a lower pedal 28' and an upper pedal 29' described below to retract to within the base 21') formed in a substantially rectangular shape as a whole; the upper end of the first insertion hole 22' protrudes rightward, whereas the upper end of the second insertion hole 23' protrudes leftward. A first right shaft support piece 22*a*' is provided on the right side edge of the first insertion hole 22', whereas a first left shaft support piece 22*b*' is provide on the left side edge of the first insertion hole 22'; a second right shaft support piece 23*a*' is provided on the right side edge of the second insertion hole 23', whereas a second left shaft support piece 23*b*' is provided on the left side edge of the second insertion hole 23'. The first left shaft support piece 22*b*' and the second right shaft support piece 23*a*' correspond to the flanges formed on the peripheries of the first insertion hole 22' and the second insertion hole 23'. The first left shaft support piece 22*b*' and the second right shaft support piece 23*a*' are formed in shaft inserting flanges forming U-shaped both leg pieces in a shaft support holding part that is formed integrally with the base 21' and is formed to have a U-shaped transverse cross section (discontinuous) that holds a shaft support part 24' described below in a fitted manner. This shaft support holding part has a function of maintaining the strength of the base 21' also when a large through opening including the first insertion hole 22' and the second insertion hole 23' formed in a substantially rectangular shape as a whole is formed in the base 21'.

Figure 19:
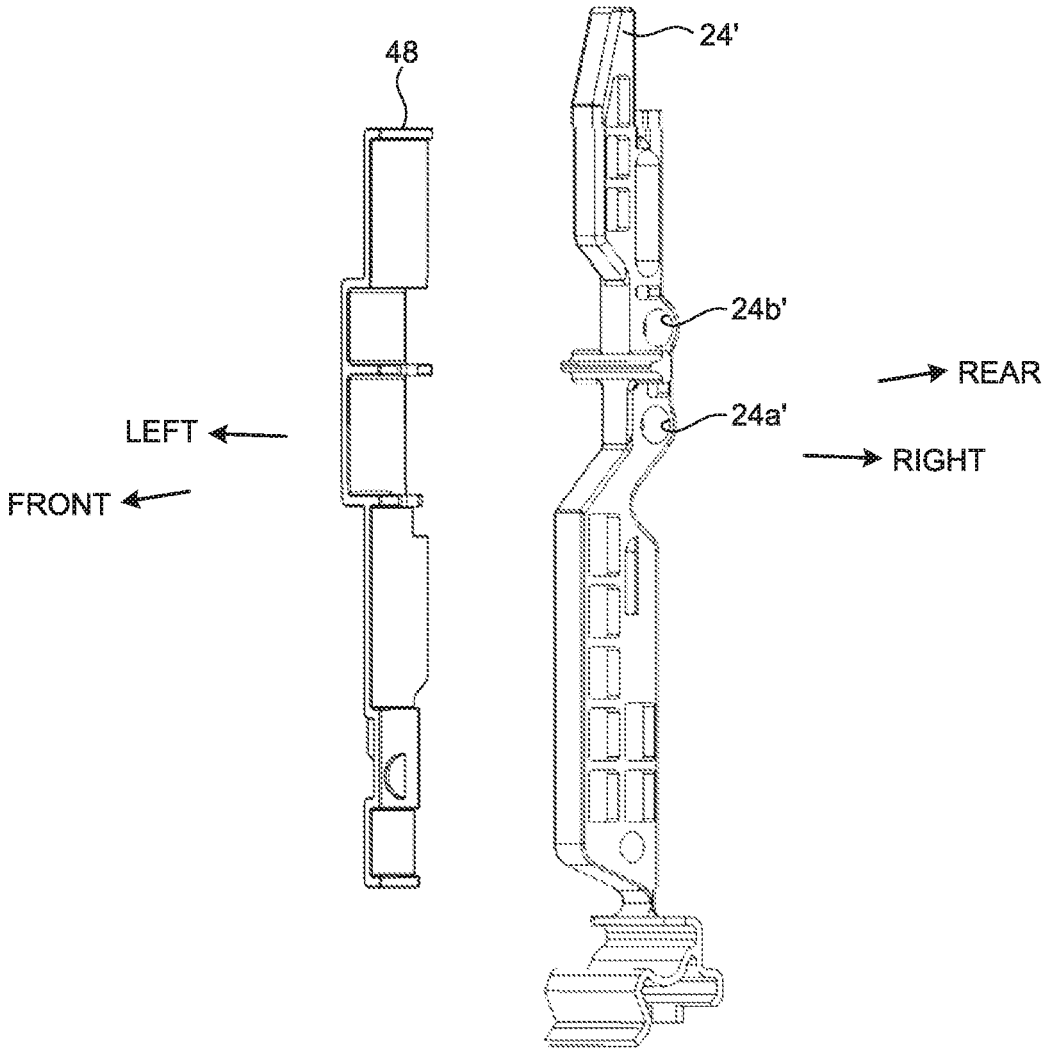
FIG. 19 is a perspective view of a shaft support part and a guide mounted on the base illustrated in FIG. 18.

The shaft support part 24' and a guide 48 as illustrated in FIG. 19 are mounted on the base 21' having the above configuration. The shaft support part 24' is formed of a resin material or the like and is fitted into between the first left shaft support piece 22*b*' and the second right shaft support piece 23*a*'. The guide 48 is formed of a resin material or the like similarly to the shaft support part 24' and is fitted to the base 21' in such a manner as to be adjacent to the second left shaft support piece 23*b*'.

Provided on the base 21' are a first swinging support shaft 28*a*' and a second swinging support shaft 29*a*'. The first swinging support shaft 28*a*' is a shaft-shaped member installed passing through open holes 22*a*1', 22*b*1', 23*a*1', 23*b*1', and 24*a*' formed in the first right shaft support piece 22*a*', the first left shaft support piece 22*b*', the second right shaft support piece 23*a*', the second left shaft support piece 23*b*', and the shaft support part 24', respectively, in such a manner as to extend in the substantially horizontal direction and supports the lower pedal 28' in its intermediate part.

A second out-of-stock link 50 (refer to FIG. 17) is arranged at the right end of the first swinging support shaft 28*a*'. The second out-of-stock link 50 includes a second out-of-stock base and a second out-of-stock contact part, which are not illustrated, and a second out-of-stock pressing part 53 as illustrated in FIG. 11. The second out-of-stock base is formed by coupling lower ends of two C-shaped, disc-shaped parts by a coupling part, for example, in which open holes through which the right end of the first swinging support shaft 28*a*' is passed are formed in the respective disc-shaped members. The second out-of-stock contact part extends leftward than a forward part of the left disc-shaped part of the second out-of-stock base. This second out-of-stock contact part is provided on the left side of the first out-of-stock contact part 32 included in the first out-of-stock link 30, thereby causing them not to interfere with each other. The second out-of-stock pressing part 53 is formed so as to protrude rightward than a lower part of the right disc-shaped part of the second out-of-stock base. The open holes formed in the second out-of-stock base are formed greater than the first swinging support shaft 28*a*', thereby enabling the second out-of-stock link 50 to move freely relative to the first swinging support shaft 28*a*'.

The second swinging support shaft 29*a*' is a shaft-shaped member installed passing through open holes 22*a*2', 22*b*2', 23*a*2', 23*b*2', and 24*b*' formed in the first right shaft support piece 22*a*', the first left shaft support piece 22*b*', the second right shaft support piece 23*a*', the second left shaft support piece 23*b*', and the shaft support part 24', respectively, in such a manner as to extend in the substantially horizontal direction in an area above the first swinging support shaft 28*a*' and supports the upper pedal 29' in its intermediate part.

The lower pedal 28' is a plate-shaped member and causes the first swinging support shaft 28*a*' to be inserted into its basal end to be arranged in such a manner as to be swingable about the central axis of this first swinging support shaft 28*a*'.

A tip of the lower pedal 28' extends in the radially outside direction of the first swinging support shaft 28*a*' and can advance and retract to and from the second article storage passage 13*b* through the first insertion hole 22' and the second insertion hole 23' when swinging about the central axis of the first swinging support shaft 28*a*'. In other words, the lower pedal 28' is swingably arranged in such a manner as to advance and retract to and from the second article storage passage 13*b*.

A lower pedal spring 28*b*' is interposed between the lower pedal 28' and the base 21'. The lower pedal spring 28*b*' always biases the lower pedal 28' in an advancing direction to the second article storage passage 13*b*. More specifically, the lower pedal spring 28*b*' sets the lower pedal 28' to a standby position (hereinafter may be referred to as an article-absent standby position (the second standby position)) so as to position the tip of the lower pedal 28' above the first swinging support shaft 28*a*' as illustrated in FIG. 17. When an article is placed on the top face of the lower pedal 28', the lower pedal spring 28*b*' sets the lower pedal 28' to a standby position (hereinafter may be referred to as an article-present standby position (the first standby position)) so as to position the tip of the lower pedal 28' at a height level equal to the first swinging support shaft 28*a*'.

With this operation, the tip of the lower pedal 28' is positioned at an upper position when the lower pedal 28' is in the article-absent standby position than when the lower pedal 28' is at the article-present standby position.

When the lower pedal 28' is in the article-absent standby position, the basal end of the lower pedal 28' comes into contact with the second out-of-stock contact part of the second out-of-stock link 50 as illustrated in FIG. 11, whereby the second out-of-stock link 50 rotates with the first swinging support shaft 28*a*' as an axis, whereby the second out-of-stock pressing part 53 presses the contact maker 27*a* of the second out-of-stock detection switch 27. With this operation, the contact maker 27*a* is pressed to be displaced rearward against the biasing force of the spring, whereby the second out-of-stock detection switch 27 is turned to the on state to send the on signal to the dispensing controller 60.

In contrast, when the lower pedal 28' is at the article-present standby position, the basal end of the lower pedal 28' separates from the second out-of-stock contact part of the second out-of-stock link 50, whereby the second out-of-stock link 50 becomes free. With this operation, the contact maker 27*a* is biased by the spring to be erected, whereby the second out-of-stock detection switch 27 is turned to the off state to send the off signal to the dispensing controller 60. In other words, the second out-of-stock pressing part 53 is pressed by the contact maker 27*a*, whereby the second out-of-stock link 50 that has become free rotates with the first swinging support shaft 28*a*' as the axis.

The lower pedal 28' includes a plate-shaped pedal main body 281' and a pair of guide parts 282'. The pair of guide parts 282' are provided on the back side of the pedal main body 281'. The guide parts 282' are plate-shaped members extending in the up-and-down direction and are formed so as to face each other. Guide grooves (not illustrated) are formed on the facing faces facing each other of the respective guide parts 282'.

The guide groove includes a fitted-in part that is positioned lowermost and in which a pedal operation shaft (not illustrated) of a turning stopper 36' described below is fitted in a state in which the lower pedal 28' is arranged at an advanced position most advanced to the second article storage passage 13*b*, a contact part that is positioned uppermost and with which the pedal operation shaft of the turning stopper 36' comes into contact in a state in which the lower pedal 28' is arranged at a retracted position most retracted from the second article storage passage 13*b*, and a first guide part and a second guide part that connect the fitted-in part and the contact part so as to make them continuous.

The first guide part is formed in the guide part 282' in such a manner as to incline obliquely upward so as to separate from the fitted-in part relative to the base 21', to incline obliquely upward so as to be close to the base 21', and to reach the contact part in the state in which the lower pedal 28' is arranged at a position (an advanced position) most advanced relative to the second article storage passage 13*b*.

The second guide part is formed in the guide part 282' in such a manner as to incline obliquely downward so as to separate from the contact part relative to the base 21' and to reach the fitted-in part in the state in which the lower pedal 28' is arranged at the position (the advanced position) most advanced to the second article storage passage 13*b*.

The radially outward length of this lower pedal 28' from the first swinging support shaft 28*a*' is set to a length that can ensure a gap smaller than the maximum width of an article the maximum width of which is smaller between the lower pedal 28' and the passage width defining plate 17 when the lower pedal 28' is positioned at the position (the advanced position) most advanced to the second article storage passage 13*b*.

The upper pedal 29' is a plate-shaped member and causes the second swinging support shaft 29*a*' to be inserted into its basal end to be thereby arranged on the base 21' in such a manner as to be swingable about the central axis of this second swinging support shaft 29*a*'.

A tip of the upper pedal 29' extends in the radially outside direction of the second swinging support shaft 29*a*' and can advance and retract to and from the second article storage passage 13*b* through the first insertion hole 22' and the second insertion hole 23' when swinging about the central axis of the second swinging support shaft 29*a*'. In other words, the upper pedal 29' is swingably arranged in such a manner as to advance and retract to and from the second article storage passage 13*b*.

An upper pedal spring (not illustrated) is interposed between the upper pedal 29' and the base 21'. The upper pedal spring always biases the upper pedal 29' in a retracting direction from the second article storage passage 13*b*.

The upper pedal 29' includes a pressing inclined face 291', a recess 292', a stopper contact part 293', and a protrusion 294'. The pressing inclined face 291' is provided at the tip of the upper pedal 29' and is a curved inclined face formed in such a manner as to gradually lower toward the second article storage passage 13*b* when the upper pedal 29' is retracted from the second article storage passage 13*b*. The recess 292' is provided on the back side of the upper pedal 29' and is a line of recess extending in the substantially horizontal direction formed in such a manner as to open to both side faces of the upper pedal 29'. The stopper contact part 293' is a part with which a stopper pin described below comes into contact and is provided in such a manner as to incline above the recess 292' on the back side of the upper pedal 29'.

The protrusion 294' is provided in such a manner as to protrude at the basal end of the upper pedal 29' toward the second article storage passage 13*b*.

This upper pedal 29' is biased to retract from the second article storage passage 13*b* by the biasing force of the upper pedal spring, and the stopper pin comes into contact with the recess 292', whereby an initial position is set to the state in which the upper pedal 29' has retracted from the second article storage passage 13*b*.

This upper pedal 29' is inclined forward relative to a vertical plane passing through the second swinging support shaft 29*a*' in a state in which the upper pedal 29' is positioned at a position (an advanced position) most advanced to the second article storage passage 13*b*. The radially outward length of the upper pedal 29' from the second swinging support shaft 29*a*' is set to a length that can ensure a gap smaller than the maximum width of an article the maximum width of which is smaller between the upper pedal 29' and the passage width defining plate 17 in the forward inclined state.

In the base 21', installed between the shaft support part 24' and the second left shaft support piece 23*b*' are the stopper pin (not illustrated), a pedal stopper pin 34*b*', and a stopper shaft 34*c*'.

The stopper pin is a shaft-shaped member arranged in the substantially horizontal direction between the shaft support part 24' and the second left shaft support piece 23*b*'. This stopper pin is connected to a pedal link 35' and can move in the up-and-down direction along with the movement in the up-and-down direction of the pedal link 35'. The stopper pin is in contact with the recess 292' of the upper pedal 29' in the initial position.

The pedal stopper pin 34*b*' is a shaft-shaped member arranged in the substantially horizontal direction between the shaft support part 24' and the second left shaft support piece 23*b*'. This pedal stopper pin 34*b*' is connected to a pedal link 35' and can move in the up-and-down direction along with the movement in the up-and-down direction of the pedal link 35'.

The stopper shaft 34*c*' is a shaft-shaped member arranged in the substantially horizontal direction between the shaft support part 24' and the second left shaft support piece 23*b*' and supports the turning stopper 36' in its intermediate part.

The turning stopper 36' causes the stopper shaft 34*c*' to be inserted into its insertion hole of its basal end and is arranged between the shaft support part 24' and the second left shaft support piece 23*b*' in such a manner as to be swingable about the central axis of this stopper shaft 34*c*'.

A tip of the turning stopper 36' extends in the radially outside direction of the stopper shaft 34*c*' and can advance and retract to and from the second article storage passage 13*b* through the second insertion hole 23' when swinging about the central axis of the stopper shaft 34*c'*.

This turning stopper 36' causes a pedal operation shaft 361' (refer to FIG. 4) to be inserted into an open hole (not illustrated) of the tip and thereby has the pedal operation shaft 361'. The pedal operation shaft 361' is a shaft-shaped member arranged in the substantially horizontal direction, both ends of which are fitted in the guide grooves of the lower pedal 28'.

A pedal operation spring (not illustrated) is interposed between the turning stopper 36' and the base 21'. The pedal operation spring always biases the turning stopper 36' in an advancing direction to the second article storage passage 13*b*.

This turning stopper 36' is biased in an advancing direction to the second article storage passage 13*b* by the pedal operation spring and is prevented from moving in a retracting direction by the pedal stopper pin 34*b'* entering an indentation 36*b'* of the turning stopper 36' and coming into contact with the pedal stopper pin 34*b'*, and an initial position with the turning stopper 36' advanced to the second article storage passage 13*b* is set. The lower pedal 28' is biased by the lower pedal spring 28*b'*, whereby the turning stopper 36' positions both ends of the pedal operation shaft 361' at the fitted-in parts of the guide grooves and sets an initial position at a position at which the lower pedal 28' has advanced to the second article storage passage 13*b*.

The pedal link 35' is an elongated plate-shaped member extending in the up-and-down direction, in which an upper part is bent rearward and then extends upward. Provided on the upper part of this pedal link 35' are a contact piece 351' that extends frontward and then extends obliquely upward and a locking part 352' that locks a link spring 35*a'*. This link spring 35*a'* is interposed between the pedal link 35' and the base 21' and always biases the pedal link 35' downward.

With the pedal link 35' biased by the link spring 35*a'* and arranged at a lower position, the recess 292' of the upper pedal 29' arranged at the retracted position is in contact with the stopper pin. Besides, the turning stopper 36' arranged at the advanced position is in contact with the pedal stopper pin 34*b'*, thereby preventing the turning stopper 36 from retracting. In addition, the pedal operation shaft 361' of the turning stopper 36' arranged at the advanced position is fitted in the fitted-in parts of the lower pedal 28', thereby preventing the lower pedal 28' arranged at the advanced position from retracting.

In contrast, with the pedal link 35' arranged at an upper position against the biasing force of the link spring 35*a'*, the stopper contact part 293' of the upper pedal 29' is in contact with the stopper pin, thereby preventing the upper pedal 29' from retracting and causing the upper pedal 29' to advance against the biasing force of the upper pedal spring and to be arranged at the advanced position.

Meanwhile, the prevention of retracting for the turning stopper 36' by the pedal stopper pin 34*b'* is released, and the prevention of retracting is released about the stopper shaft 34*c'*. The load of the article in contact with the lower pedal 28' maintained at the advanced position by the turning stopper 36' is being applied to the turning stopper 36', and the prevention of retracting for the turning stopper 36' has been released, whereby the turning stopper 36' starts retracting. When the retracting of the turning stopper 36' is started, the pedal operation shaft 361' is detached from the fitted-in parts of the lower pedal 28', whereby the lower pedal 28' is allowed to retract about the first swinging support shaft 28*a'* and retracts against the elastic biasing force of the lower pedal spring 28*b'* by the load of the article.

When the lower pedal 28' thus retracts, the basal end of the lower pedal 28' separates from the second out-of-stock contact part of the second out-of-stock link 50, whereby the second out-of-stock link 50 becomes free. With this operation, the contact maker 27*a* is pressed by the spring to be erected, whereby the second out-of-stock detection switch 27 maintains the off state. In other words, also when the lower pedal 28' retracts similarly to the article-present standby position, the second out-of-stock link 50 does not press the contact maker 27*a* of the second out-of-stock detection switch 27.

The first article discharging apparatus 20*a* and the second article discharging apparatus 20*b* having the above configuration are combined in a back-to-back manner with the harness guide 25 as a guide member to form the article dispensing apparatus 20. In this case, the tip of the first link lever 461 included in the driving unit 40 is positioned at a lower area of the contact piece 351 of the pedal link 35, whereas the tip of the second link lever 462 is positioned at a lower area of the contact piece 351' of the pedal link 35'.

Figure 20:
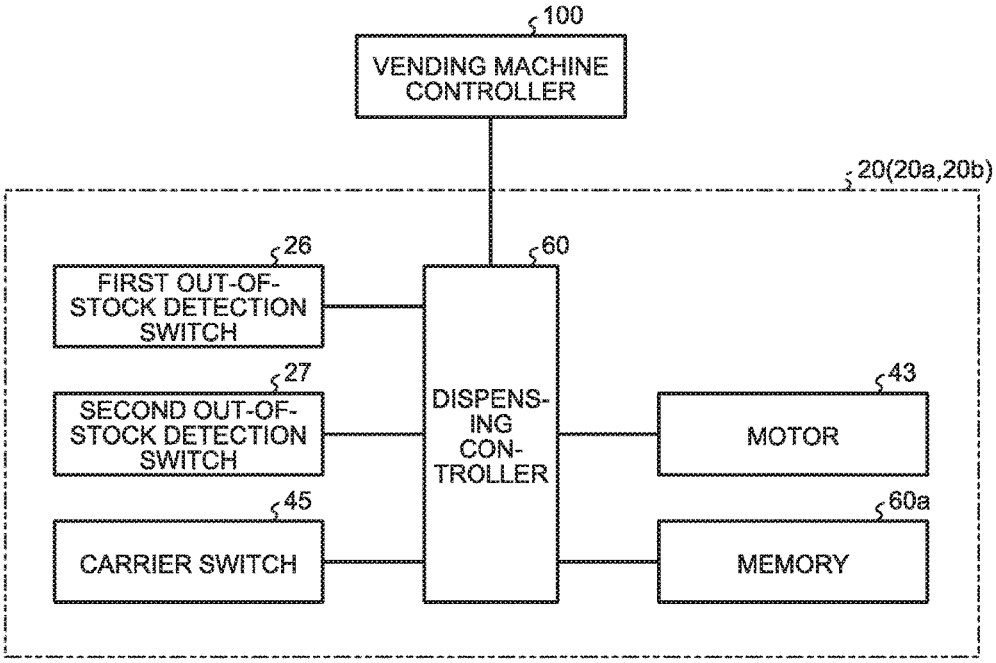
FIG. 20 is a block diagram of a characteristic control system of the article dispensing apparatus.

FIG. 20 is a block diagram of a characteristic control system of the article dispensing apparatus 20. As illustrated in FIG. 20, the article dispensing apparatus 20 includes the dispensing controller 60. The dispensing controller 60 comprehensively controls the operation of the article dispensing apparatus 20 in accordance with computer programs and data stored in a memory 60*a* and is communicable with a vending machine controller 100 that controls the selling operation of the vending machine. Processing that this dispensing controller 60 performs will be described below.

The article dispensing apparatus 20 configured as described above in the standby state is as follows. In the following description, an article stored in the first article storage passage 13*a* will be referred to also as a "first article", whereas an article stored in the second article storage passage 13*b* will be referred to also as a "second article".

In the driving unit 40 provided in the first article discharging apparatus 20*a*, the cam part 443*a* and the pressing piece 443*b* of the output gear 443 are positioned uppermost, and the pressing piece 443*b* is pressing the contact maker 45*a* of the carrier switch 45. In this case, the carrier switch 45 is turned to the on state. In this standby state, the tip 461*b* of the first link lever 461 included in the driving unit 40 is at a position separate from the contact piece 351 of the pedal link 35 downward, whereas the tip 462*b* of the second link lever 462 is at a position separate from the contact piece 351' of the pedal link 35' downward.

Given this situation, in the first article discharging apparatus 20*a*, the pedal link 35 is arranged at the lower position as illustrated in FIG. 5. Articles are charged into the first article storage passage 13*a*, and an article is placed on the upper face of the lower pedal 28, whereby the lower pedal 28 is at the article-present standby position, and the upper pedal 29 has retracted from the first article storage passage 13*a* (refer to part (a) of FIG. 23). The lower pedal 28 is thus at the article-present standby position, and the contact maker 26*a* is erected, whereby the first out-of-stock detection switch 26 is turned to the off state.

Figure 24:
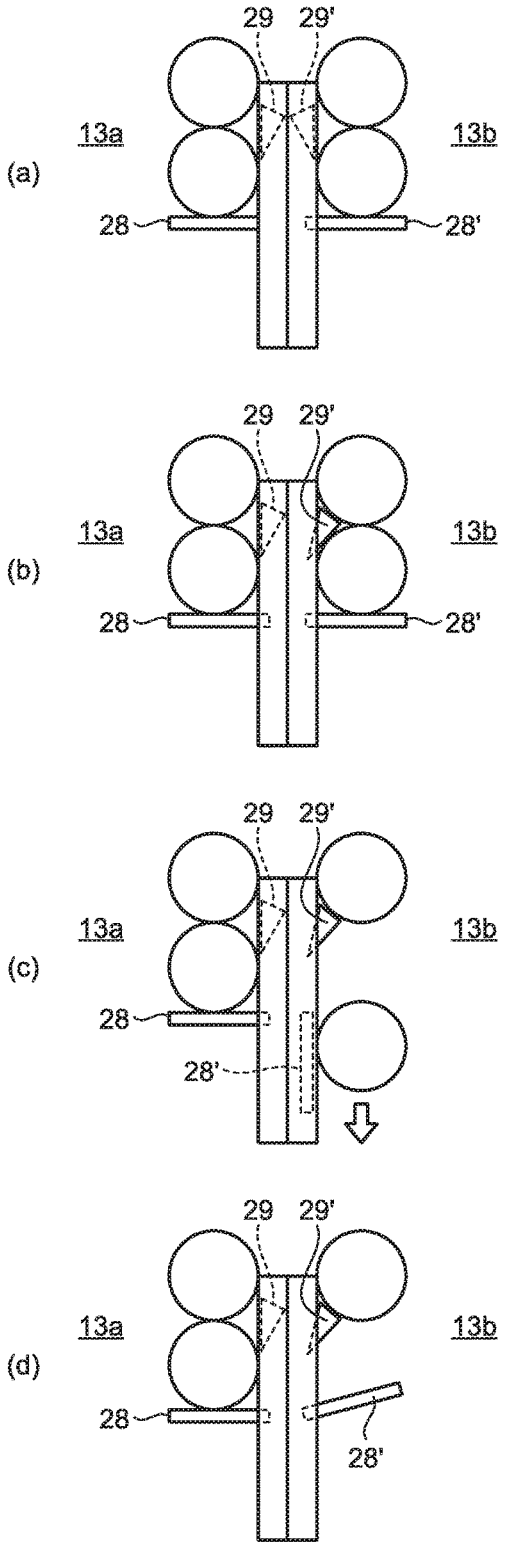
FIG. 24 is a schematic illustrative diagram of a procedure for discharging an article in the second article discharging apparatus.

In the second article discharging apparatus 20*b*, the pedal link 35' is positioned at the lower position, the lower pedal 28' is at the article-present standby position, and the upper pedal 29' has retracted from the second article storage passage 13*b* (refer to part (a) of FIG. 24). The lower pedal 28' is thus at the article-present standby position, and the contact maker 27*a* is elected, whereby the second out-of-stock detection switch 27 is turned to the off state.

In the article dispensing apparatus 20, if the dispensing controller 60 performs input processing for inputting a discharging instruction for a first article given from the vending machine controller 100, the dispensing controller 60 drives the motor 43 forward.

When the motor 43 is thus driven forward, the output gear 443 to which the driving force of the motor 43 has been transmitted via the worm gear 441 and the intermediate gear 442 rotates clockwise when viewed from the front.

When the output gear 443 rotates clockwise when viewed from the front, the pressing piece 443*b* of the output gear 443 separates from the contact maker 45*a* of the carrier switch 45. With this operation, the contact maker 45*a* of the carrier switch 45 is released from the pressed state and is switched from the on state to the off state, and gives an off signal to the dispensing controller 60.

Figure 21:
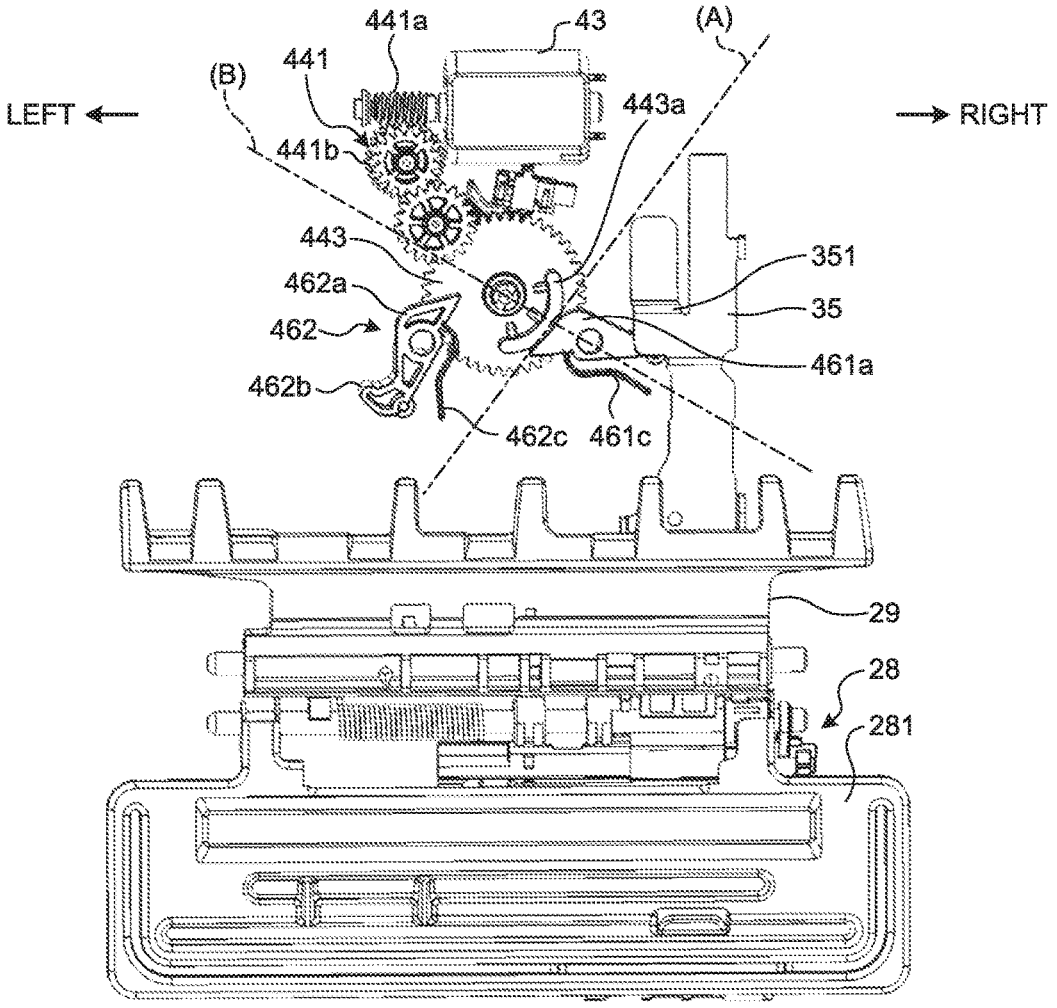
FIG. 21 is an illustrative diagram when the operation of a principal part of the driving unit is viewed from the front side.
Figure 22:
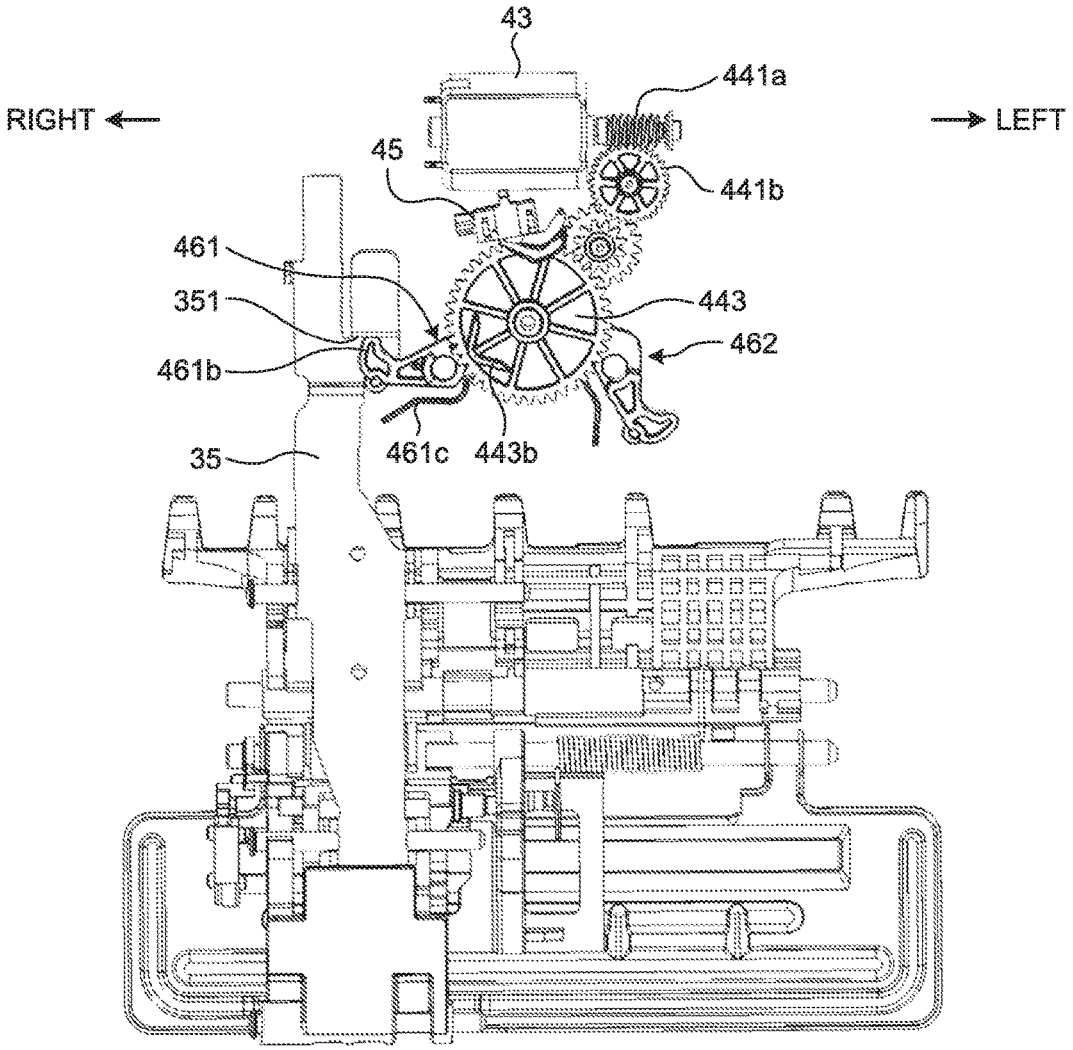
FIG. 22 is an illustrative diagram when the operation of the principal part of the driving unit is viewed from the exact rear.

When the cam part 443*a* comes into contact with the basal end 461*a* of the first link lever 461 from above by the rotation of the output gear 443, the first link lever 461 rotates counterclockwise when viewed from the front. When this first link lever 461 rotates counterclockwise, the tip 461*b* moves upward. The tip 461*b* thus moves upward to come into contact with the contact piece 351 of the pedal link 35 as illustrated in FIG. 21 and FIG. 22, can move the pedal link 35 upward by a certain distance against the biasing force of the link spring 35*a*, and can besides maintain the state in which the pedal link 35 has been moved upward by the certain distance while the cam part 443*a* is in sliding contact with the basal end 461*a*.

In this case, the first link lever 461, when being in sliding contact with the cam part 443*a*, is adjusted so as to cause a plane (A) containing a part in sliding contact with the cam part 443*a* to be substantially orthogonal to a plane (B) containing its own central axis (the central axis of the first link shaft 42*e*) and the central axis of the output gear 443.

Along with this upward movement of the pedal link 35, the stopper pin 34*a* moves upward from the lower end of the stopper pin insertion holes 23*b*3 and 24*c*1, and the pedal stopper pin 34*b* moves upward from the lower end of the pedal stopper pin support grooves 23*b*4 and 24*c*2.

Figure 23:
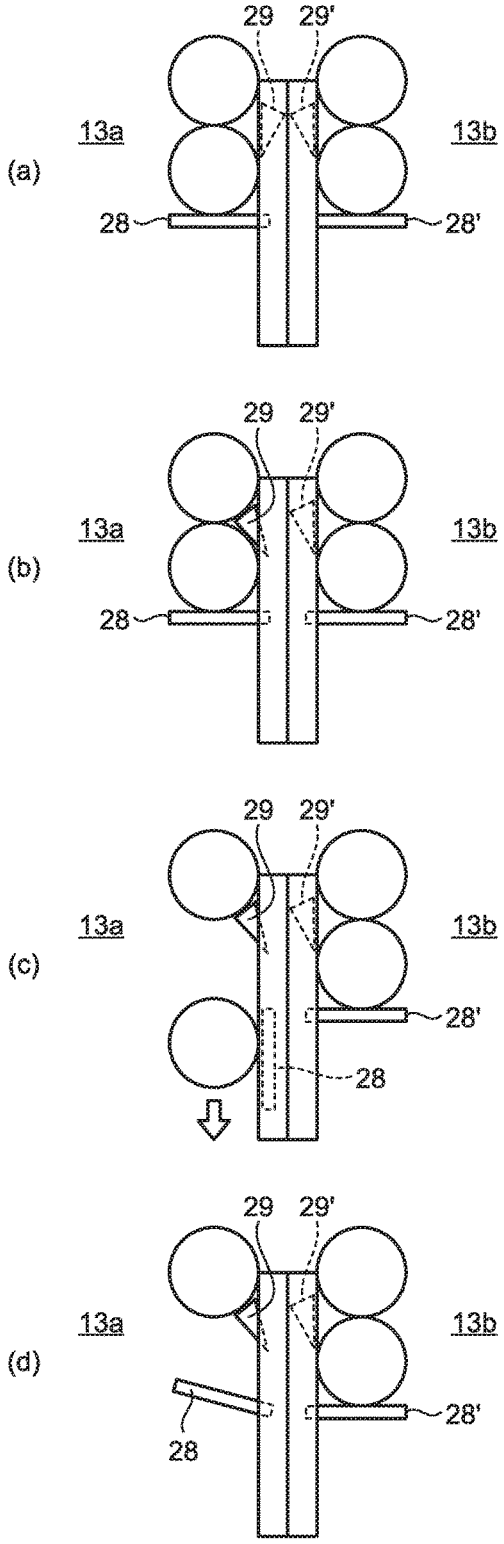
FIG. 23 is a schematic illustrative diagram of a procedure for discharging an article in the first article discharging apparatus.

In this process, the stopper pin 34*a* moves upward while being in contact with the edge wall of the recess 292 of the upper pedal 29, whereby the upper pedal 29 advances from the initial position against the biasing force of the upper pedal spring as illustrated in part (b) of FIG. 23. This advancing of the upper pedal 29 is performed by the upward movement of the stopper pin 34*a*. When reaching the upper end of the stopper pin insertion holes 23*b*3 and 24*c*1, the stopper pin 34*a* comes into contact with the stopper contact part 293 to prevent the upper pedal 29 from retracting.

The upper pedal 29 that has advanced comes into contact with the second lowermost first article (hereinafter may be referred to as a next article) to prevent the next article from moving downward.

Meanwhile, the load of the article in contact with the lower pedal 28 maintained at the advanced position is being applied to the turning stopper 36, and the prevention of retracting has been released by the upward movement of the pedal stopper pin 34*b*, whereby the turning stopper 36 starts retracting.

When the turning stopper 36 thus starts retracting, the pedal operation shaft 361 escapes from the fitted-in part 283*a*, and the lower pedal 28 starts retracting against the biasing force of the lower pedal spring 28*b* by the self-weight of the article. The pedal operation shaft 361 of the turning stopper 36 that has escaped from the fitted-in part 283*a* moves toward a position at which the first guide part 283*b* and the second guide part 283*c* cross each other along the first guide part 283*b*.

After that, as illustrated in part (c) of FIG. 23, the lower pedal 28 retracts by the self-weight of the lowermost article, the lowermost article is allowed to move downward, and the lowermost article is discharged downward (refer to FIG. 8). The discharged article is guided to the article discharging port 3*c* via the article chute 5 and is further enabled to be taken out via the article outlet port 2*a*.

When the lowermost article slips through the lower pedal 28, the lower pedal 28 moves toward the advanced position by the elastic biasing force of the lower pedal spring 28*b*, and the turning stopper 36 also moves toward the advanced position by the elastic biasing force of the pedal operation spring. When the lower pedal 28 and the turning stopper 36 move toward the advanced position, the pedal operation shaft 361 that has been maintained at the position at which the first guide part 283*b* and the second guide part 283*c* cross each other moves toward the fitted-in part 283*a* along the second guide part 283*c*, and the lower pedal 28 and the turning stopper 36 return to the advanced position.

Meanwhile, the pedal link 35 moves upward, the stopper pin 34*a* is positioned at the upper end of the stopper pin insertion holes 23*b*3 and 24*c*1, and the pedal stopper pin 34*b* is positioned at the upper end of the pedal stopper pin support grooves 23*b*4 and 24*c*2.

After that, when the contact between the cam part 443*a* and the basal end 462*a* is released by the rotation of the output gear 443, the pedal link 35 is biased by the link spring 35*a* to move downward.

By this downward movement of the pedal link 35, the stopper pin 34*a* moves downward from the upper end of the stopper pin insertion holes 23*b*3 and 24*c*1, and the pedal stopper pin 34*b* moves downward from the upper end of the pedal stopper pin support grooves 23*b*4 and 24*c*2.

When the pedal stopper pin 34*b* moves to the lower end of the pedal stopper pin support grooves 23*b*4 and 24*c*2, the pedal stopper pin 34*b* comes into contact with the indentation 36*b* on the back side of the turning stopper 36 that has returned to the advanced position. With this operation, movement in the retracting direction is prevented, and the lower pedal 28 returns to the article-absent standby position that has advanced to the first article storage passage 13*a* by the biasing force of the lower pedal spring 28*b* as illustrated in part (d) of FIG. 23. As a result, the first out-of-stock detection switch 26 is switched from the off state to the on state, and gives an on signal to the dispensing controller 60.

Meanwhile, the upper pedal 29 retracts along with the downward movement of the stopper pin 34*a* by being biased by the upper pedal spring. With this operation, the next article is allowed to move downward, and while the next article then comes into contact with the lower pedal 28 having advanced and is prevented from moving downward, the lower pedal 28 shifts to the article-present standby position and returns to the standby state as illustrated in part (a) of FIG. 23.

In the driving unit 40, by the clockwise rotation when viewed from the front of the output gear 443, the cam part 443*a* then comes into contact with the basal end 462*a* of the second link lever 462. In this case, the locking part 462*c* is in contact with the right side edge 472 of the left opening, whereby the second link lever 462 is prevented from rotating about the central axis. Consequently, the locking part 462*c* becomes elastically deformed so as to allow the basal end

462*a* to be close to the locking part 462*c*, and the movement of the cam part 443*a* by the rotation of the output gear 443 is not hindered.

After that, when the cam part 443*a* returns to the standby position by the rotation of the output gear 443, the pressing piece 443*b* presses the contact maker 45*a* of the carrier switch 45, whereby the carrier switch 45 is switched from the off state to the on state, and gives an on signal to the dispensing controller 60. Immediately after the pressing piece 443*b* presses the contact maker 45*a* of the carrier switch 45, the cam part 443*a* is detached from the basal end 462*a* of the second link lever 462, and the second link lever 462 returns to the original state by the locking part 462*c*. After that, the dispensing controller 60 stops the drive of the motor 43.

In the above-described article dispensing apparatus 20, if the dispensing controller 60 performs input processing for inputting a discharging instruction for a second article given from the vending machine controller 100, the dispensing controller 60 drives the motor 43 backward.

When the motor 43 is thus driven backward, the output gear 443 to which the driving force of the motor 43 has been transmitted via the worm gear 441 and the intermediate gear 442 rotates counterclockwise when viewed from the front.

When the output gear 443 rotates counterclockwise when viewed from the front, the pressing piece 443*b* of the output gear 443 separates from the contact maker 45*a* of the carrier switch 45. With this operation, the contact maker 45*a* of the carrier switch 45 is released from the pressed state and is switched from the on state to the off state, and gives an off signal to the dispensing controller 60.

When the cam part 443*a* comes into contact with the basal end 462*a* of the second link lever 462 from above by the rotation of the output gear 443, the second link lever 462 rotates clockwise when viewed from the front. When this second link lever 462 rotates clockwise, the tip 462*b* moves upward. The tip 462*b* thus moves upward to come into contact with the contact piece 351' of the pedal link 35', can move the pedal link 35' upward by a certain distance against the biasing force of the link spring 35*a*', and can besides maintain the state in which the pedal link 35' has been moved upward by the certain distance while the cam part 443*a* is in sliding contact with the basal end 462*a*.

In this case, the second link lever 462, when being in sliding contact with the cam part 443*a*, is adjusted so as to cause a plane containing a part in sliding contact with the cam part 443*a* to be substantially orthogonal to a plane containing its own central axis (the central axis of the second link shaft 42*f*) and the central axis of the output gear 443, although not explicitly illustrated in the drawing.

Along with this upward movement of the pedal link 35', the stopper pin moves upward, and the pedal stopper pin 34*b*' also moves upward.

In this process, the stopper pin moves upward while being in contact with the edge wall of the recess 292' of the upper pedal 29', whereby the upper pedal 29' advances from the initial position against the biasing force of the upper pedal spring as illustrated in part (b) of FIG. 24. This advancing of the upper pedal 29' is performed by the upward movement of the stopper pin. When reaching the upper end of the stopper pin insertion holes, the stopper pin comes into contact with the stopper contact part 293' to prevent the upper pedal 29' from retracting.

The upper pedal 29' that has advanced comes into contact with the second lowermost second article (hereinafter may be referred to as a next article) to prevent the next article from moving downward.

Meanwhile, the load of the article in contact with the lower pedal 28' maintained at the advanced position is being applied to the turning stopper 36', and the prevention of retracting has been released by the upward movement of the pedal stopper pin 34*b*', whereby the turning stopper 36' starts retracting.

When the turning stopper 36' thus starts retracting, the pedal operation shaft 361' escapes from the fitted-in part, and the lower pedal 28' starts retracting against the biasing force of the lower pedal spring 28*b*' by the self-weight of the article. The pedal operation shaft 361' of the turning stopper 36' that has escaped from the fitted-in part moves toward a position at which the first guide part and the second guide part cross each other along the first guide part.

After that, as illustrated in part (c) of FIG. 24, the lower pedal 28' retracts by the self-weight of the lowermost article, the lowermost article is allowed to move downward, and the lowermost article is discharged downward. The discharged article is guided to the article discharging port 3*c* via the article chute 5 and is further enabled to be taken out via the article outlet port 2*a*.

When the lowermost article slips through the lower pedal 28', the lower pedal 28' moves toward the advanced position by the elastic biasing force of the lower pedal spring 28*b*', and the turning stopper 36' also moves toward the advanced position by the elastic biasing force of the pedal operation spring. When the lower pedal 28' and the turning stopper 36' move toward the advanced position, the pedal operation shaft 361' that has been maintained at the position at which the first guide part and the second guide part cross each other moves toward the fitted-in part along the second guide part, and the lower pedal 28' and the turning stopper 36' return to the advanced position.

After that, when the contact between the cam part 443*a* and the basal end 462*a* is released by the rotation of the output gear 443, the pedal link 35' is biased by the link spring 35*a*' to move downward.

By this downward movement of the pedal link 35', the stopper pin moves downward, and the pedal stopper pin 34*b*' also moves downward.

When the pedal stopper pin 34*b*' moves to the lower end of the pedal stopper pin support grooves, the pedal stopper pin 34*b*' comes into contact with the indentation 36*b*' on the back side of the turning stopper 36' that has returned to the advanced position. With this operation, movement in the retracting direction is prevented, and the lower pedal 28' returns to the article-absent standby position that has advanced to the second article storage passage 13*b* by the biasing force of the lower pedal spring 28*b*' as illustrated in part (d) of FIG. 24. As a result, the second out-of-stock detection switch 27 is switched from the off state to the on state, and gives an on signal to the dispensing controller 60.

Meanwhile, the upper pedal 29' retracts along with the downward movement of the pedal stopper pin 34*b*' by being biased by the upper pedal spring. With this operation, the next article is allowed to move downward, and while the next article then comes into contact with the lower pedal 28' having advanced and is prevented from moving downward, the lower pedal 28' shifts to the article-present standby position and returns to the standby state as illustrated in part (a) of FIG. 24.

In the driving unit 40, by the counterclockwise rotation when viewed from the front of the output gear 443, the cam part 443*a* then comes into contact with the basal end 461*a* of the first link lever 461. In this case, the locking part 461*c* is in contact with the left side edge 471 of the right opening, whereby the first link lever 461 is prevented from rotating about the central axis. Consequently, the locking part 461*c* becomes elastically deformed so as to allow the basal end 461*a* to be close to the locking part 461*c*, and the movement of the cam part 443*a* by the rotation of the output gear 443 is not hindered.

After that, when the cam part 443*a* returns to the standby position by the rotation of the output gear 443, the pressing piece 443*b* presses the contact maker 45*a* of the carrier switch 45, whereby the carrier switch 45 is switched from the off state to the on state, and gives an on signal to the dispensing controller 60. After that, the dispensing controller 60 stops the drive of the motor 43.

Figure 25:
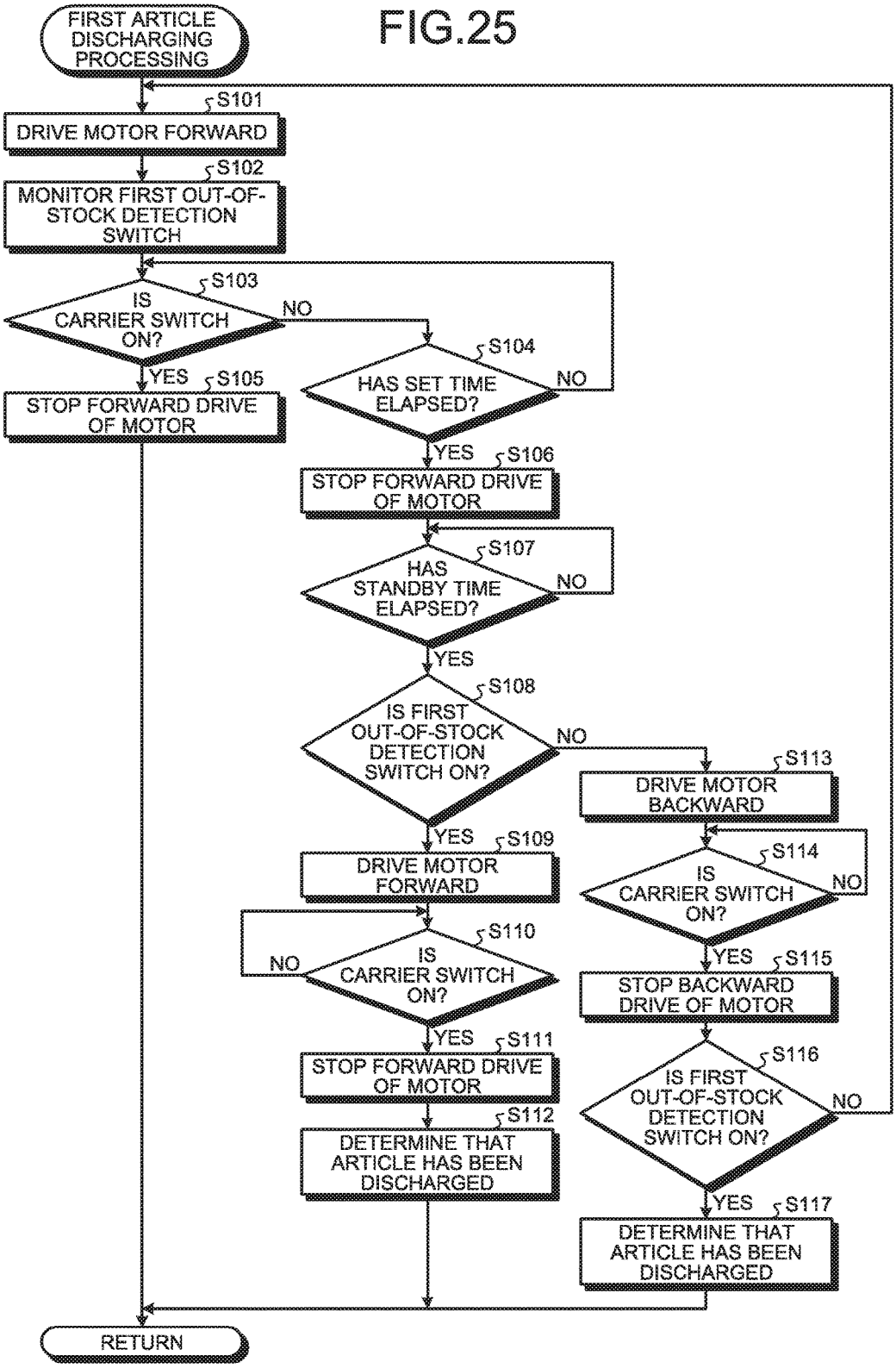
FIG. 25 is a flowchart of a detailed processing of a first article discharging processing that a dispensing controller performs when a discharging instruction for a first article is given from a vending machine controller.

FIG. 25 is a flowchart of a detailed processing of a first article discharging processing that the dispensing controller 60 performs when a discharging instruction for a first article is given from the vending machine controller 100. Although the first article discharging processing is performed simultaneously with the discharging operation for the first article performed by the article dispensing apparatus 20, the first article discharging processing is described separately from the discharging operation for the convenience of description.

In the first article discharging processing, the dispensing controller 60 drives the motor 43 forward (Step S101), and monitors a signal from the first out-of-stock detection switch 26 (Step S102).

The dispensing controller 60 is in a waiting state in which it waits for whether the on signal is given thereto from the carrier switch 45 before a preset set time (e.g., one to two seconds) set in the memory 60*a* elapses (Step S103, Step S104).

If the on signal is given from the carrier switch 45 before the set time elapses (Yes at Step S103, No at Step S104), that is, if the output gear 443 returns to the standby position, the dispensing controller 60 stops the forward drive of the motor 43 (Step S105), and returns the procedure to end the present processing.

With this processing, the first article is discharged in accordance with the discharging instruction for the first article, and thus the first article is dispensed from the article dispensing apparatus 20.

If the on signal is not given from the carrier switch 45 and the set time elapses (No at Step S103, Yes at Step S104), that is, if the set time has elapsed but the output gear 443 has not returned to the standby position, the dispensing controller 60 stops the forward drive of the motor 43 (Step S106) and is in a waiting state in which it waits until a preset standby time (e.g., 0.5 to 1.5 seconds) set in the memory 60*a* elapses (Step S107).

After the standby time has elapsed (Yes at Step S107), if the on signal was given in the set time or in the standby time from the first out-of-stock detection switch 26 monitored by the dispensing controller 60 since Step S102 (Yes at Step S108), the dispensing controller 60 drives the motor 43 forward (Step S109).

If the on signal is given from the carrier switch 45 (Yes at S110), the dispensing controller 60 that has driven the motor 43 forward stops the forward drive of the motor 43, and determines that the first article has been discharged (Step S111, Step S112), and returns the procedure to end the present processing.

If the on signal was not given from the first out-of-stock detection switch 26 in the set time or in the standby time at Step S108 (No at Step S108), the dispensing controller 60 drives the motor 43 backward (Step S113).

If the on signal is given from the carrier switch 45 (Yes at Step S114), the dispensing controller 60 that has driven the motor 43 backward stops the backward drive of the motor 43 (Step S115).

If the dispensing controller 60 stops the backward drive of the motor 43, that is, if the output gear 443 returns to the standby position, the dispensing controller 60 determines whether the on signal has been given from the first out-of-stock detection switch 26 in a drive time from the beginning of the processing at Step S113 to the present time (Step S116).

If the on signal has not been given from the first out-of-stock detection switch 26 (No at Step S116), the process returns to the processing at Step S101 and the dispensing controller 60 repeats the above-described procedure.

If the on signal has been given from the first out-of-stock detection switch 26 (Yes at S116), the dispensing controller 60 determines that the first article has been discharged (Step S117), and returns the procedure to end the present processing.

Figure 26:
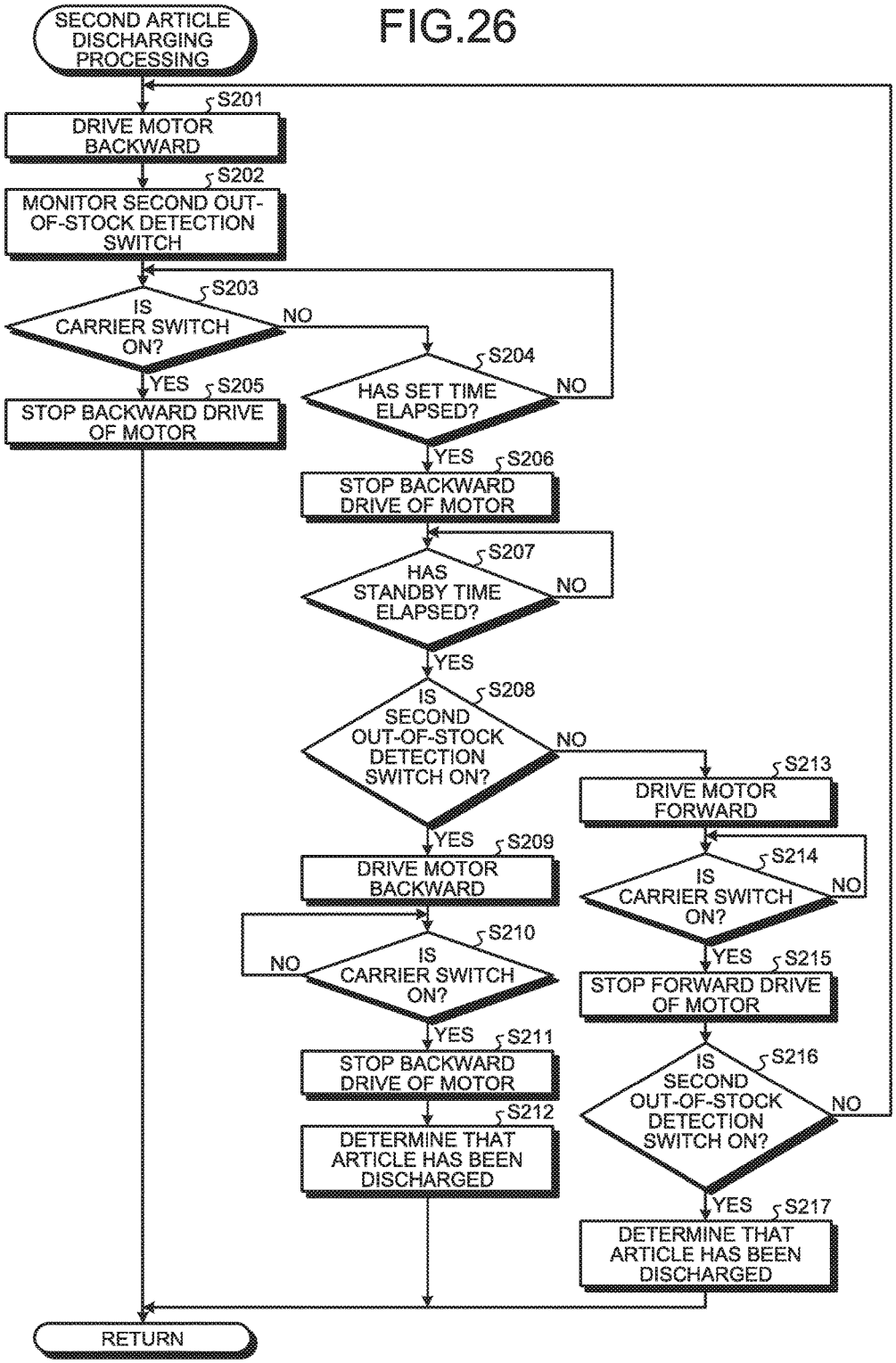
FIG. 26 is a flowchart of a detailed processing of a second article discharging processing that the dispensing controller performs when a discharging instruction for a second article is given from the vending machine controller.

FIG. 26 is a flowchart of a detailed processing of a second article discharging processing that the dispensing controller 60 performs when a discharging instruction for a second article is given from the vending machine controller 100. Although the second article discharging processing is performed simultaneously with the discharging operation for the second article performed by the article dispensing apparatus 20, the second article discharging processing is described separately from the discharging operation for the convenience of description.

In the second article discharging processing, the dispensing controller 60 drives the motor 43 backward (Step S201), and monitors a signal from the second out-of-stock detection switch 27 (Step S202).

The dispensing controller 60 is in a waiting state in which it waits for whether the on signal is given thereto from the carrier switch 45 before a preset set time (e.g., one to two seconds) set in the memory 60*a* elapses (Step S203, Step S204).

If the on signal is given from the carrier switch 45 before the set time elapses (Yes at Step S203, No at Step S204), that is, if the output gear 443 returns to the standby position, the dispensing controller 60 stops the backward drive of the motor 43 (Step S205), and returns the procedure to end the present processing.

With this processing, the second article is discharged in accordance with the discharging instruction for the second article, and thus the second article is dispensed from the article dispensing apparatus 20.

If the on signal is not given from the carrier switch 45 and the set time elapses (No at Step S203, Yes at Step S204), that is, if the set time has elapsed but the output gear 443 has not returned to the standby position, the dispensing controller 60 stops the backward drive of the motor 43 (Step S206) and is in a waiting state in which it waits until a preset standby time (e.g., 0.5 to 1.5 seconds) set in the memory 60*a* elapses (Step S207).

After the standby time has elapsed (Yes at Step S207), if the on signal was given in the set time or in the standby time from the second out-of-stock detection switch 27 monitored by the dispensing controller 60 since Step S202 (Yes at Step S208), the dispensing controller 60 drives the motor 43 backward (Step S209).

If the on signal is given from the carrier switch 45 (Yes at S210), the dispensing controller 60 that has driven the motor 43 backward stops the backward drive of the motor 43, and determines that the second article has been discharged (Step S211, Step S212), and returns the procedure to end the present processing.

If the on signal was not given from the second out-of-stock detection switch 27 in the set time or in the standby time at Step S208 (No at Step S208), the dispensing controller 60 drives the motor 43 forward (Step S213).

If the on signal is given from the carrier switch 45 (Yes at Step S214), the dispensing controller 60 that has driven the motor 43 forward stops the forward drive of the motor 43 (Step S215).

If the dispensing controller 60 stops the forward drive of the motor 43, that is, if the output gear 443 returns to the standby position, the dispensing controller 60 determines whether the on signal has been given thereto from the second out-of-stock detection switch 27 in a drive time from the beginning of the processing at Step S213 to the present time (Step S216).

If the on signal has not been given from the second out-of-stock detection switch 27 (No at Step S216), the process returns to the processing at Step S201 and the dispensing controller 60 repeats the above-described procedure.

If the on signal has been given from the second out-of-stock detection switch 27 (Yes at S216), the dispensing controller 60 determines that the second article has been discharged (Step S217), and returns the procedure to end the present processing.

The above-described article dispensing apparatus 20 in which the first out-of-stock detection switch 26 detects presence or absence of articles in the first article storage passage 13*a* by changing its states as the lower pedal 28 shifts between the article-absent standby position and the article-present standby position, and the second out-of-stock detection switch 27 detects presence or absence of second articles in the second article storage passage 13*b* by changing its states as the lower pedal 28' shifts between the article-absent standby position and the article-present standby position can recognize absence of articles in the article storage passages 13 reliably, and can match the number of sales opportunities for the articles and the number of stored articles in the article storage passages 13. Thus, the sales opportunities for the articles can be increased.

In the above-described article dispensing apparatus 20, when the output gear 443 rotated in a first direction from the standby position does not return to the standby position in a preset set time, and when the on signal is not given from the out-of-stock detection switch 26 or 27 in the set time and the following standby time, the dispensing controller 60 rotates the output gear 443 in a second direction opposite to the first direction to return the output gear 443 to the standby position. When the dispensing controller 60 rotates the output gear 443 in the second direction to return the output gear 443 to the standby position, and when the on signal is given from the out-of-stock detection switch 26 or 27 before the output gear 443 returns, the dispensing controller 60 stops the rotational drive so as not to rotate the output gear 443 again, and determines that an article has been discharged, and ends the discharging operation for the article. This configuration can prevent the output gear 443 from rotating in the first direction again, and prevent another article from being discharged. Thus, the article dispensing apparatus 20 can prevent a plurality of articles from being dispensed by the re-rotation of the output gear 443.

In the above-described article dispensing apparatus 20, when the output gear 443 rotated in the first direction from the standby position does not return to the standby position in the preset set time, and when the on signal is given from the out-of-stock detection switch 26 or 27 in the set time and the following standby time, the dispensing controller 60 rotates the output gear 443 in the first direction to return the output gear 443 to the standby position. This configuration can prevent discharging error that is caused such that, after the discharge of a first or a second article, the output gear 443 is rotated in the second direction, and another second or first article is discharged.

In the above-described article dispensing apparatus 20, when a discharging instruction for a first or a second article is given from the vending machine controller 100 and the first article discharging apparatus 20*a* or the second article discharging apparatus 20*b* is driven, the dispensing controller 60 determines that the first or the second article has been discharged from the article storage passage 13 by reception of the on signal given from the first out-of-stock detection switch 26 or the second out-of-stock detection switch 27 when turned to the on state. With this configuration, the article dispensing apparatus 20 can detect discharge of the first or the second article reliably without using, for example, a detection unit that detects discharge of the article.

As described above, the article dispensing apparatus 20 can detect discharge of the first or the second article reliably. This configuration can eliminate the need for adjusting differences in the number of stored articles in the article storage passage 13 in the inventory control or in the number of articles sold from the article storage passage 13 in the sales management. This configuration can also prevent, for example, troubles relating to discharge of articles with the buyers of articles.

The above-described article dispensing apparatus 20 in which the first article discharging apparatus 20*a* includes the motor 43 as the driving source for the first article discharging apparatus 20*a* and the second article discharging apparatus 20*b* and the driving unit 40 that alternatively selects the first article discharging apparatus 20*a* or the second article discharging apparatus 20*b* when a discharging instruction has been given in accordance with the discharging instruction to give the driving force from the motor 43 to the selected article discharging apparatus can reduce the number of driving sources relative to the number of discharging mechanisms and can reduce manufacturing costs. Besides, the first article discharging apparatus 20*a* includes the driving unit 40 including the motor 43, and the first article discharging apparatus 20*a* alone can also be used. In other words, the first article discharging apparatus 20*a* can be used not only for the article storage rack 10 including an even number of article storage passages 13 arranged fore and aft as described above but also for the article storage rack 10 including an odd number of article storage passages 13 arranged fore and aft. Consequently, the article dispensing apparatus 20 can reduce manufacturing costs and can flexibly correspond in accordance with the number of the article storage passages 13 adjacent to each other fore and aft.

The article dispensing apparatus 20 in which the motor 43 as the driving source is a DC motor is less susceptible to regional voltage and/or frequency fluctuations and can be installed at various locations.

The article dispensing apparatus 20 in which the first out-of-stock detection switch 26 and the second out-of-stock detection switch 27 are installed in the first article discharging apparatus 20*a* can use the first article discharging apparatus 20*a* alone, can also thereby flexibly correspond in accordance with the number of the article storage passages 13 adjacent to each other fore and aft, and can put the harnesses together in the first article discharging apparatus

20*a*, because the electric parts are arranged only in the first article discharging apparatus 20*a*.

Second Embodiment

Figure 27:
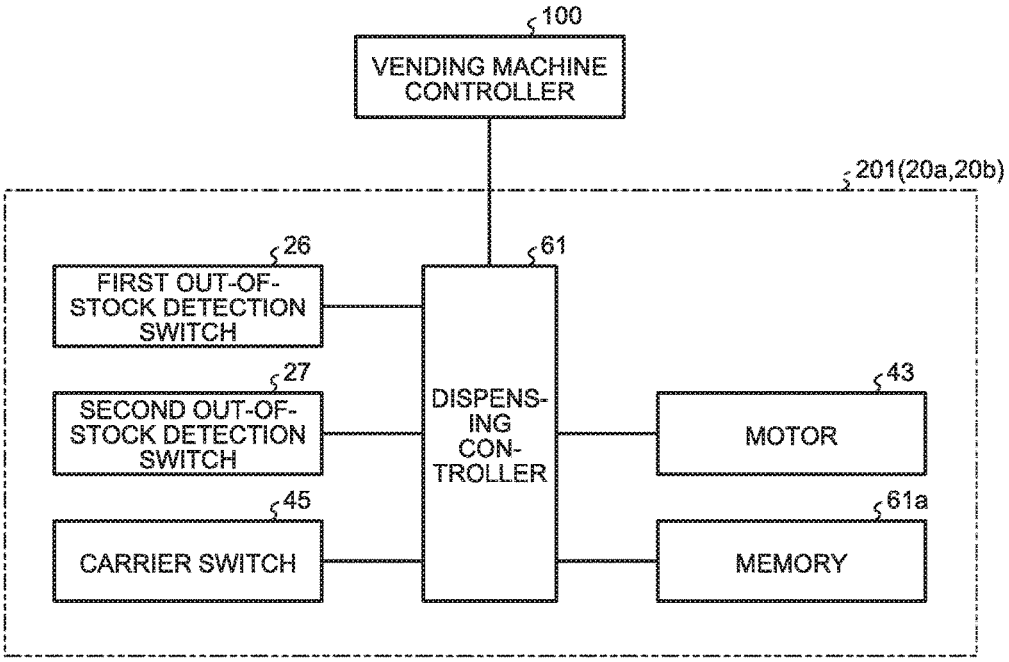
FIG. 27 is a block diagram of a characteristic control system of an article dispensing apparatus as a second embodiment of the present disclosure.

FIG. 27 is a block diagram of a characteristic control system of an article dispensing apparatus as a second embodiment of the present disclosure. The same reference signs refer to the elements similar to those of the article dispensing apparatus 20 as the first embodiment described above are used and the description thereof will be omitted. As illustrated in FIG. 27, this article dispensing apparatus 201 includes a dispensing controller 61. The dispensing controller 61 comprehensively controls the operation of the article dispensing apparatus 201 in accordance with computer programs and data stored in a memory 61*a* and is communicable with the vending machine controller 100 that controls the selling operation of the vending machine.

Figure 28:
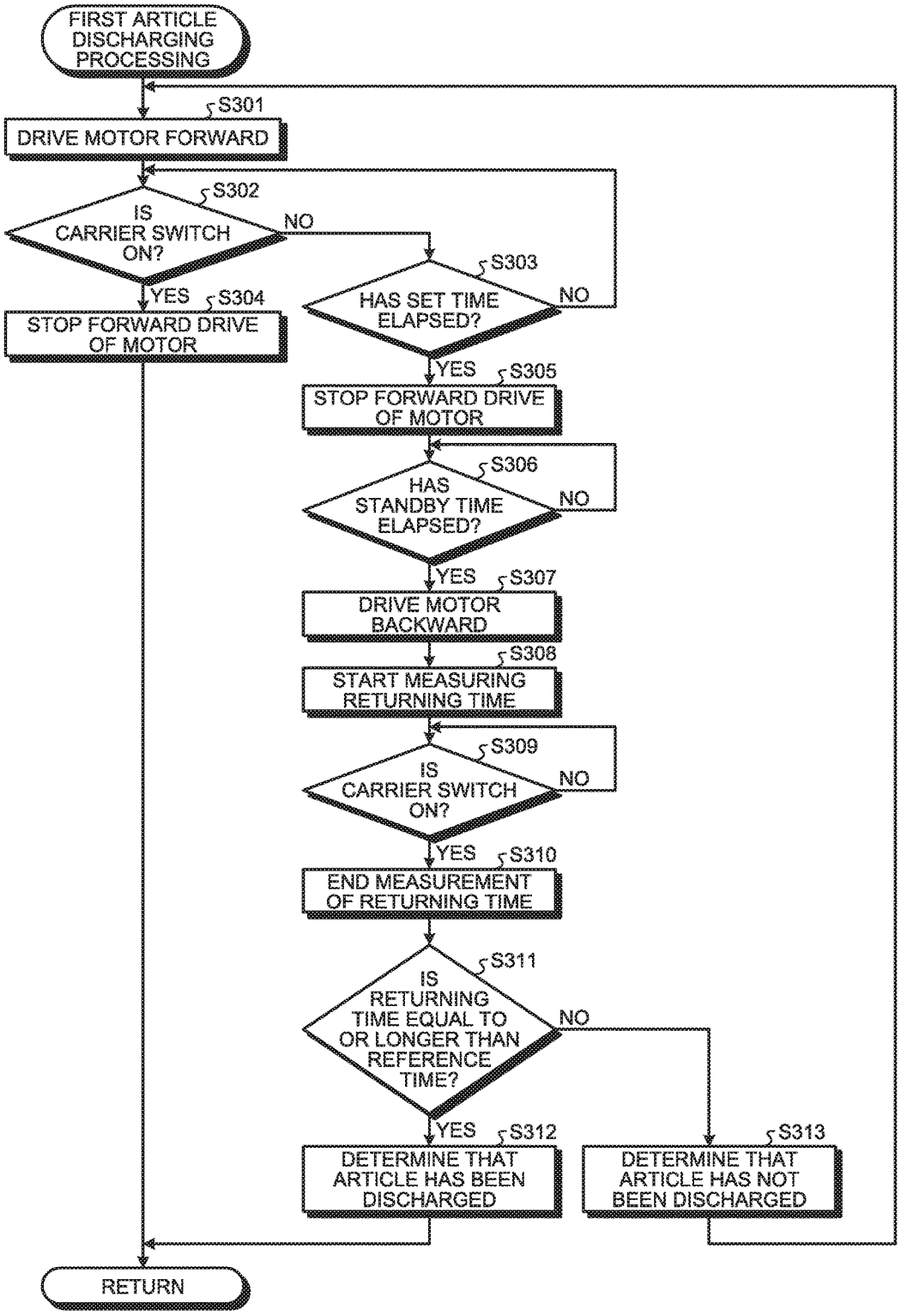
FIG. 28 is a flowchart of a detailed processing of a first article discharging processing that a dispensing controller illustrated in FIG. 27 performs when a discharging instruction for a first article is given from the vending machine controller.

FIG. 28 is a flowchart of a detailed processing of a first article discharging processing that the dispensing controller 61 performs when a discharging instruction for a first article is given from the vending machine controller 100. Although the first article discharging processing is performed simultaneously with the discharging operation for the first article described in the first embodiment, the first article discharging processing is described separately from the discharging operation for the convenience of description.

In the first article discharging processing, the dispensing controller 61 drives the motor 43 forward (Step S301), and is in a waiting state in which it waits for whether the on signal is given thereto from the carrier switch 45 before a set time (e.g., one to two seconds) stored in the memory 61*a* elapses (Step S302, Step S303).

If the on signal is given from the carrier switch 45 before the set time elapses (Yes at Step S302, No at Step S303), that is, if the output gear 443 returns to the standby position, the dispensing controller 61 stops the forward drive of the motor 43 (Step S304), and returns the procedure to end the present processing.

With this processing, the first article is discharged in accordance with the discharging instruction for the first article, and thus the first article is dispensed from the article dispensing apparatus 201.

If the on signal is not given from the carrier switch 45 and the set time elapses (No at Step S302, Yes at Step S303), that is, if the set time has elapsed but the output gear 443 has not returned to the standby position, the dispensing controller 61 stops the forward drive of the motor 43 (Step S305) and is in a waiting state in which it waits until a standby time (e.g., 0.5 to 1.5 seconds) stored in the memory 61*a* elapses (Step S306).

After the standby time has elapsed (Yes at S306), the dispensing controller 61 drives the motor 43 backward and starts measuring a returning time with a built-in time measuring unit (not illustrated) (Step S307, Step S308), and is in a waiting state in which the dispensing controller 61 waits for the on signal to be given from the carrier switch 45 (Step S309).

If the on signal is given from the carrier switch 45 (Yes at Step S309), the dispensing controller 61 ends the measurement of the returning time started at Step S308 (Step S310).

The dispensing controller 61 that has ended the measurement of the returning time determines whether the returning time is equal to or greater than a reference time stored in the memory 61*a* (Step S311). The reference time is a time sufficient for the first link lever 461 to rotate counterclockwise when viewed from the front with the cam part 443*a* coming into contact with the basal end 461*a* of the first link lever 461 when the output gear 443 rotates from the standby position.

If the returning time is equal to or greater than the reference time (Yes at Step S311), the dispensing controller 61 determines that the first article has been discharged (Step S312), and returns the procedure to end the present processing.

If the returning time is less than the reference time (No at S311), the dispensing controller 61 determines that the first article has not been discharged (Step S313), and the process returns to Step S301, at which the dispensing controller 61 rotates the output gear 443 clockwise again when viewed from the front and repeats the above-described procedure.

Figure 29:
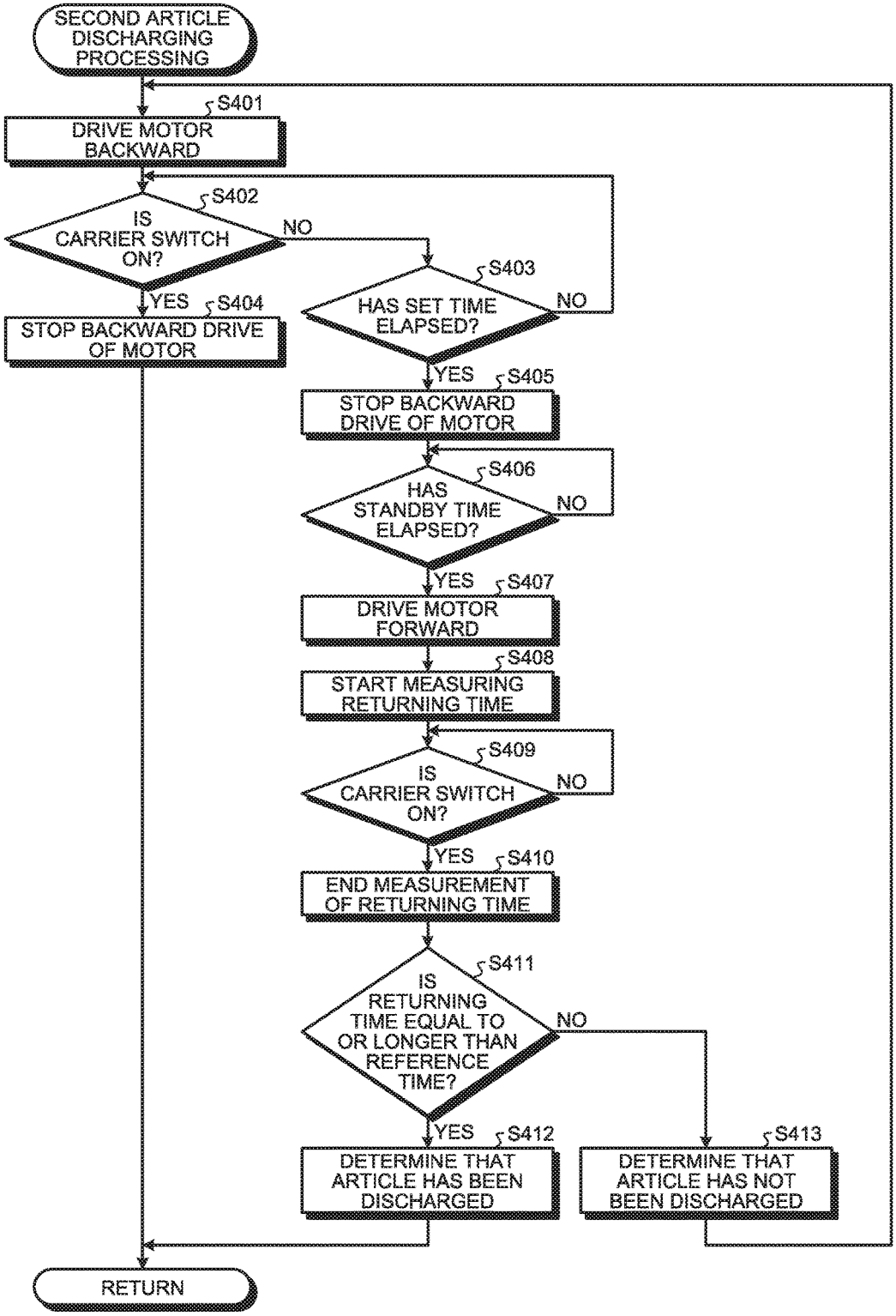
FIG. 29 is a flowchart of a detailed processing of a second article discharging processing that the dispensing controller illustrated in FIG. 27 performs when a discharging instruction for a second article is given from the vending machine controller.

FIG. 29 is a flowchart of a detailed processing of a second article discharging processing that the dispensing controller 61 performs when a discharging instruction for a second article is given from the vending machine controller 100. Although the second article discharging processing is performed simultaneously with the discharging operation for the second article described in the first embodiment, the second article discharging processing is described separately from the discharging operation for the convenience of description.

In the second article discharging processing, the dispensing controller 61 drives the motor 43 backward (Step S401), and is in a waiting state in which it waits for whether the on signal is given thereto from the carrier switch 45 before a set time (e.g., one to two seconds) stored in the memory 61*a* elapses (Step S402, Step S403).

If the on signal is given from the carrier switch 45 before the set time elapses (Yes at Step S402, No at Step S403), that is, if the output gear 443 returns to the standby position, the dispensing controller 61 stops the backward drive of the motor 43 (Step S404), and returns the procedure to end the present processing.

With this processing, the second article is discharged in accordance with the discharging instruction for the second article, and thus the second article is dispensed from the article dispensing apparatus 201.

If the on signal is not given from the carrier switch 45 and the set time elapses (No at Step S402, Yes at Step S403), that is, if the set time has elapsed but the output gear 443 has not returned to the standby position, the dispensing controller 61 stops the backward drive of the motor 43 (Step S405) and is in a waiting state in which it waits until a standby time (e.g., 0.5 to 1.5 seconds) stored in the memory 61*a* elapses (Step S406).

After the standby time has elapsed (Yes at S406), the dispensing controller 61 drives the motor 43 forward and starts measuring a returning time with the built-in time measuring unit (not illustrated) (Step S407, Step S408), and is in a waiting state in which the dispensing controller 61 waits for the on signal to be given from the carrier switch 45 (Step S409).

If the on signal is given from the carrier switch 45 (Yes at Step S409), the dispensing controller 61 ends the measurement of the returning time started at Step S408 (Step S410).

The dispensing controller 61 that has ended the measurement of the returning time determines whether the returning time is equal to or greater than a reference time stored in the memory 61*a* (Step S411). The reference time is a time sufficient for the second link lever 462 to rotate clockwise when viewed from the front with the cam part 443*a* coming into contact with the basal end 462*a* of the second link lever 462 when the output gear 443 rotates from the standby position.

If the returning time is equal to or greater than the reference time (Yes at S411), the dispensing controller 61 determines that the second article has been discharged (Step S412), and returns the procedure to end the present processing.

If the returning time is less than the reference time (No at S411), the dispensing controller 61 determines that the second article has not been discharged (Step S413), and the process returns to Step S401, at which the dispensing controller 61 rotates the output gear 443 counterclockwise again when viewed from the front and repeats the above-described procedure.

In the above-described article dispensing apparatus 201, when the output gear 443 rotated from the standby position in a first direction does not return to the standby position in a preset set time, the dispensing controller 61 rotates the output gear 443 in a second direction opposite to the first direction to return the output gear 443 to the standby position. When a returning time for the output gear 443 to return to the standby position is equal to or greater than a preset reference time, the dispensing controller 61 determines that the article has been discharged, and stops the rotation of the output gear 443 so as not to rotate it again, and ends the discharging operation for the article. This configuration can prevent the output gear 443 from rotating again in the first direction and thus prevent another article from being discharged. Thus, the article dispensing apparatus 201 can prevent a plurality of articles from being discharged by a single article discharging instruction.

The above-described article dispensing apparatus 201 in which the first out-of-stock detection switch 26 detects presence or absence of articles in the first article storage passage 13*a* by changing its states as the lower pedal 28 shifts between the article-absent standby position and the article-present standby position, and the second out-of-stock detection switch 27 detects presence or absence of second articles in the second article storage passage 13*b* by changing its states as the lower pedal 28' shifts between the article-absent standby position and the article-present standby position can recognize absence of articles in the article storage passages 13 reliably, and can match the number of sales opportunities for the articles and the number of stored articles in the article storage passages 13. Thus, the sales opportunities for the articles can be increased.

In the above-described article dispensing apparatus 201, when a discharging instruction for a first or a second article is given and the first article discharging apparatus 20*a* or the second article discharging apparatus 20*b* is driven, the dispensing controller 61 determines that the first or the second article has been discharged from the article storage passage 13 by reception of the on signal given from the first out-of-stock detection switch 26 or the second out-of-stock detection switch 27 when turned to the on state. With this configuration, the article dispensing apparatus 201 can detect discharge of the first or the second article reliably without using, for example, a detection unit that detects discharge of the article.

As described above, the article dispensing apparatus 201 can detect discharge of the first or the second article reliably. This configuration can eliminate the need for adjusting differences in the number of stored articles in the article storage passage 13 in the inventory control or in the number of articles sold from the article storage passage 13 in the sales management. This configuration can also prevent, for example, troubles relating to discharge of articles with the buyers of articles.

The above-described article dispensing apparatus 201 in which the first article discharging apparatus 20*a* includes the motor 43 as the driving source for the first article discharging apparatus 20*a* and the second article discharging apparatus 20*b* and the driving unit 40 that alternatively selects the first article discharging apparatus 20*a* or the second article discharging apparatus 20*b* when a discharging instruction has been given in accordance with the discharging instruction to give the driving force from the motor 43 to the selected article discharging apparatus can reduce the number of driving sources relative to the number of discharging mechanisms and can reduce manufacturing costs. Besides, the first article discharging apparatus 20*a* includes the driving unit 40 including the motor 43, and the first article discharging apparatus 20*a* alone can also be used. In other words, the first article discharging apparatus 20*a* can be used not only for the article storage rack 10 including an even number of article storage passages 13 arranged fore and aft as described above but also for the article storage rack 10 including an odd number of article storage passages 13 arranged fore and aft. Consequently, the article dispensing apparatus 201 can reduce manufacturing costs and can flexibly correspond in accordance with the number of the article storage passages 13 adjacent to each other fore and aft.

The article dispensing apparatus 201 in which the motor 43 as the driving source is a DC motor is less susceptible to regional voltage and/or frequency fluctuations and can be installed at various locations.

The article dispensing apparatus 201 in which the first out-of-stock detection switch 26 and the second out-of-stock detection switch 27 are installed in the first article discharging apparatus 20*a* can use the first article discharging apparatus 20*a* alone, can also thereby flexibly correspond in accordance with the number of the article storage passages 13 adjacent to each other fore and aft, and can put the harnesses together in the first article discharging apparatus 20*a*, because the electric parts are arranged only in the first article discharging apparatus 20*a*.

Third Embodiment

Figure 30:
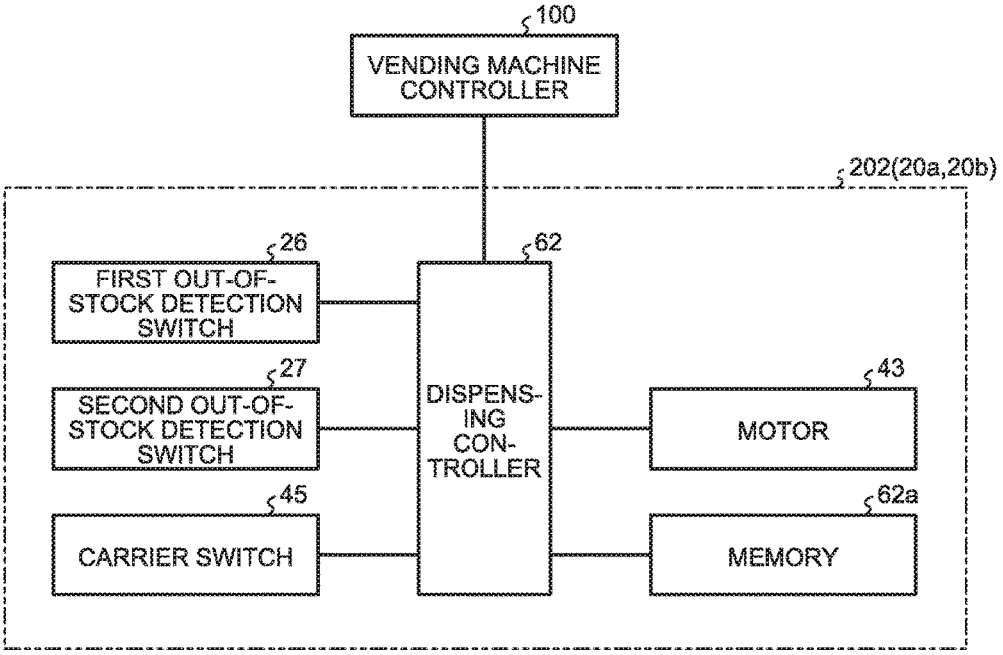
FIG. 30 is a block diagram of a characteristic control system of an article dispensing apparatus as a third embodiment of the present disclosure.

FIG. 30 is a block diagram of a characteristic control system of an article dispensing apparatus as a third embodiment of the present disclosure. The same reference signs refer to the elements similar to those of the article dispensing apparatus 20 as the first embodiment described above are used, and the description thereof will be omitted. As illustrated in FIG. 30, this article dispensing apparatus 202 includes a dispensing controller 62. The dispensing controller 62 comprehensively controls the operation of the article dispensing apparatus 202 in accordance with computer programs and data stored in a memory 62*a* and is communicable with the vending machine controller 100 that controls the selling operation of the vending machine.

Figure 31:
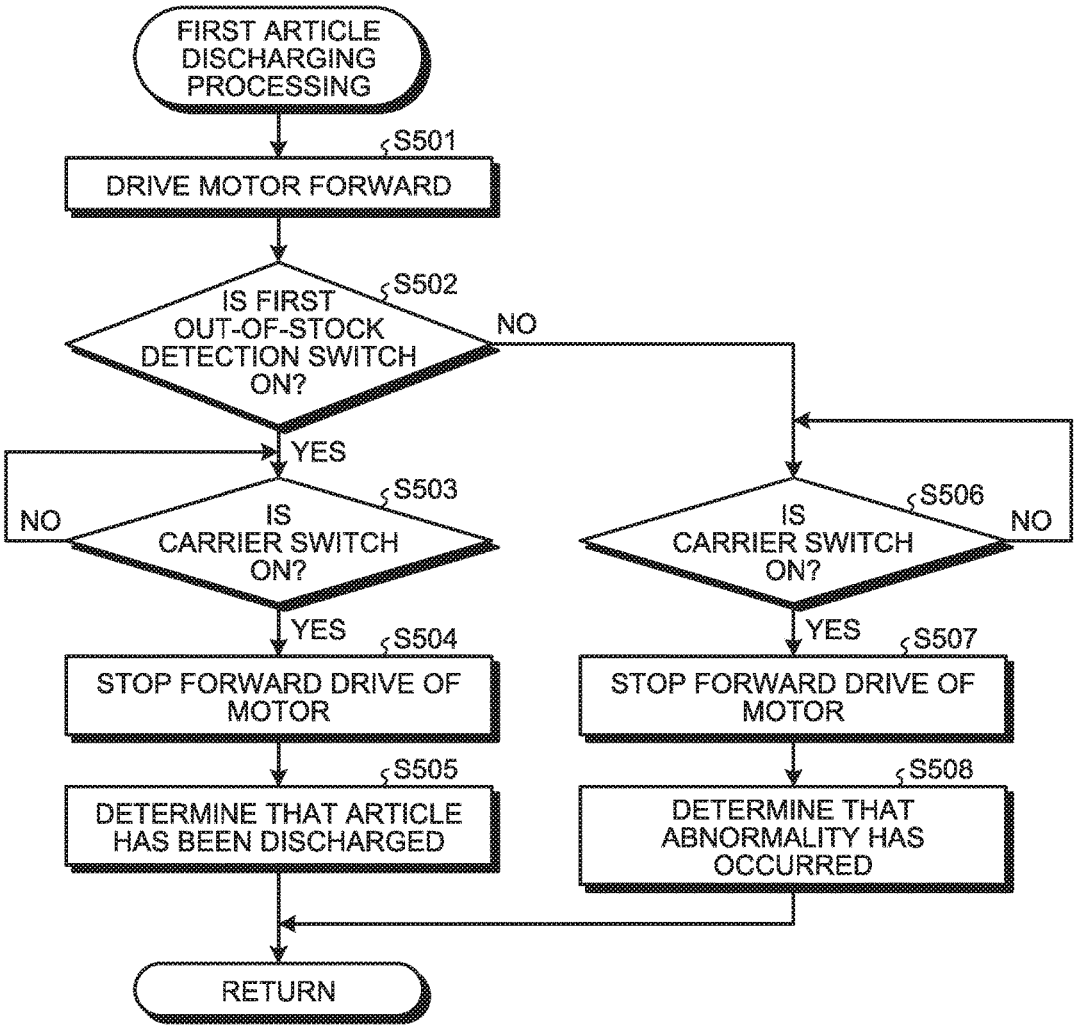
FIG. 31 is a flowchart of a detailed processing of a first article discharging processing that a dispensing controller illustrated in FIG. 30 performs when a discharging instruction for a first article is given from the vending machine controller.

FIG. 31 is a flowchart of a detailed processing of a first article discharging processing that the dispensing controller 62 performs when a discharging instruction for a first article is given from the vending machine controller 100. Although the first article discharging processing is performed simultaneously with the discharging operation for the first article described in the first embodiment, the first article discharging processing is described separately from the discharging operation for the convenience of description.

In the first article discharging processing, the dispensing controller 62 drives the motor 43 forward (Step S501). After that, if the on signal is given from the first out-of-stock detection switch 26 and then an on signal is given from the carrier switch 45 (Yes at S502, Yes at S503), that is, if the first out-of-stock detection switch 26 is turned to the on state (first state) (if the lower pedal 28 is in the article-absent standby position) before the output gear 443 returns to the standby position, the dispensing controller 62 stops the forward drive of the motor 43 (Step S504). The dispensing controller 62 then determines that the first article has been discharged (Step S505), and returns the procedure to end the present processing.

With this processing, the first article is discharged in accordance with the discharging instruction for the first article, and thus the first article is dispensed from the article dispensing apparatus 202.

If the on signal is not given from the first out-of-stock detection switch 26 and the on signal is given from the carrier switch 45 (No at S502, Yes at S506), that is, if the output gear 443 returns to the standby position but the first out-of-stock detection switch 26 is not turned to the on state (first state) (if the lower pedal 28 is not in the article-absent standby position), the dispensing controller 62 stops the forward drive of the motor 43 (Step S507). The dispensing controller 62 then determines that an abnormality has occurred in the discharge of the first article (Step S508), and returns the procedure to end the present processing.

With this processing, the dispensing controller 62 can transmit information that an abnormality has occurred in the discharge of the first article to the vending machine controller 100, and the vending machine controller 100 can return the money put by the user, or can allow the user to select an article again and the user can select the article again.

Figure 32:
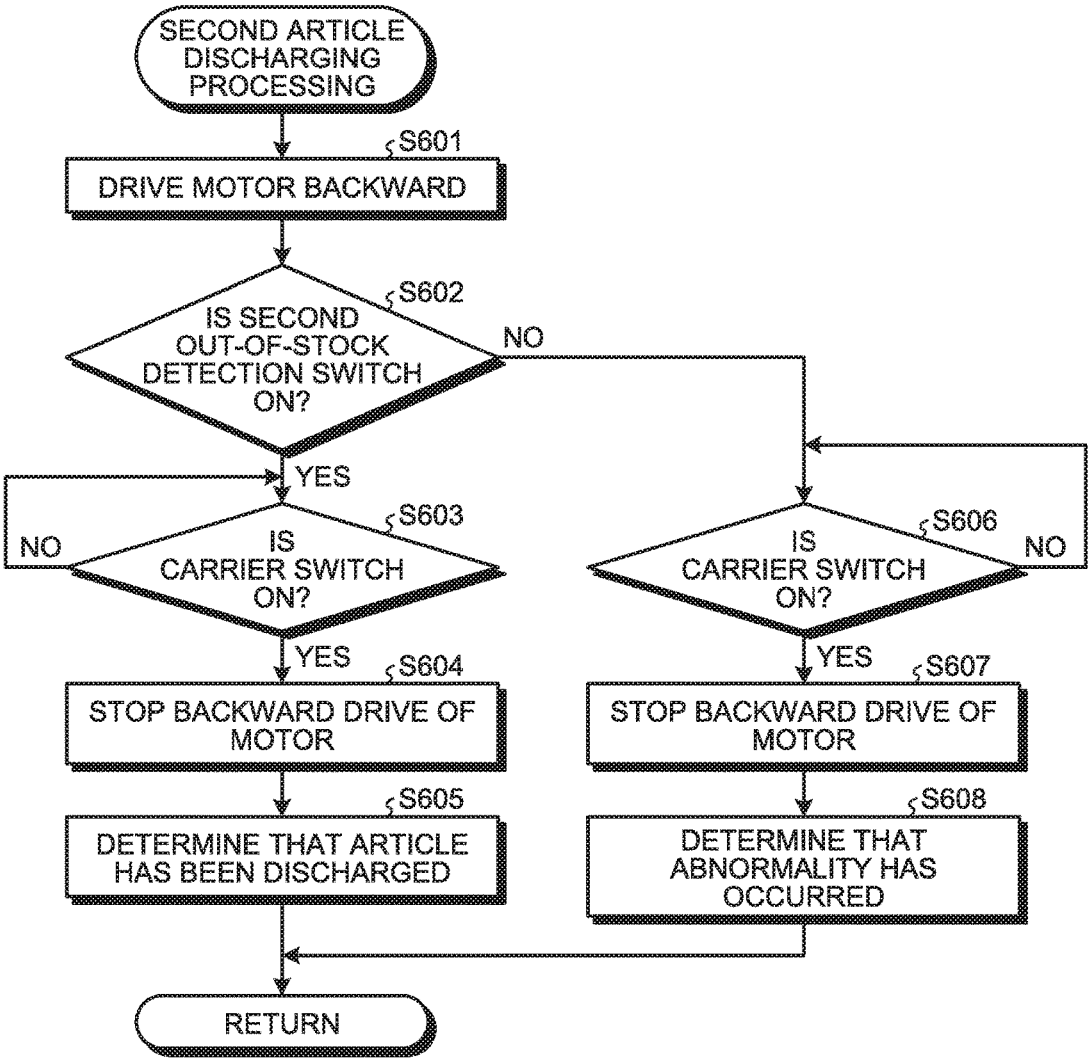
FIG. 32 is a flowchart of a detailed processing of a second article discharging processing that the dispensing controller illustrated in FIG. 30 performs when a discharging instruction for a second article is given from the vending machine controller.

FIG. 32 is a flowchart of a detailed processing of a second article discharging processing that the dispensing controller 62 performs when a discharging instruction for a second article is given from the vending machine controller 100. Although the second article discharging processing is performed simultaneously with the discharging operation for the second article described in the first embodiment, the second article discharging processing is described separately from the discharging operation for the convenience of description.

In the second article discharging processing, the dispensing controller 62 drives the motor 43 backward (Step S601). After that, if the on signal is given from the second out-of-stock detection switch 27 and then an on signal is given from the carrier switch 45 (Yes at S602, Yes at S603), that is, if the second out-of-stock detection switch 27 is turned to the on state (first state) (if the lower pedal 28' is in the article-absent standby position) before the output gear 443 returns to the standby position, the dispensing controller 62 stops the backward drive of the motor 43 (Step S604). The dispensing controller 62 then determines that the second article has been discharged (Step S605), and returns the procedure to end the present processing.

With this processing, the second article is discharged in accordance with the discharging instruction for the second article, and thus the second article is dispensed from the article dispensing apparatus 202.

If the on signal is not given from the second out-of-stock detection switch 27 and an on signal is given from the carrier switch 45 (No at S602, Yes at S606), that is, if the output gear 443 returns to the standby position but the second out-of-stock detection switch 27 is not turned to the on state (first state) (if the lower pedal 28' is not in the article-absent standby position), the dispensing controller 62 stops the backward drive of the motor 43 (Step S607). The dispensing controller 62 then determines that an abnormality has occurred in the discharge of the second article (Step S608), and returns the procedure to end the present processing.

With this processing, the dispensing controller 62 can transmit information that an abnormality has occurred in the discharge of the second article to the vending machine controller 100, and the vending machine controller 100 can return the money put by the user, or can allow the user to select an article again and the user can select the article again.

The above-described article dispensing apparatus 202 in which the first out-of-stock detection switch 26 detects presence or absence of articles in the first article storage passage 13*a* by changing its states as the lower pedal 28 shifts between the article-absent standby position and the article-present standby position, and the second out-of-stock detection switch 27 detects presence or absence of second articles in the second article storage passage 13*b* by changing its states as the lower pedal 28' shifts between the article-absent standby position and the article-present standby position can recognize absence of articles in the article storage passages 13 reliably, and can match the number of sales opportunities for the articles and the number of stored articles in the article storage passages 13. Thus, the sales opportunities for the articles can be increased.

In the above-described article dispensing apparatus 202, when the output gear 443 returns to the standby position but the out-of-stock detection switch 26 or 27 is not turned to the on state (the first state) (if the lower pedal 28 or 28' is not in the article-absent standby position), the dispensing controller 62 determines that an abnormality has occurred. This configuration can avoid, for example, reception of money while no article is ever discharged, and can prevent unexpected disadvantage for users.

In the above-described article dispensing apparatus 202, when a discharging instruction for a first or a second article is given from the vending machine controller 100 and the first article discharging apparatus 20*a* or the second article discharging apparatus 20*b* is driven, the dispensing controller 62 determines that the first or the second article has been discharged from the article storage passage 13 by reception of the on signal given from the first out-of-stock detection switch 26 or the second out-of-stock detection switch 27 when turned to the on state. With this configuration, the article dispensing apparatus 202 can detect discharge of the first or the second article reliably without using, for example, a detection unit that detects discharge of an article.

As described above, the article dispensing apparatus 202 can detect discharge of the first or the second article reliably. This configuration can eliminate the need for adjusting differences in the number of stored articles in the article storage passage 13 in the inventory control or in the number of articles sold from the article storage passage 13 in the sales management. This configuration can also prevent, for example, troubles relating to discharge of articles with the buyers of articles.

The above-described article dispensing apparatus 202 in which the first article discharging apparatus 20*a* includes the motor 43 as the driving source for the first article discharging apparatus 20*a* and the second article discharging apparatus 20*b* and the driving unit 40 that alternatively selects the first article discharging apparatus 20*a* or the second article discharging apparatus 20*b* when a discharging instruction has been given in accordance with the discharging instruction to give the driving force from the motor 43 to the selected article discharging apparatus can reduce the number of driving sources relative to the number of discharging mechanisms and can reduce manufacturing costs. Besides, the first article discharging apparatus 20*a* includes the driving unit 40 including the motor 43, and the first article discharging apparatus 20*a* alone can also be used. In other words, the first article discharging apparatus 20*a* can be used not only for the article storage rack 10 including an even number of article storage passages 13 arranged fore and aft as described above but also for the article storage rack 10 including an odd number of article storage passages 13 arranged fore and aft. Consequently, the article dispensing apparatus 202 can reduce manufacturing costs and can flexibly correspond in accordance with the number of the article storage passages 13 adjacent to each other fore and aft.

The article dispensing apparatus 202 in which the motor 43 as the driving source is a DC motor is less susceptible to regional voltage and/or frequency fluctuations and can be installed at various locations.

The article dispensing apparatus 202 in which the first out-of-stock detection switch 26 and the second out-of-stock detection switch 27 are installed in the first article discharging apparatus 20*a* can use the first article discharging apparatus 20*a* alone, can also thereby flexibly correspond in accordance with the number of the article storage passages 13 adjacent to each other fore and aft, and can put the harnesses together in the first article discharging apparatus 20*a*, because the electric parts are arranged only in the first article discharging apparatus 20*a*.

Fourth Embodiment

Figure 33:
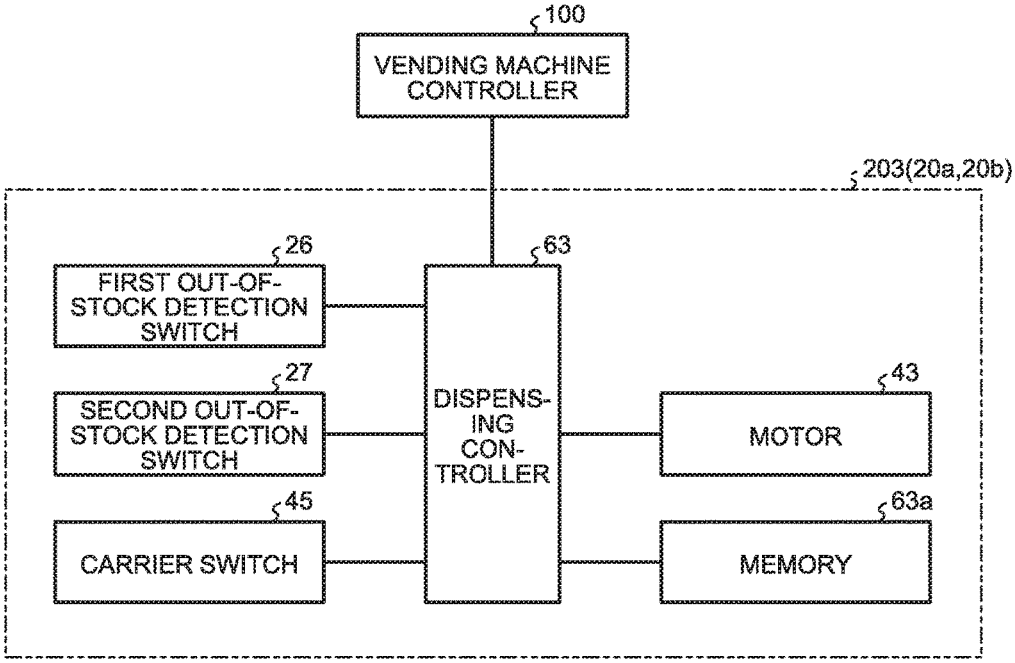
FIG. 33 is a block diagram of a characteristic control system of an article dispensing apparatus as a fourth embodiment of the present disclosure.

FIG. 33 is a block diagram of a characteristic control system of an article dispensing apparatus as a fourth embodiment of the present disclosure. The same reference signs refer to the elements similar to those of the article dispensing apparatus 20 as the first embodiment described above are used, and the description thereof will be omitted. As illustrated in FIG. 33, this article dispensing apparatus 203 includes a dispensing controller 63. The dispensing controller 63 comprehensively controls the operation of the article dispensing apparatus 203 in accordance with computer programs and data stored in a memory 63*a* and is communicable with the vending machine controller 100 that controls the selling operation of the vending machine.

Figure 34:
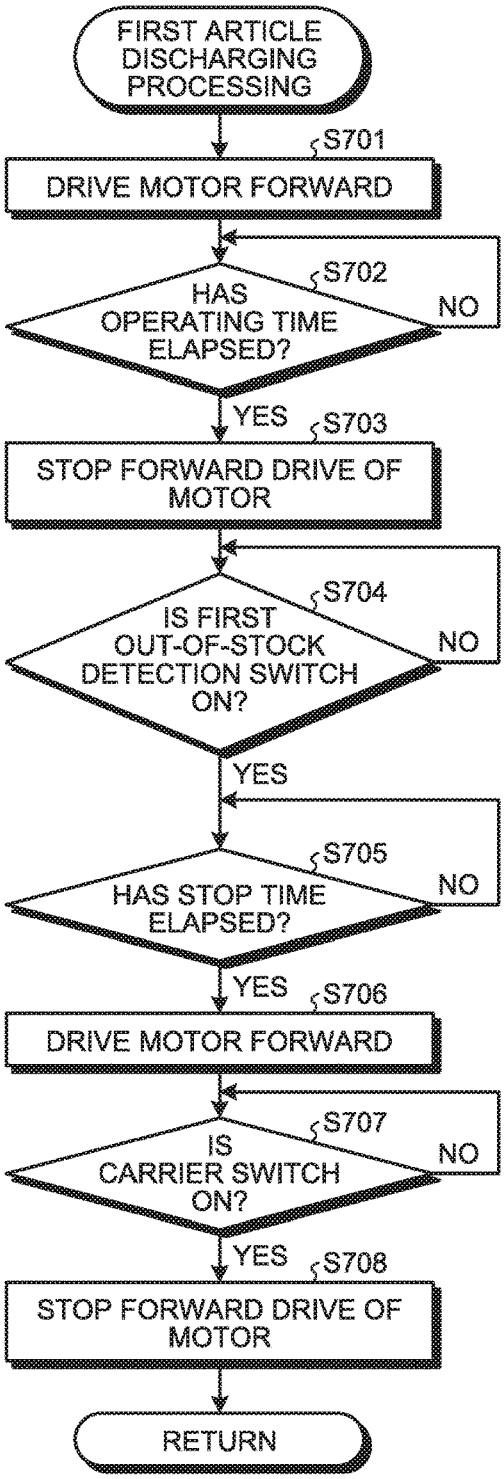
FIG. 34 is a flowchart of a detailed processing of a first article discharging processing that a dispensing controller illustrated in FIG. 33 performs when a discharging instruction for a first article is given from the vending machine controller.

FIG. 34 is a flowchart of a detailed processing of a first article discharging processing that the dispensing controller 63 performs when a discharging instruction for a first article is given from the vending machine controller 100. Although the first article discharging processing is performed simultaneously with the discharging operation for the first article described in the first embodiment, the first article discharging processing is described separately from the discharging operation for the convenience of description.

In the first article discharging processing, the dispensing controller 63 drives the motor 43 forward (Step S701), and waits until a preset operating time stored in the memory 63*a* elapses (Step S702). The operating time stored in the memory 63*a* is a time for advancing the upper pedal 29 to the first article storage passage 13*a* by rotating the output gear 443 from the standby position and moving the pedal link 35 upward via the first link lever 461.

If the operating time has elapsed (Yes at Step S702), the dispensing controller 63 stops the forward drive of the motor 43 (Step S703). With this processing, the upper pedal 29 is kept advanced to the first article storage passage 13*a*.

Keeping the upper pedal 29 advanced to the first article storage passage 13*a* allows the lower pedal 28 to retract from the first article storage passage 13*a*, thereby providing sufficient time for the lowermost article to be discharged.

If the on signal is given from the first out-of-stock detection switch 26 and if a preset stop time stored in the memory 63*a* has elapsed since the implementation of Step S703 (Yes at Step S704, Yes at Step S705), the dispensing controller 63 drives the motor 43 forward (Step S706). The stop time stored in the memory 63*a* is a time for discharging the lowermost article with the lower pedal 28 being retractable from the first article storage passage 13*a*.

If the on signal is given from the carrier switch 45 (Yes at Step S707), that is, if the output gear 443 returns to the standby position, the dispensing controller 63 stops the forward drive of the motor 43 (Step S708), and returns the procedure to end the present processing.

With this processing, the first article is discharged in accordance with the discharging instruction for the first article, and thus the first article is dispensed from the article dispensing apparatus 203.

Described here is an example of discharging the first article when the discharging instruction for the first article is given. When the discharging instruction for the second article is given, the second article is discharged in the same manner as the discharging of the first article described herein.

In the above-described article dispensing apparatus 203, when the output gear 443 is rotated from the standby position to drive the article discharging apparatus 20*a* or 20*b*, the dispensing controller 63 stops the rotation of the output gear 443 for a certain time with the upper pedal 29 or 29' kept advanced to the article storage passage 13. This configuration allows the article dispensing apparatus 203 to discharge the lowermost article if it has a light weight or a parallelepiped shape. In other words, the article dispensing apparatus 203 can successfully discharge an article that requires a greater discharging time due to its weight, shape, or the like.

According to the present disclosure, when, in the standby state, no article is placed on the top face of the lower pedal, the lower pedal is in the second standby position in which the tip of the lower pedal is positioned at a position upper than in the first standby position. When the lower pedal is in the second standby position, the out-of-stock detection switch is turned to the first state, whereas when the lower pedal is in a position other than the second standby position, the out-of-stock detection switch is turned to the second state. With this configuration, the out-of-stock detection switch detects presence or absence of the articles in the article storage passage, and thus, the article dispensing apparatus can recognize the absence of articles in the article storage passage reliably, and can match the number of sales opportunities for the articles and the number of articles stored in the article storage passage. Thus, the present disclosure produces an effect of increasing sales opportunities for articles.

According to the present disclosure, when the output member rotated from the standby position in the first direction does not return to the standby position in the preset set time and when the out-of-stock detection switch is turned to the first state in the set time, the controller rotates the output member in the first direction to return the output member to the standby position. With this configuration, the present disclosure produces an effect of preventing discharging error in an article dispensing apparatus configured by two article discharging apparatuses combined in a back-to-back manner. The discharging error is such that, when one article discharging apparatus discharges a target article and then the output member is rotated in the second direction opposite to the first direction, the other article discharging apparatus is caused to discharge another article.

According to the present disclosure, when the output member rotated from the standby position in the first direction does not return to the standby position in the preset set time, the controller rotates the output member in the second direction to return the output member to the standby position. When the output member returns to the standby position and when the out-of-stock detection switch is turned to the first state in the drive time that lasts until the output member returns to the standby position, the controller stops the rotation of the output member. This configuration can prevent the output member from rotating again in the first direction and thus prevent another article from being discharged. Thus, the present disclosure produces an effect of preventing a plurality of articles from being discharged by the re-rotation of the output member.

According to the present disclosure, when the output member rotated from the standby position in the first direction does not return to the standby position in the preset set time, the controller rotates the output member in the second direction to return the output member to the standby position. When the returning time for the output member to return to the standby position is equal to or greater than the preset reference time, the controller determines that an article has been discharged, and stops the rotation of the output member so as not to rotate it again. This configuration can prevent the output member from rotating again in the first direction and thus prevent another article from being discharged. Thus, the present disclosure produces an effect of preventing a plurality of articles from being discharged by a single article discharging instruction.

According to the present disclosure, when the output member rotated from the standby position in the first direction returns to the standby position and when the out-of-stock detection switch is not turned to the first state, the controller determines that an abnormality has occurred. This configuration can avoid, for example, reception of money while no article is ever discharged. Thus, the present disclosure produces an effect of preventing unexpected disadvantage for users.

According to the present disclosure, when the output member is rotated from the standby position to drive the article discharging apparatus, the controller stops the rotation of the output member for a certain time with the upper pedal kept advanced to the article storage passage. This configuration allows the article discharging apparatus to discharge the lowermost article if it has a light weight or a parallelepiped shape. In other words, the present disclosure produces an effect of successfully discharging an article that requires a greater discharging time due to its weight, shape, or the like.

Although preferred embodiments of the present disclosure have been described, the present disclosure is not limited to these embodiments, and various alterations may be made.

In the first article discharging processing and the second article discharging processing according to the first embodiment described above, the dispensing controller 60 stops the drive of the motor 43 after the set time elapses at Step S104 and Step S204 and then waits until the standby time elapses, the standby time is not necessarily needed in the present disclosure.

In the first article discharging processing and the second article discharging processing according to the second embodiment described above, the dispensing controller 61 stops the drive of the motor 43 after the set time elapses at Step S303 and Step S403 and then waits until the standby time elapses, the standby time is not necessarily needed in the present disclosure.

The invention claimed is:

1. An article dispensing apparatus comprising:

an article discharging apparatus including a base, an article storage passage that stores therein charged articles in an up-and-down direction, a lower pedal swingably arranged on the base in such a manner that a tip of the lower pedal advances and retracts to and from the article storage passage, and an upper pedal swingably arranged on the base in such a manner that a tip of the upper pedal advances and retracts to and from the article storage passage in an area above the lower pedal, the article discharging apparatus, in a standby state, preventing a lowermost article from moving downward with the upper pedal retracted from the article storage passage and with the lower pedal advanced to the article storage passage to be in a first standby position in which the lowermost article is placed on a top face of the lower pedal, the article discharging apparatus, when being driven, discharging the lowermost article downward with the upper pedal advanced to the article storage passage to come into contact with a second lowermost article and with the lower pedal retracted from the article storage passage, wherein the lower pedal is in a second standby position in which the tip of the lower pedal is positioned at a position upper than in the first standby position when no article is placed on the top face of the lower pedal advanced to the article storage passage, the article dispensing apparatus further comprising:

an out-of-stock detection switch that is turned to a first state when the lower pedal is in the second standby position and that is turned to a second state when the lower pedal is in a position other than the second standby position;

an output member that is rotatably provided about a central axis of the article dispensing apparatus, puts the article discharging apparatus in the standby state when the output member is at a standby position, and drives the article discharging apparatus when the output member rotates from the standby position; and a controller that rotates the output member in a first direction to return the output member to the standby position when the output member rotated from the standby position in the first direction does not return to the standby position in a preset set time and when the out-of-stock detection switch is turned to the first state in the set time.

2. The article dispensing apparatus according to claim 1, wherein, when the output member rotated from the standby position in the first direction does not return to the standby position in the set time, the controller stops rotation of the output member and determines whether the out-of-stock detection switch is turned to the first state in a preset standby time, and when the out-of-stock detection switch is turned to the first state in the set time and the standby time, the controller rotates the output member in the first direction to return the output member to the standby position.

3. An article dispensing apparatus comprising:

an article discharging apparatus including a base, an article storage passage that stores therein charged articles in an up- and down direction, a lower pedal swingably arranged on the base in such a manner that a tip of the lower pedal advances and retracts to and from the article storage passage, and an upper pedal swingably arranged on the base in such a manner that a tip of the upper pedal advances and retracts to and from the article storage passage in an area above the lower pedal, the article discharging apparatus, in a standby state, preventing a lowermost article from moving downward with the upper pedal retracted from the article storage passage and with the lower pedal advanced to the article storage passage to be in a first standby position in which the lowermost article is placed on a top face of the lower pedal, the article discharging apparatus, when being driven, discharging the lowermost article downward with the upper pedal advanced to the article storage passage to come into contact with a second lowermost article and with the lower pedal retracted from the article storage passage, wherein the lower pedal is in a second standby position in which the tip of the lower pedal is positioned at a position upper than in the first standby position when no article is placed on the top face of the lower pedal advanced to the article storage passage, the article dispensing apparatus further comprising:

an out-of-stock detection switch that is turned to a first state when the lower pedal is in the second standby position and that is turned to a second state when the lower pedal is in a position other than the second standby position;

an output member that is rotatably provided about a central axis of the article dispensing apparatus, puts the article discharging apparatus in the standby state when the output member is at a standby position, and drives the article discharging apparatus when the output member rotates from the standby position; and a controller that rotates the output member in a second direction to return the output member to the standby position when the output member rotated from the standby position in a first direction opposite to the second direction does not return to the standby position in a preset set time, wherein the controller stops rotation of the output member when the output member returns to the standby position and when the out-of-stock detection switch is turned to the first state in a drive time that lasts until the output member returns to the standby position.

4. The article dispensing apparatus according to claim 3, wherein, when the output member rotated from the standby position in the first direction does not return to the standby position in the set time and when the out-of-stock detection switch is not turned to the first state in the set time, the controller rotates the output member in the second direction to return the output member to the standby position.

5. The article dispensing apparatus according to claim 4, wherein, when the output member rotated from the standby position in the first direction does not return to the standby position in the set time, the controller stops rotation of the output member and determines whether the out-of-stock detection switch is turned to the first state in a preset standby time, and when the out-of-stock detection switch is not turned to the first state in the set time and the standby time, the controller rotates the output member in the second direction to return the output member to the standby position.

6. An article dispensing apparatus comprising:

an article discharging apparatus including a base, an article storage passage that stores therein charged articles in an up-and-down direction, a lower pedal swingably arranged on the base in such a manner that a tip of the lower pedal advances and retracts to and from the article storage passage, an upper pedal swingably arranged on the base in such a manner that a tip of the upper pedal advances and retracts to and from the article storage passage in an area above the lower pedal, the article discharging apparatus, in a standby state, preventing a lowermost article from moving downward with the upper pedal retracted from the article storage passage and with the lower pedal advanced to the article storage passage, the article discharging apparatus, when being driven, discharging the lowermost article downward with the upper pedal advanced to the article storage passage to come into contact with a second lowermost article and with the lower pedal retracted from the article storage passage;

an output member that is rotatably provided about a central axis of the article dispensing apparatus, puts the article discharging apparatus in the standby state when the output member is at a standby position, and drives the article discharging apparatus when the output member is rotated from the standby position by a driving force given thereto from a driving source in accordance with a discharging instruction; and a controller that rotates the output member in a second direction to return the output member to the standby position when the output member rotated from the standby position in a first direction opposite to the second direction does not return to the standby position in a preset set time, wherein when the output member returns to the standby position and when a returning time for the output member to return to the standby position is equal to or greater than a preset reference time, the controller determines that an article has been discharged and stops rotation of the output member.

7. The article dispensing apparatus according to claim 6, wherein, when the output member returns to the standby position and when the returning time is less than the reference time, the controller determines that no article has been discharged and rotates the output member again in the first direction.

8. An article dispensing apparatus comprising:

an article discharging apparatus including a base, an article storage passage that stores therein charged articles in an up-and-down direction, a lower pedal swingably arranged on the base in such a manner that a tip of the lower pedal advances and retracts to and from the article storage passage, an upper pedal swingably arranged on the base in such a manner that a tip of the upper pedal advances and retracts to and from the article storage passage in an area above the lower pedal, the article discharging apparatus, in a standby state, preventing a lowermost article from moving downward with the upper pedal retracted from the article storage passage and with the lower pedal advanced to the article storage passage to be in a first standby position in which the lowermost article is placed on a top face of the lower pedal, the article discharging apparatus, when being driven, discharging the lowermost article downward with the upper pedal advanced to the article storage passage to come into contact with a second lowermost article and with the lower pedal retracted from the article storage passage, wherein the lower pedal is in a second standby position in which the tip of the lower pedal is positioned at a position upper than in the first standby position when no article is placed on the top face of the lower pedal advanced to the article storage passage, the article dispensing apparatus further comprising:

an out-of-stock detection switch that is turned to a first state when the lower pedal is in the second standby position and that is turned to a second state when the lower pedal is in a position other than the second standby position;

an output member that is rotatably provided about a central axis of the article dispensing apparatus, puts the article discharging apparatus in the standby state when the output member is at a standby position, and drives the article discharging apparatus when the output member rotates from the standby position; and a controller that determines that an abnormality has occurred when the output member rotated from the standby position in a first direction returns to the standby position and when the out-of-stock detection switch is not turned to the first state.

9. An article dispensing apparatus comprising:

an article discharging apparatus including a base, an article storage passage that stores therein charged articles, a lower pedal swingably arranged on a base in such a manner that a tip of the lower pedal advances and retracts to and from an article storage passage, an upper pedal swingably arranged on the base in such a manner that a tip of the upper pedal advances and retracts to and from the article storage passage in an area above the lower pedal, the article discharging apparatus, in a standby state, preventing a lowermost article from moving downward with the upper pedal retracted from the article storage passage and with the lower pedal advanced to the article storage passage, the article discharging apparatus, when being driven, discharging the lowermost article downward with the upper pedal advanced to the article storage passage to come into contact with a second lowermost article and with the lower pedal retracted from the article storage passage;

an output member that is rotatably provided about a central axis of the article dispensing apparatus, puts the article discharging apparatus in the standby state when the output member is at a standby position, and drives the article discharging apparatus when the output member is rotated from the standby position by a driving force given thereto from a driving source in accordance with a discharging instruction; and a controller that stops rotation of the output member for a certain time with the upper pedal kept advanced to the article storage passage when the output member is rotated from the standby position to drive the article discharging apparatus.

* * * * *